US011098554B2

(12) United States Patent
Brown

(10) Patent No.: US 11,098,554 B2
(45) Date of Patent: Aug. 24, 2021

(54) EXPANDING AND COLLAPSING APPARATUS AND METHODS OF USE

(71) Applicants: PEAK WELL SYSTEMS PTY LTD, Bayswater (AU); PEAK WELL SYSTEMS LIMITED, Aberdeen (GB)

(72) Inventor: Gareth Edward George Brown, Ellon (GB)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 22 days.

(21) Appl. No.: 16/066,038

(22) PCT Filed: Dec. 23, 2016

(86) PCT No.: PCT/GB2016/054058

§ 371 (c)(1),
(2) Date: Jun. 25, 2018

(87) PCT Pub. No.: WO2017/109506

PCT Pub. Date: Jun. 29, 2017

(65) Prior Publication Data

US 2019/0352997 A1 Nov. 21, 2019

(30) Foreign Application Priority Data

Dec. 23, 2015 (GB) ..... 1522725

(51) Int. Cl.
*E21B 33/128* (2006.01)
*E21B 23/01* (2006.01)
(Continued)

(52) U.S. Cl.
CPC ..... *E21B 33/1216* (2013.01); *E21B 33/128* (2013.01); *E21B 33/134* (2013.01)

(58) Field of Classification Search
CPC .... E21B 29/005; E21B 23/01; E21B 33/1208; E21B 33/128; B26D 3/163; B23D 21/14
(Continued)

(56) References Cited

U.S. PATENT DOCUMENTS 9,043 A 6/1852 Wright
758,186 A 4/1904 Morton
(Continued)

FOREIGN PATENT DOCUMENTS

CH 295473 A 12/1953
DE 814546 A 9/1951
(Continued)

OTHER PUBLICATIONS

Examination Report issued in the related GB Application 1622147.5, dated Jan. 31, 2019 (2 pages).
(Continued)

*Primary Examiner* — Kenneth L Thompson
(74) *Attorney, Agent, or Firm* — Eileen Pape

(57) ABSTRACT

The invention provides an expanding and/or collapsing apparatus and a method of use. The apparatus comprises a plurality of elements assembled together to form a ring structure oriented in a plane around a longitudinal axis. The ring structure is operable to be moved between an expanded condition and a collapsed condition by movement of the plurality of elements. The plurality of elements is operable to be moved between the expanded and collapsed conditions by sliding with respect to one another in the plane of the ring structure, in a direction tangential to a circle concentric with the ring structure. Applications of the invention include oilfield devices, including anti-extrusion rings, plugs, packers, locks, patching tools, connection systems, and variable diameter tools run in a wellbore.

33 Claims, 31 Drawing Sheets

(51) Int. Cl.
*E21B 33/12* (2006.01)
*E21B 33/134* (2006.01)

(58) Field of Classification Search
USPC ..... 83/178
See application file for complete search history.

(56) References Cited

U.S. PATENT DOCUMENTS

| | | | | |
|---|---|---|---|---|
| 865,998 | A | 9/1907 | Cook | |
| 1,594,259 | A | 7/1926 | Hardman | |
| 1,776,415 | A | 9/1930 | Class | |
| 2,169,735 | A | 8/1939 | Keller | |
| 2,052,846 | A | 9/1939 | Ryba | |
| 2,287,205 | A | 6/1942 | Stone | |
| 2,355,308 | A | 8/1944 | Kurzina, Jr. | |
| 2,609,836 | A | 9/1952 | Knox | |
| 2,613,763 | A | 10/1952 | Campbell | |
| 2,701,615 | A | 2/1955 | Riordan, Jr. | |
| 3,572,627 | A | 3/1971 | Jones | |
| 3,603,411 | A | 9/1971 | Link | |
| 3,915,424 | A | 10/1975 | LeRouax | |
| 3,937,412 | A | 2/1976 | Damour | |
| 4,460,150 | A | 7/1984 | Turlak et al. | |
| 4,842,082 | A | 6/1989 | Springer | |
| 5,341,888 | A | 8/1994 | Deschutter | |
| 5,507,465 | A * | 4/1996 | Borle | E21B 33/06 251/1.1 |
| 5,678,635 | A | 10/1997 | Dunlap et al. | |
| 5,685,078 | A | 11/1997 | Obst et al. | |
| 6,598,672 | B2 | 7/2003 | Bell et al. | |
| 7,290,603 | B2 | 11/2007 | Hiorth et al. | |
| 7,389,822 | B2 * | 6/2008 | Lohbeck | E21B 43/105 166/384 |
| 7,921,921 | B2 | 4/2011 | Bishop et al. | |
| 7,992,634 | B2 | 8/2011 | Angelle et al. | |
| 8,083,001 | B2 | 12/2011 | Conner et al. | |
| 8,167,033 | B2 | 5/2012 | White | |
| 8,459,344 | B1 | 6/2013 | Stone | |
| 8,555,980 | B1 | 10/2013 | Powell | |
| 8,733,453 | B2 | 5/2014 | Guerrero et al. | |
| 9,038,723 | B2 * | 5/2015 | Trudeau | B23D 21/14 166/298 |
| 9,051,812 | B2 * | 6/2015 | Clemens | E21B 23/01 |
| 9,806,566 | B2 | 10/2017 | Nagao et al. | |
| 10,258,361 | B2 | 4/2019 | Dickerson et al. | |
| 10,487,614 | B2 | 11/2019 | MacDonald | |
| 2007/0200299 | A1 * | 8/2007 | Kunz | F16J 15/125 277/511 |
| 2010/0071908 | A1 | 3/2010 | Bishop et al. | |
| 2011/0061857 | A1 | 3/2011 | White | |
| 2011/0127131 | A1 | 6/2011 | Simons et al. | |
| 2013/0112398 | A1 | 5/2013 | White | |
| 2013/0168076 | A1 | 7/2013 | Davis | |
| 2013/0269929 | A1 | 10/2013 | Smith | |
| 2013/0319654 | A1 | 12/2013 | Hiorth et al. | |
| 2014/0284047 | A1 * | 9/2014 | Lovslett | E21B 23/06 166/101 |
| 2015/0176361 | A1 * | 6/2015 | Prosser | E21B 34/14 166/192 |
| 2015/0275619 | A1 * | 10/2015 | Slup | E21B 33/1216 166/387 |
| 2016/0123100 | A1 | 5/2016 | Tse | |
| 2017/0370176 | A1 * | 12/2017 | Frazier | E21B 33/1212 |
| 2019/0264547 | A1 | 8/2019 | Cornelissen | |
| 2019/0352988 | A1 * | 11/2019 | Brown | E21B 23/01 |
| 2019/0352997 | A1 * | 11/2019 | Brown | E21B 33/134 |
| 2019/0360288 | A1 * | 11/2019 | Brown | E21B 33/1216 |
| 2019/0368274 | A1 * | 12/2019 | Brown | E21B 7/28 |

FOREIGN PATENT DOCUMENTS

| | | | |
|---|---|---|---|
| DE | 1775899 | A1 | 10/1971 |
| EP | 0533326 | A1 | 3/1993 |
| FR | 2996816 | A1 | 4/2014 |
| GB | 191010637 | A | 3/1911 |
| GB | 601318 | A | 5/1948 |
| GB | 1452272 | A | 10/1976 |
| GB | 1484814 | A | 9/1977 |
| GB | 2127068 | A | 4/1984 |
| GB | 2097491 | B | 2/1985 |
| GB | 2488152 | A | 8/2012 |
| JP | S643330 | A1 | 1/1989 |
| JP | 2000120365 | A | 4/2000 |
| WO | 2017109506 | A2 | 6/2017 |
| WO | 2017109508 | A1 | 6/2017 |
| WO | 2017109509 | A1 | 6/2017 |
| WO | 2017109510 | A1 | 6/2017 |
| WO | 2017109511 | A1 | 6/2017 |

OTHER PUBLICATIONS

International Search and Written Opinion issued in the related PCT Application PCT/GB2016/054064, dated May 8, 2017 (11 pages).
International Preliminary Report on Patentability issued in the related PCT Application PCT/GB2016/054064, dated Jun. 26, 2018 (7 pages).
Combined Search and Examination Report issued in the related GB Application 1622148.3, dated Jun. 21, 2017 (9 pages).
Examination Report issued in the related GB Application 1622148.3, dated Jul. 24, 2019 (4 pages).
International Search and Written Opinion issued in the related PCT Application PCT/GB2016/054065, dated May 8, 2017 (10 pages).
International Preliminary Report on Patentability issued in the related PCT Application PCT/GB2016/054065, dated Jun. 26, 2018 (6 pages).
Combined Search and Examination Report issued in the related GB Application 1622150.9, dated Mar. 31, 2017 (5 pages).
International Search and Written Opinion issued in the related PCT Application PCT/GB2016/054066, dated May 8, 2017 (9 pages).
International Preliminary Report on Patentability issued in the related PCT Application PCT/GB2016/054066, dated Jun. 26, 2018 (6 pages).
Combined Search and Examination Report issued in the related GB Application 1622151.9, dated Apr. 27, 2017 (5 pages).
Examination Report issued in the related GB Application 1622151.9, dated Jan. 24, 2019 (3 pages).
International Search and Written Opinion issued in the related PCT Application PCT/GB2016/054067, dated May 8, 2017 (11 pages).
International Preliminary Report on Patentability issued in the related PCT Application PCT/GB2016/054067, dated Jun. 26, 2018 (7 pages).
Combined Search and Examination Report issued in the related GB Application 1622152.5, dated Apr. 27, 2017 (7 pages).
International Search and Written Opinion issued in the related PCT Application PCT/GB2016/054058, dated Jun. 21, 2017 (12 pages).
International Preliminary Report on Patentability issued in the related PCT Application PCT/GB2016/054058, dated Jun. 26, 2018 (8 pages).
Combined Search and Examination Report issued in the related GB Application 1622147.5, dated Apr. 27, 2017 (7 pages).
Office Action received in U.S. Appl. No. 16/066,044 dated Feb. 20, 2020, 19 pages.
Office Action received in U.S. Appl. No. 16/066,046 dated Mar. 2, 2020, 18 pages.
Office Action received in U.S. Appl. No. 16/066,049 dated Mar. 16, 2020, 15 pages.
Office Action received in U.S. Appl. No. 16/066,050 dated Feb. 22, 2021, 26 pages.

* cited by examiner

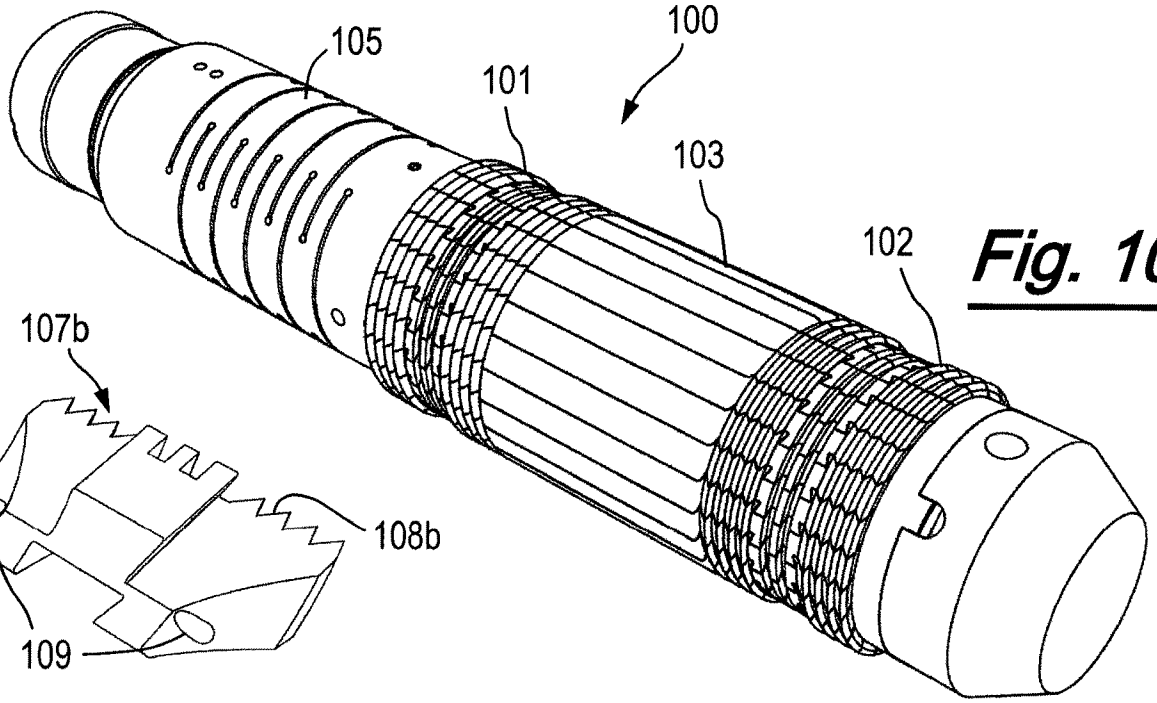
Fig. 10A
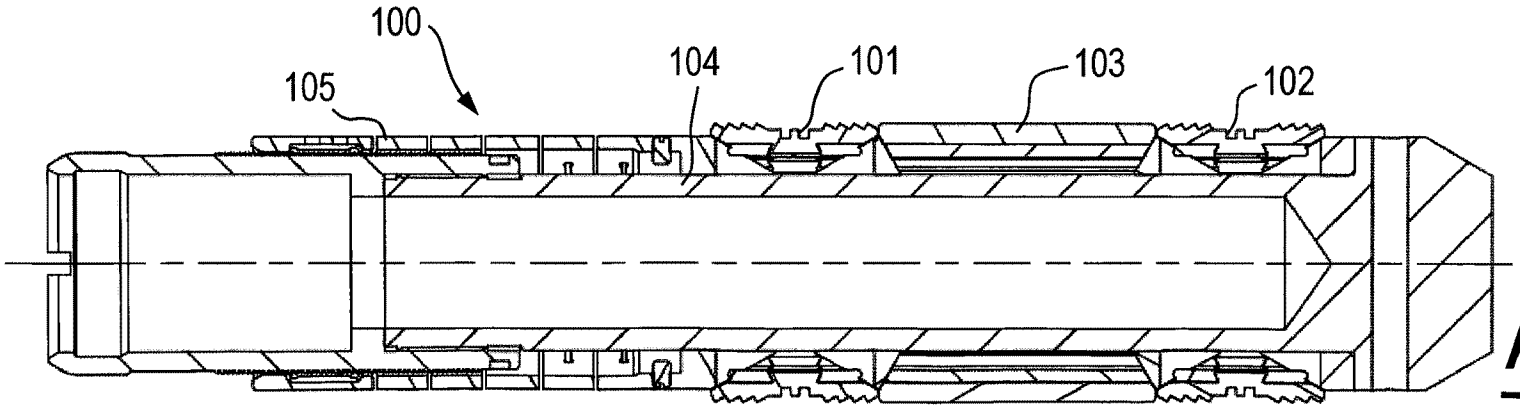
Fig. 10B
Fig. 11B
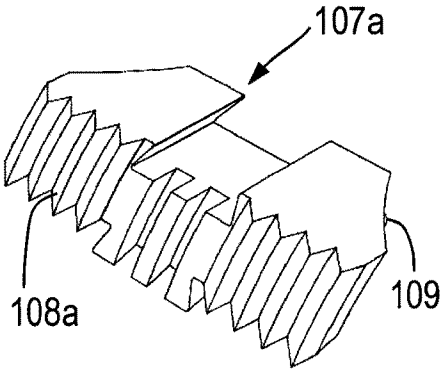
Fig. 11A

EXPANDING AND COLLAPSING APPARATUS AND METHODS OF USE

This application is the U.S. National Stage of International Application No. PCT/GB2016/054058, filed Dec. 23, 2016. This application also claims the benefit of GB patent application No. 1522725.9, filed Dec. 23, 2015, the contents of both of which are hereby incorporated by reference in their entirety.

The present invention relates to an expanding and collapsing apparatus and methods of use, and in particular aspects, to an expanding apparatus in the form of a ring, operable to move between a collapsed condition and an expanded condition. The invention also relates to tools and devices incorporating the expansion apparatus and methods of use. Preferred embodiments of the invention relate to oilfield apparatus (including but not limited to downhole apparatus and wellhead apparatus) incorporating the apparatus and methods of use.

BACKGROUND TO THE INVENTION

In many fields of mechanical engineering, and in the field of hydrocarbon exploration and production in particular, it is known to provide expansion mechanisms for the physical interaction of tubular components. Expansion mechanisms may expand outwardly to engage an external surface, or may collapse inwardly to engage an internal surface.

Applications are many and varied, but in hydrocarbon exploration and production include the actuation and setting of flow barriers and seal elements such as plugs and packers, anchoring and positioning tools such as wellbore anchors, casing and liner hangers, and locking mechanisms for setting equipment downhole. Other applications include providing mechanical support or back up for elements such as elastomers or inflatable bladders.

A typical anti-extrusion ring is positioned between a packer or seal element and its actuating slip members, and is formed from a split or segmented metallic ring. During deployment of the packer or seal element, the segments move to a radially expanded condition. During expansion and at the radially expanded condition, spaces are formed between the segments, as they are required to occupy a larger annular volume. These spaces create extrusion gaps, which may result in failure of the packer or seal under working conditions.

Various configurations have been proposed to minimise the effect of spaces between anti-extrusion segments, including providing multi-layered rings, such that extrusion gaps are blocked by an offset arrangement of segments. For example, U.S. Pat. No. 6,598,672 describes an anti-extrusion rings for a packer assembly which has first and second ring portions which are circumferentially offset to create gaps in circumferentially offset locations.

U.S. Pat. No. 2,701,615 discloses a well packer comprising an arrangement of crowned spring metal elements which are expanded by relative movement.

Other proposals, for example those disclosed in U.S. Pat. Nos. 3,572,627, 7,921,921, US 2013/0319654, U.S. Pat. Nos. 7,290,603 and 8,167,033 include arrangements of circumferentially lapped segments. U.S. Pat. No. 3,915,424 describes a similar arrangement in a drilling BOP configuration, in which overlapping anti-extrusion members are actuated by a radial force to move radially and circumferentially to a collapsed position which supports annular sealing elements. Such arrangements avoid introducing extrusion gaps during expansion, but create a ring with uneven or stepped faces or flanks. These configurations do not provide an unbroken support wall for a sealing element, are spatially inefficient, and may be difficult to reliably move back to their collapsed configurations.

U.S. Pat. No. 8,083,001 proposes an alternative configuration in which two sets of wedge shaped segments are brought together by sliding axially with respect to one another to create an expanded gauge ring.

In anchoring, positioning, setting, locking and connection applications, radially expanding and collapsing structures are typically circumferentially distributed at discrete locations when at their increased outer diameter. This reduces the surface area available to contact an auxiliary engagement surface, and therefore limits the maximum force and pressure rating for a given size of device.

SUMMARY OF THE INVENTION

It is amongst the claims and objects of the invention to provide an expanding and collapsing apparatus and methods of use which obviate or mitigate disadvantages of previously proposed expanding and collapsing apparatus.

It is amongst the aims and objects of the invention to provide an oilfield apparatus, including a downhole apparatus or a wellhead apparatus, incorporating an expanding and collapsing apparatus, which obviates or mitigates disadvantages of prior art oilfield apparatus.

Further aims and objects of the invention will be apparent from reading the following description.

According to a first aspect of the invention, there is provided an apparatus comprising: a plurality of elements assembled together to form a ring structure oriented in a plane around a longitudinal axis;

wherein the ring structure is operable to be moved between an expanded condition and a collapsed condition by movement of the plurality of elements on actuation by an axial force;

and wherein the plurality of elements is operable to be moved between the expanded and collapsed conditions by sliding with respect to one another in the plane of the ring structure, in a direction tangential to a circle concentric with the ring structure.

The collapsed condition may be a first condition of the apparatus, and the expanded condition may be a second condition of the apparatus. Thus the apparatus may be normally collapsed, and may be actuated to be expanded. Alternatively, the expanded condition may be a first condition of the apparatus, and the collapsed condition may be a second condition of the apparatus. Thus the apparatus may be normally expanded, and may be actuated to be collapsed.

The plane of the ring structure may be perpendicular to the longitudinal axis. The ring structure, and its plane of orientation, may be operable to move on the apparatus during expansion and/or collapsing. The movement of the plane may be an axial sliding movement, during expanding and/or collapsing of the ring structure.

The ring structure may comprise one or more ring surfaces, which may be presented to an auxiliary surface, for example the surface of a tubular, when actuated to an expanded condition or a collapsed condition. The one or more ring surfaces may include a ring surface which is parallel to the longitudinal axis of the apparatus. Alternatively, or in addition, the one or more ring surfaces may include a surface which is perpendicular to the longitudinal axis of the apparatus, and/or a surface which is inclined to the longitudinal axis of the apparatus.

The ring surface may be an outer ring surface, and may be a substantially cylindrical surface. The ring surface may be arranged to contact or otherwise interact with an inner surface of a tubular or bore.

Alternatively, the ring surface may be an inner surface of the ring structure, and may be a substantially cylindrical surface. The ring surface may be arranged to contact or otherwise interact with an outer surface of a tubular or cylinder.

The ring surface may be substantially smooth. Alternatively, the ring surface may be profiled, and/or may be provided with one or more functional formations thereon, for interacting with an auxiliary surface.

In the collapsed condition, the elements may be arranged generally at collapsed radial positions, and may define a collapsed outer diameter and inner diameter of the ring structure.

In the expanded condition, the elements may be arranged generally at expanded radial positions, and may define an expanded outer diameter and inner diameter of the ring structure. The ring surface may be located at or on the expanded outer diameter of the ring structure, or may be located at or on the collapsed inner diameter of the ring structure.

In the collapsed condition, the elements may occupy a collapsed annular volume, and in the expanded condition the elements may occupy an expanded annular volume. The collapsed annular volume and the expanded annular volume may be discrete and separated volumes, or the volumes may partially overlap.

The elements may be configured to move between their expanded and collapsed radial positions in a path which is tangential to a circle described around and concentric with the longitudinal axis.

Preferably, each element of the ring structure comprises a first contact surface and second contact surface respectively in abutment with first and second adjacent elements. The elements may be configured to slide relative to one another along their respective contact surfaces.

The first contact surface and/or the second contact surface may be oriented tangentially to a circle described around and concentric with the longitudinal axis. The first contact surface and the second contact surface are preferably non-parallel. The first contact surface and the second contact surface may converge towards one another in a direction towards an inner surface of the ring structure (and may therefore diverge away from one another in a direction away from an inner surface of the ring structure).

At least some of the elements are preferably provided with interlocking profiles for interlocking with an adjacent element. Preferably the interlocking profiles are formed in the first and/or second contact surfaces. Preferably, an element is configured to interlock with a contact surface of an adjacent element. Such interlocking may prevent or restrict separation of assembled adjacent elements in a circumferential and/or radial direction of the ring structure, while enabling relative sliding movement of adjacent elements.

Preferably, at least some of, and more preferably all of, the elements assembled to form a ring are identical to one another, and each comprises an interlocking profile which is configured to interlock with a corresponding interlocking profile on another element. The interlocking profiles may comprise at least one recess such as groove, and at least one protrusion, such as a tongue or a pin, configured to be received in the groove. The interlocking profiles may comprise at least one dovetail recess and dovetail protrusion.

The first and second contact surfaces of an element may be oriented on first and second planes, which may intersect an inner surface of the ring at first and second intersection lines, such that a sector of an imaginary cylinder is defined between the longitudinal axis and the intersection lines. The central angle of the sector may be 45 degrees or less. Such a configuration corresponds to eight or more elements assembled together to form the ring structure.

Preferably, the central angle of the sector is 30 degrees or less, corresponding to twelve or more elements assembled together to form the ring. More preferably, the central angle of the sector is in the range of 10 degrees to 20 degrees, corresponding to eighteen to thirty-six elements assembled together to form the ring. In a particular preferred embodiment, the central angle of the sector is 15 degrees, corresponding to twenty-four elements assembled together to form the ring structure.

Preferably, an angle described between the first contact and second contact surfaces corresponds to the central angle of the sector. Preferably therefore, an angle described between the first contact and second contact surfaces is in the range of 10 degrees to 20 degrees, and in a particular preferred embodiment, the angle described between the first contact and second contact surfaces is 15 degrees, corresponding to twenty-four elements assembled together to form the ring structure.

In a preferred embodiment, the apparatus comprises a support surface for the ring structure. The support surface may be the outer surface of a mandrel or tubular. The support surface may support the ring structure in a collapsed condition of the apparatus.

The support surface may be the inner surface of a mandrel or tubular. The support surface may support the ring structure in an expanded condition of the apparatus.

In some embodiments, the apparatus is operated in its expanded condition, and in other embodiments, the apparatus is operated in its collapsed condition. Preferably, elements forming the ring structure are mutually supportive in an operating condition of the apparatus. Where the operating condition of the apparatus its expanded condition (i.e. when the apparatus is operated in its expanded condition), the ring structure is preferably a substantially solid ring structure in its expanded condition, and the elements may be fully mutually supported.

Where the operating condition of the apparatus its collapsed condition (i.e. when the apparatus is operated in its collapsed condition), the ring structure is preferably a substantially solid ring structure in its collapsed condition, and the elements may be fully mutually supported.

The apparatus may comprise a formation configured to impart a radial expanding or collapsing force component to the elements of a ring structure from an axial actuation force. The apparatus may comprise a pair of formations configured to impart a radial expanding or collapsing force component to the elements of a ring structure from an axial actuation force. The formation (or formations) may comprise a wedge or wedge profile, and may comprise a cone wedge or wedge profile.

The apparatus may comprise a biasing means, which may be configured to bias the ring structure to one of its expanded or collapsed conditions. The biasing means may comprise a circumferential spring, a garter spring, or a spiral retaining ring. The biasing means may be arranged around an outer surface of a ring structure, to bias it towards a collapsed condition, or may be arranged around an inner surface of a ring structure, to bias it towards an expanded condition. One or more elements may comprise a formation such as a groove for receiving the biasing means. Preferably, grooves in the elements combine to form a circumferential groove in the ring structure. Multiple biasing means may be provided on the ring structure.

The apparatus may comprise a secondary expanding and collapsing mechanism operable to move the ring structure between a first expanded condition to a second expanded condition on actuation by an axial force.

The ring structure may be a first ring structure, and the apparatus may comprise at least one additional ring structure, wherein the additional ring structure is operable to move the first ring structure from an intermediate expanded condition to a fully expanded condition.

The apparatus may comprise at least one pair of additional ring structures, wherein the pair of additional ring structures are operable to move the first ring structure from an intermediate expanded condition to a fully expanded condition. The pair of additional ring structures may be disposed (axially) on either side of the first ring structure, and may act together to move the ring structure from an intermediate expanded condition to a fully expanded condition.

The additional ring structure may comprise a plurality of elements assembled together to form a ring structure, and may be oriented in a plane around a longitudinal axis. The additional ring structure may be operable to be moved between an expanded condition and a collapsed condition by movement of the plurality of elements on actuation by an axial force. The plurality of elements of the additional ring structure may be operable to be moved between the expanded and collapsed conditions by sliding with respect to one another in the plane of the additional ring structure, in a direction tangential to a circle concentric with the additional ring structure. In other respects, the additional ring structure and its elements may have features in common with the ring structure described herein.

The additional ring structure, and/or its elements, may be operable to transfer an axial actuation force to the elements of the first ring structure. The additional ring structure, and/or its elements may comprise one or more wedge profiles, which may be conical wedge profiles. The one or more wedge profiles may be defined by an outer surface of the elements of the additional ring structure.

The apparatus may comprise a plurality of additional ring structures, which may be arranged in functional pairs, and/or which may be operable to move the first ring structure from an intermediate expanded condition to a subsequent intermediate expanded condition, or a fully expanded condition.

Preferably, each additional ring structure comprises a biasing means, which may be configured to bias the first ring structure to one of its expanded or collapsed conditions. The biasing means may comprise a circumferential spring, a garter spring, or a spiral retaining ring. Preferably, the biasing means of the first and additional ring structures are selected to define a sequence of expanding and collapsing of the apparatus. Preferably, the biasing means of the first and additional ring structures are selected to expand the centremost ring structure before an adjacent pair of additional ring structures. The biasing means additional ring structures may be selected to expand a first pair of additional ring structures before an adjacent pair of additional ring structures located axially outside of the first pair or additional ring structures.

Preferably, a functional pair of additional ring structures and/or the elements thereof is symmetrical about a centre ring structure. Each of a functional pair of additional ring structures and/or the elements thereof may be configured to move axially with respect to one another on the apparatus, and may be configured to move into abutment with one another. Preferably, each of a functional pair of additional ring structures and/or the elements thereof are configured to limit the travel of a corresponding additional ring structures and/or the elements thereof.

The surfaces of the plurality of elements may be configured to be presented directly against a surface with which it interacts, such as a borehole wall. Alternatively, or in addition, the apparatus may comprise an intermediate structure or material disposed between the surfaces of the elements and a surface with which it interacts.

In one embodiment, the elements of the ring structure are configured to conform, deform or compress in a collapsed condition to form a fluid barrier or seal with an object in the throughbore. The elements may be formed, at least partially, from a compressible and/or resilient material, such as an elastomer, rubber or polymer.

Alternatively, or in addition, the elements may be formed, at least partially, from a metal or metal alloy, and may be coated or covered with a compressible and/or resilient material, such as an elastomer, rubber or polymer.

According to a second aspect of the invention, there is provided an expanding and collapsing ring apparatus comprising:

a plurality of elements assembled together to form a ring structure around a longitudinal axis;

wherein the ring structure is operable to be moved between an expanded condition and a collapsed condition by movement of the plurality of elements on actuation by an axial force;

wherein the plurality of elements is operable to be moved between the expanded and collapsed conditions in a plane perpendicular to the longitudinal axis, by sliding with respect to an adjacent pair of elements.

Embodiments of the second aspect of the invention may include one or more features of the first aspect of the invention or its embodiments, or vice versa.

According to a third aspect of the invention, there is provided an expanding and collapsing ring apparatus comprising:

a plurality of elements assembled together to form a ring structure around a longitudinal axis;

wherein the ring structure is operable to be moved between an expanded condition and a collapsed condition by movement of the plurality of elements on actuation by an axial force;

wherein the plurality of elements is operable to be moved between the expanded and collapsed conditions by sliding relative to one another in directions tangential to a circle concentric with the longitudinal axis.

Embodiments of the third aspect of the invention may include one or more features of the first or second aspects of the invention or their embodiments, or vice versa.

According to a fourth aspect of the invention, there is provided an expanding and collapsing ring apparatus comprising:

a plurality of elements assembled together to form a ring structure around a longitudinal axis;

wherein the ring structure is operable to be moved between an expanded condition and a collapsed condition on actuation by an axial force;

wherein in the expanded condition, the plurality of elements combine to form a solid ring structure having a substantially smooth outer surface.

Preferably, the plurality of elements combine to form a solid ring structure having a substantially smooth outer surface in the collapsed condition and/or in a partially expanded or partially collapsed condition. Preferably, the plurality of elements combine to form a solid ring structure in a number of intermediate positions between a collapsed condition and an expanded condition, and most preferably all intermediate positions, having a substantially smooth outer surface.

The substantially smooth outer surface may comprise a smooth circular profile in a plane parallel to the plane of the ring structure. The substantially smooth outer surface may be substantially unbroken. Preferably, the smooth outer surface comprises one or more smooth side surfaces. The substantially smooth outer surface may comprise a smooth radially extending surface, and may comprise a first side of an annular projection defined by the ring structure in its expanded condition. The smooth surface may comprise a first side and an opposing second side of an annular projection defined by the ring structure in its expanded condition. Thus one or more flanks or faces of the ring structure, which are the surfaces presented in the longitudinal direction, may have smooth surfaces.

Preferably, the plurality of elements is operable to be moved between the expanded and collapsed conditions in the plane of the ring structure. The plurality of elements may be operable to be moved between the expanded and collapsed conditions by sliding with respect to an adjacent pair of elements. Sliding may be in a direction tangential to a circle concentric with the ring structure.

Embodiments of the fourth aspect of the invention may include one or more features of the first to third aspects of the invention or their embodiments, or vice versa.

According to a fifth aspect of the invention, there is provided an oilfield tool comprising the apparatus of any of the first to fourth aspects of the invention.

The oilfield tool may be a downhole tool. Alternatively, the oilfield tool may comprise a wellhead tool.

The downhole tool may comprise a downhole tool selected from the group consisting of a plug, a packer, an anchor, a tubing hanger, or a downhole locking tool.

The plug may be a bridge plug, and may be a retrievable bridge plug. Alternatively, the plug may be a permanent plug.

Embodiments of the fifth aspect of the invention may include one or more features of the first to fourth aspects of the invention or their embodiments, or vice versa.

According to a sixth aspect of the invention, there is provided variable diameter downhole tool, the tool comprising an apparatus according to a previous aspect of the invention.

The downhole tool may be selected from the group consisting of a wellbore centraliser, a wellbore broach tool, and a wellbore drift tool. The downhole tool may be a stabiliser tool. The downhole tool may be a stabilising and centring tool, and/or may be configured for use with non-sealing devices, including drilling, milling and cutting tools.

Embodiments of the sixth aspect of the invention may include one or more features of the first to fourth aspects of the invention or their embodiments, or vice versa.

According to a seventh aspect of the invention, there is provided a connector system comprising a first connector and a second connector, wherein one of the first and second connectors comprises the apparatus of any of the first to fourth aspects of the invention.

Embodiments of the seventh aspect of the invention may include one or more features of the first to fourth aspects of the invention or their embodiments, or vice versa.

According to an eighth aspect of the invention, there is provided a patch apparatus for a fluid conduit or tubular, the patch apparatus comprising the apparatus of any of the first to fourth aspects of the invention.

Embodiments of the eighth aspect of the invention may include one or more features of the first to fourth aspects of the invention or their embodiments, or vice versa.

According to a ninth aspect of the invention, there is provided a method of expanding an apparatus, the method comprising:

providing an apparatus comprising a plurality of elements assembled together to form a ring structure oriented in a plane around a longitudinal axis;

imparting an axial force to the ring structure to move the plurality of elements by sliding with respect to one another in the plane of the ring structure, in a direction tangential to a circle concentric with the ring structure; thereby moving the ring structure from a collapsed condition to an expanded condition.

Embodiments of the ninth aspect of the invention may include one or more features of the first to fourth aspects of the invention or their embodiments, or vice versa.

According to a tenth aspect of the invention, there is provided a method of collapsing an apparatus, the method comprising:

providing an apparatus comprising a plurality of elements assembled together to form a ring structure oriented in a plane around a longitudinal axis;

releasing or reducing an axial force from the ring structure to move the plurality of elements by sliding with respect to one another in the plane of the ring structure, in a direction tangential to a circle concentric with the ring structure, thereby moving the ring structure from an expanded condition to a collapsed condition.

Embodiments of the tenth aspect of the invention may include one or more features of the first to fourth aspects of the invention or their embodiments, or vice versa.

According to a further aspect of the invention, there is provided an apparatus comprising: a plurality of elements assembled together to form a ring structure oriented in a plane around a longitudinal axis;

wherein the ring structure is operable to be moved between an expanded condition and a collapsed condition by movement of the plurality of elements;

and wherein the plurality of elements is operable to be moved between the expanded and collapsed conditions by sliding with respect to one another in the plane of the ring structure, in a direction tangential to a circle concentric with the ring structure.

According to a further aspect of the invention, there is provided an expanding and collapsing ring apparatus comprising:

a plurality of elements assembled together to form a ring structure around a longitudinal axis;

wherein the ring structure is operable to be moved between an expanded condition and a collapsed condition by movement of the plurality of elements;

wherein the plurality of elements is operable to be moved between the expanded and collapsed conditions in a plane perpendicular to the longitudinal axis, by sliding with respect to an adjacent pair of elements.

According to a further aspect of the invention, there is provided an expanding and collapsing ring apparatus comprising:

a plurality of elements assembled together to form a ring structure around a longitudinal axis;

wherein the ring structure is operable to be moved between an expanded condition and a collapsed condition by movement of the plurality of elements;

wherein the plurality of elements is operable to be moved between the expanded and collapsed conditions by sliding relative to one another in directions tangential to a circle concentric with the longitudinal axis.

According to a further aspect of the invention, there is provided an expanding and collapsing ring apparatus comprising:

a plurality of elements assembled together to form a ring structure around a longitudinal axis;

wherein the ring structure is operable to be moved between an expanded condition and a collapsed condition;

wherein in the expanded condition, the plurality of elements combine to form a solid ring structure having a substantially smooth outer surface.

According to a further aspect of the invention, there is provided a method of expanding an apparatus, the method comprising:

providing an apparatus comprising a plurality of elements assembled together to form a ring structure oriented in a plane around a longitudinal axis;

imparting a force to or releasing a force from the ring structure to move the plurality of elements by sliding with respect to one another in the plane of the ring structure, in a direction tangential to a circle concentric with the ring structure; thereby moving the ring structure from a collapsed condition to an expanded condition.

According to a further aspect of the invention, there is provided a method of collapsing an apparatus, the method comprising:

providing an apparatus comprising a plurality of elements assembled together to form a ring structure oriented in a plane around a longitudinal axis;

releasing a force from or imparting a force to the ring structure to move the plurality of elements by sliding with respect to one another in the plane of the ring structure, in a direction tangential to a circle concentric with the ring structure, thereby moving the ring structure from an expanded condition to a collapsed condition.

According to a further aspect of the invention, there is provided fluid conduit tool comprising the apparatus according to any previous aspect of the invention. The fluid conduit tool may be configured for use in pipelines or other fluid conduits, which may be surface fluid conduits or subsea fluid conduits, and may be oilfield or non-oilfield fluid conduits.

Embodiments of the further aspects of the invention may include one or more features of the first to fourth aspects of the invention or their embodiments, or vice versa.

BRIEF DESCRIPTION OF THE DRAWINGS

There will now be described, by way of example only, various embodiments of the invention with reference to the drawings, of which:

FIGS. 10A and 10B are respectively perspective and sectional views of a permanent plug according to an alternative embodiment of the invention, shown in a run position;

FIGS. 11A and 11B are respectively first and second perspective views of a slip segment of the apparatus of FIGS. 10A and 10B;

DETAILED DESCRIPTION OF PREFERRED EMBODIMENTS

Figure 1A:
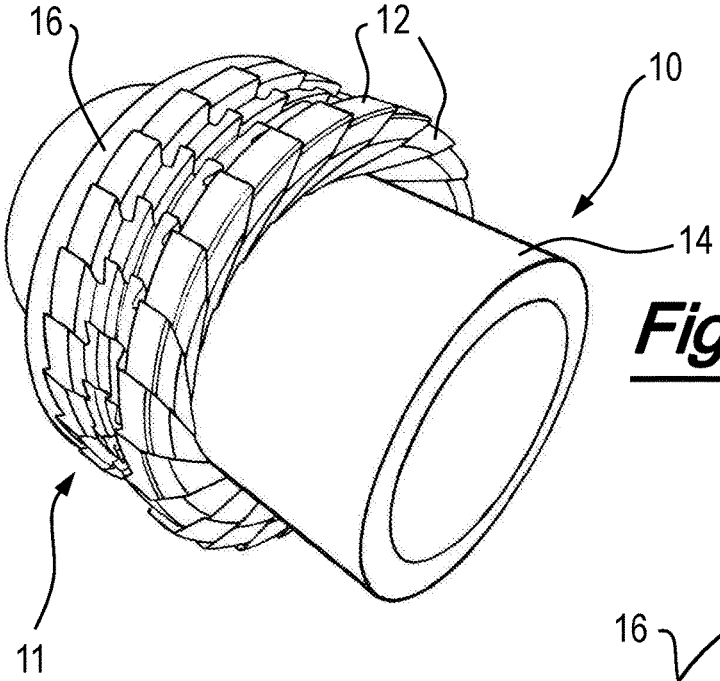
FIGS. 1A to 1D are respectively perspective, first end, part sectional and second end views of an apparatus according to a first embodiment of the invention, shown in a collapsed condition.

Referring firstly to FIGS. 1 to 4, the principles of the invention will be described with reference to an expanding apparatus in accordance with the first embodiment. In this embodiment, the expanding apparatus, generally depicted at 10, comprises an expanding ring structure configured to be expanded from a first collapsed or unexpanded condition (shown in FIGS. 1A to 1D) and a second expanded condition (shown in FIGS. 2A to 2D). The apparatus of this and other embodiments may be referred to as "expanding apparatus" for convenience, as they are operable to move to an expanded state from a normal collapsed state. However, the apparatus may equally be referred to as a collapsing apparatus, or an expanding or collapsing apparatus, as they are capable of being expanded or collapsed depending on operational state.

The expanding apparatus 10 comprises a plurality of elements 12 assembled together to form a ring structure 11. The elements 12 define an inner ring surface which is supported by the outer surface of cylinder 14. Each element comprises an inner surface 20, an outer surface 21 and first and second contact surfaces 22, 23. The first and second contact surfaces are oriented in non-parallel planes, which are tangential to a circle centred on the longitudinal axis of the apparatus. The planes converge towards the inner surface of the element. Therefore, each element is in the general form of a wedge, and the wedges are assembled together in a circumferentially overlapping fashion to form the ring structure 11. In use, the first and second contact surfaces of adjacent elements are mutually supportive.

Figure 3A:
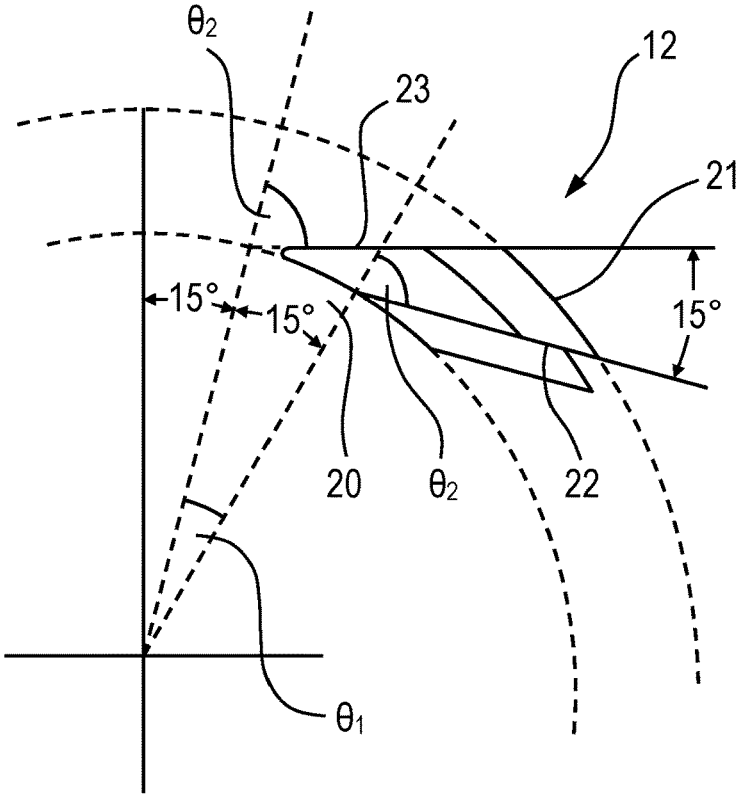
FIGS. 3A and 3B are geometric representations of an element of the apparatus of FIGS. 1A to 1D, shown from one side.
Figure 3B:
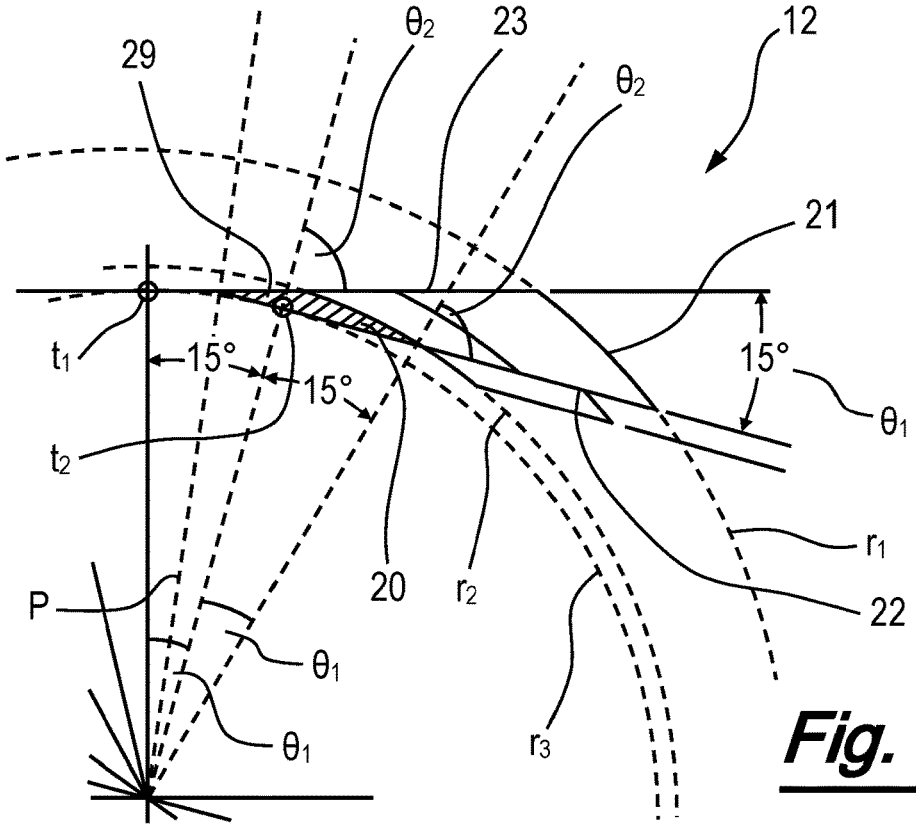
Figure 4A:
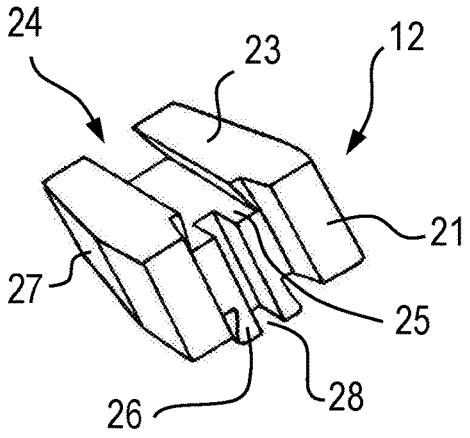
FIGS. 4A to 4F are respectively first perspective, second perspective, plan, first end, lower, and second end views of an element of the apparatus of FIGS. 1A to 1D.
Figure 4B:
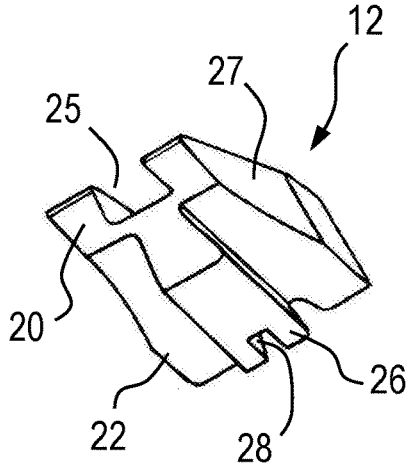
Figure 4C:
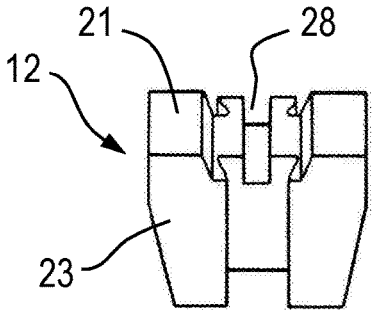
Figure 4D:
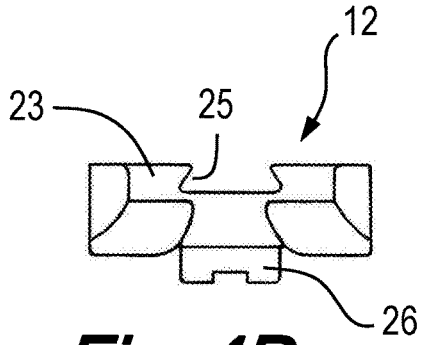
Figure 4E:
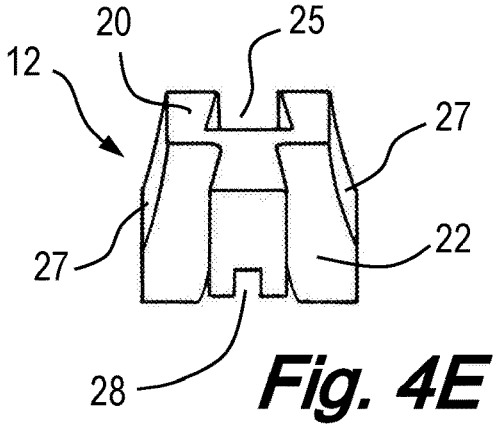
Figure 4F:
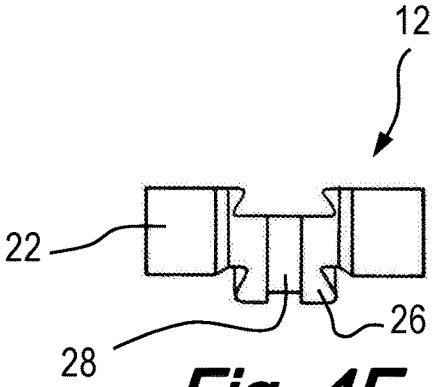

As most clearly shown in FIGS. 3A and 3B, when the ring structure is expanded to its optimal outer diameter, the orientation planes of the first and second contact surfaces intersect an inner surface of the ring structure, and together with the longitudinal axis of the apparatus, the lines of intersection define a sector of a cylinder. In this case, the ring structure is formed from twenty-four identical elements, and the central angle $\theta_1$ is 15 degrees. The angle described between the orientation planes of the first and second contact surface is the same as the central angle of the cylindrical sector, so that the elements are arranged rotationally symmetrically in the structure.

As shown in FIG. 3B, each element is based on a notional wedge-shaped segment of a ring centred on an axis, with each notional wedge-shaped segment being inclined with respect to the radial direction of the ring. The nominal outer diameter of the segment is at the optimum expansion condition of the ring (with radius shown at $r_1$).

The orientation planes of the first and second contact surfaces of the element are tangential to a circle with radius $r_3$ concentric with the ring at points $t_1$, $t_2$. The angle described between the tangent points is equal to the angle $\theta_1$ of the segment. The orientation planes of the first and second contact surfaces of each notional wedge-shaped segment intersect one another on a radial plane P which bisects radial planes located at the tangent points (i.e. is at an angle of $\theta_1/2$ to both). This intersection plane P defines the expanding and collapsing path of the segment.

Figure 1B:
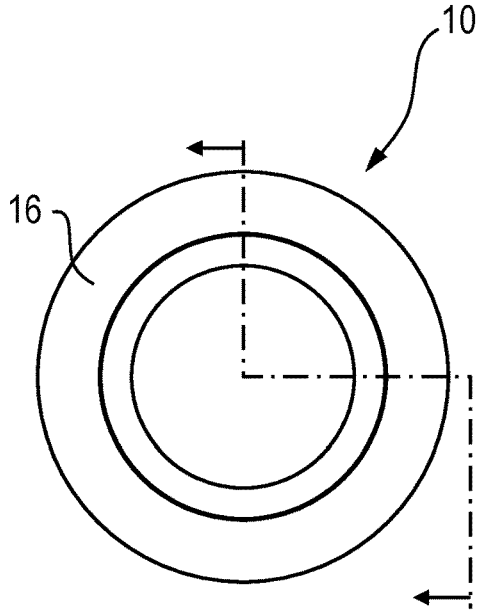
Figure 1D:
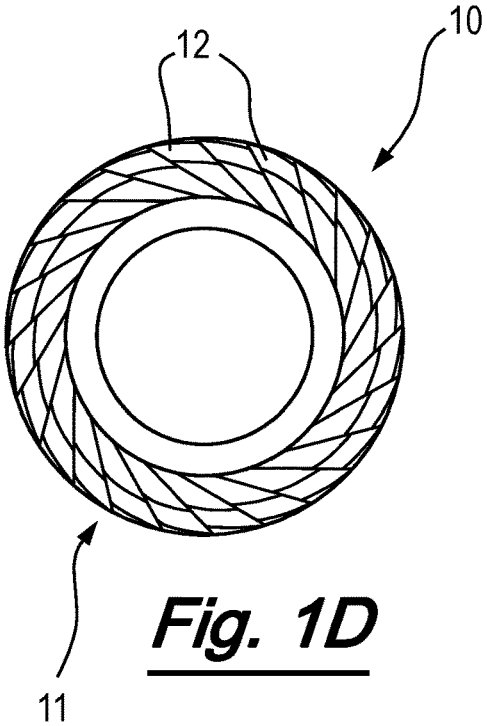
Figure 1C:
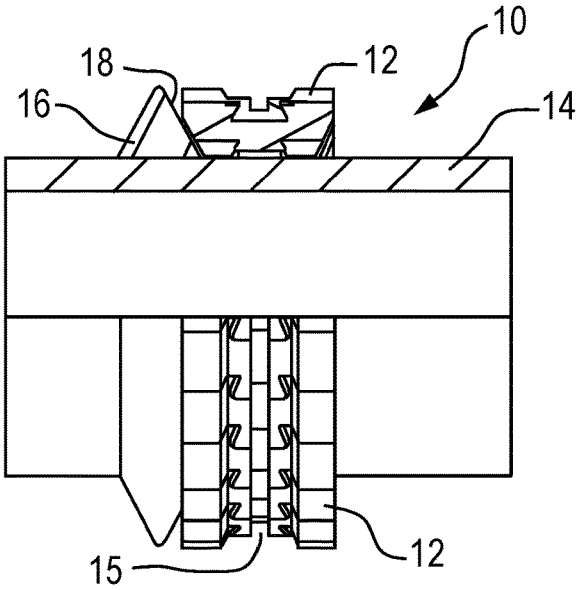
Figure 2A:
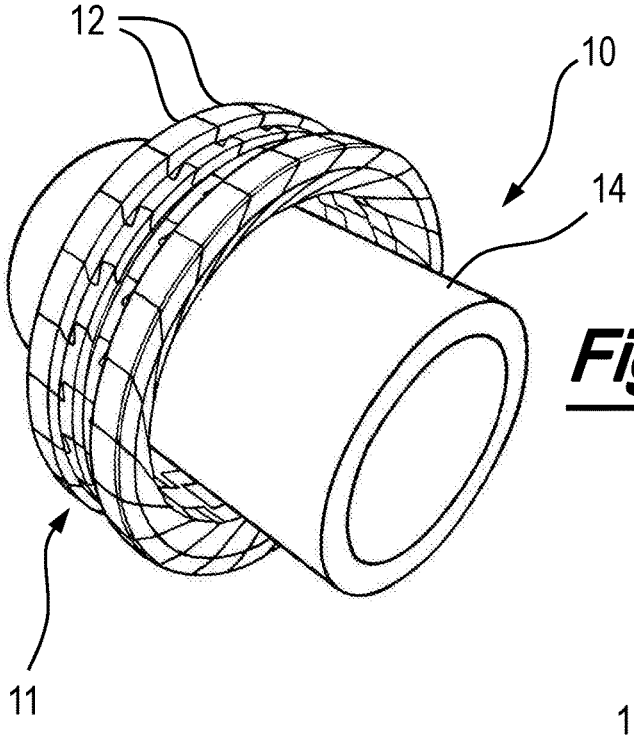
FIGS. 2A to 2D are respectively perspective, first side, part sectional and second side views of the apparatus of FIGS. 1A to 1D, shown in an expanded condition.
Figure 2B:
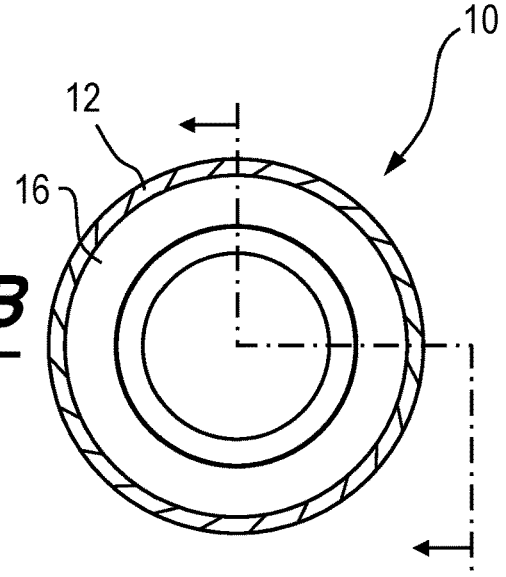
Figure 2D:
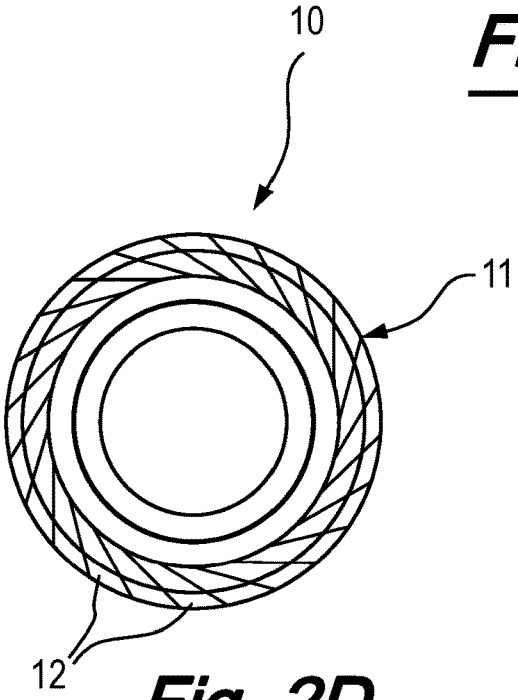
Figure 2C:
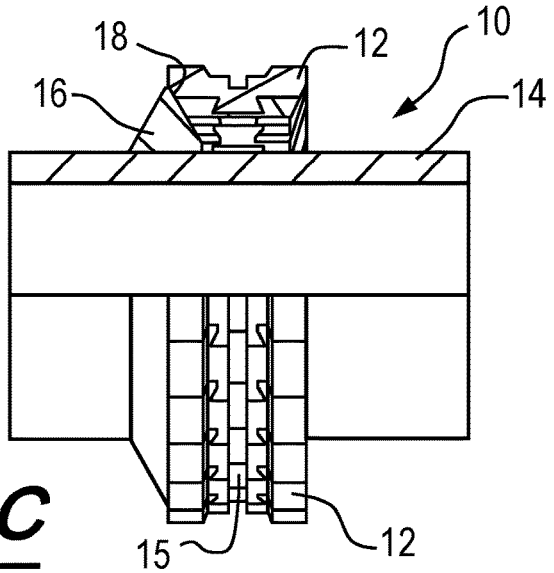

In the configuration shown in FIGS. 1 and 2, notional wedge-shaped segments are modified by removal of the tips 29 of the wedges, to provide a curved or arced inner surface 20 with radius $r_2$ when the ring is in its expanded condition shown in FIGS. 2A and 2D. The modification of the wedge-shaped elements can be thought of as an increase in diameter of an internal bore through the ring structure by $2(r_2-r_3)$, or a truncation of the inner diameter. This change in the inner diameter from the notional inner diameter $r_3$ to which the contact surfaces are tangential to a truncated inner diameter $r_2$, has the effect of changing an angle between the contact surfaces and the radial plane from the centre of the ring. Taking angle $\theta_2$ to be the angle described between the contact surface and a radial plane defined between the centre point of the ring structure and the point at which the orientation surface meets or intersects a circle at the radial position of the inner surface, $\theta_2$ is changed in dependence on the amount by which the segment has its inner diameter truncated. For the notional wedge shaped segment, the orientation planes of the contact surfaces are tangential to a circle at the inner diameter at $r_3$ (i.e. angle $\theta_2$ is 90 degrees). For the modified elements 12, the orientation planes of the contact surfaces instead intersect a circle at the (increased) inner diameter at $r_2$ and are inclined at a reduced angle $\theta_2$.

The angle $\theta_2$ at which the segment is inclined is related to the amount of material removed from the notional wedge-shaped segment, but is independent from the central angle $\theta_1$ of the wedge. Angle $\theta_2$ is selected to provide element dimensions suitable for manufacture, robustness, and fit within the desired annular volume and inner and outer diameters of the collapsed ring. As the angle $\theta_2$ approaches 90 degrees, a shallower, finer wedge profile is created by the element, which may enable optimisation of the collapsed volume of the ring structure. Although a shallower, finer wedge profile may have the effect of reducing the size of the gaps created at the inner surface of the ring in the collapsed condition and/or enabling a more compact collapsed condition, there are some consequences. These include the introduction of flat sections at the inner surfaces of the elements, which manifest as spaces at the inner diameter of the ring when in an expanded or partially expanded condition. When $\theta_2$=90 degrees, all the segments are purely tangential to inner diameter, the collapsed volume for a given outer diameter and inner diameter is most efficient, but the inner surface of the ring structure is polygonal with flat sections created by each segment. In some configurations, these flat sections may be undesirable. There may also be potential difficulties with manufacture of the elements and robustness of the elements and assembled ring structure. However, in many applications, where the profile of the inner surface of the expanded ring is not critical, for example when the inner diameter of the ring structure is floating, and/or the true inner diameter is defined by an actuation wedge profile rather than the inner surface of the ring, this compromise may not be detrimental to the operation of the apparatus, and the reduced collapse volume may justify an inclination angle $\theta_2$ of (or approaching) 90 degrees.

In the apparatus of FIGS. 1 to 4, the angle $\theta_2$ is 75 degrees. Relaxing $\theta_2$ to a reduced angle provides a smooth outer diameter and inner diameter profile to the expanded ring, as a portion of the inner circular arc is retained at the expense of slightly increased collapsed volume. It should be noted that the angle $\theta_2$ is independent from the angle $\theta_1$. Where the ring structure is desired to have a circular inner surface, preferred arrangements may have an angle $\theta_2$ which is in the range of (90 degrees-$2\theta_1$) to 90 degrees inclusive, and particularly preferred arrangements have an angle $\theta_2$ in the range of 70 degrees to 90 degrees (most preferably in the range of 73 degrees to 90 degrees). In general, to provide sufficient truncation of the inner diameter to retain a useful portion of an inner arc and provide a smooth inner surface to the ring structure, a maximum useful value of $\theta_2$ is (90 degrees-$\theta_1$/2). This would be 82.5 degrees in the described arrangements.

In other configurations, also in accordance with embodiments of the invention (and as will be described below) the geometry of the notional wedge-shaped segments forming the elements may be unmodified (save for the provision of functional formations such as for interlocking and/or retention of the elements), without the removal of material from the tip of the notional wedge-shaped segments. Such embodiments may be preferred when there is no requirement for the ring structure to have a circular inner surface.

As most clearly shown in FIGS. 4A to 4F, the first and second contact surfaces of the element have corresponding interlocking profiles 24 formed therein, such that adjacent elements can interlock with one another. In this case, the interlocking profiles comprise a dovetail groove 25 and a corresponding dovetail tongue 26. The interlocking profiles resist circumferential and/or radial separation of the elements in the ring structure, but permit relative sliding motion between adjacent elements. The interlocking profiles also facilitate smooth and uniform expansion and contraction of the elements during use. It will be appreciated that alternative forms of interlocking profiles, for example comprising recesses and protrusions of other shapes and forms, may be used within the scope of the invention.

The elements are also provided with inclined side wall portions 27, which may facilitate deployment of the apparatus in use. The side wall portions are formed in an inverted cone shape which corresponds to the shape and curvature of the actuating cone wedges profiles when the apparatus is in its maximum load condition (typically at its optimum expansion condition).

Each element is also provided with a groove 28, and in the assembled ring structure, the grooves are aligned to provide a circular groove which extends around the ring. The groove accommodates a biasing element (not shown), for example a spiral retaining ring of the type marketed by Smalley Steel Ring Company under the Spirolox brand, or a garter spring. In this case, the biasing means is located around the outer surface of the elements, to bias the apparatus towards the collapsed condition shown in FIGS. 1A to 1D. Although one groove for accommodating a biasing means is provided in this embodiment, in alternative embodiments of the apparatus, multiple grooves and biasing means may be provided.

The apparatus 10 comprises a wedge member 16, which in this case is an annular ring having a conical surface 18 opposing one side of the ring structure 11. The wedge angle corresponds with the angle of the inclined conical side walls 27 of the elements. A corresponding wedge shaped profile (not shown) is optionally provided on the opposing side of the ring structure to facilitate expansion of the ring elements. In alternative embodiments of the invention this optional additional wedge may be substituted with an abutment shoulder.

Operation of the expansion apparatus will now be described. In the first, collapsed or unexpanded condition, shown most clearly in FIG. 10, the elements are assembled in a ring structure 11 which extends to a first outer diameter. In this embodiment, and as shown in FIGS. 1B and 10, the wedge member 16 defines the maximum outer diameter of the apparatus in the first condition. The elements are biased towards the unexpanded condition by a spiral retaining ring (not shown), and are supported on the inner surface by the outer surface of the cylinder 14.

In use, an axial actuation force is imparted on the wedge member 16. Any of a number of suitable means known in the art can be used for application of the axial actuation force, for example, the application of a force from an outer sleeve positioned around the cylinder. The force causes the wedge member 16 to move axially with respect to the cylinder, and transfer a component of the axial force onto the recessed side wall of the elements. The angle of the wedge transfers a radial force component to the elements 12, which causes them to slide with respect to one another along their respective contact surfaces.

The movement of the expanding elements is tangential to a circle defined around the longitudinal axis of the apparatus. The contact surfaces of the elements mutually support one another before, during, and after expansion. The radial position of the elements increases on continued application of the axial actuation force until the elements are located at a desired outer radial position. This radial position may be defined by a controlled and limited axial displacement of the wedge member, or alternatively can be determined by an inner surface of a bore or tubular in which the apparatus is disposed.

FIGS. 2A to 2D show clearly the apparatus in its expanded condition. At an optimal expansion condition, shown in FIGS. 2B and 2D, the outer surfaces of the individual elements combine to form a complete circle with no gaps in between the individual elements. The outer surface of the expansion apparatus can be optimised for a specific diameter, to form a perfectly round expanded ring (within manufacturing tolerances) with no extrusion gaps on the inner or outer surfaces of the ring structure. The design of the expansion apparatus also has the benefit that a degree of under expansion or over expansion (for example, to a slightly different radial position) does not introduce significantly large gaps.

It is a feature of the invention that the elements are mutually supported before, throughout, and after the expansion, and do not create gaps between the individual elements during expansion or at the fully expanded position. In addition, the arrangement of elements in a circumferential ring, and their movement in a plane perpendicular to the longitudinal axis, facilitates the provision of smooth side faces or flanks on the expanded ring structure. With deployment of the elements in the plane of the ring structure, the overall width of the ring structure does not change. This enables use of the apparatus in close axial proximity to other functional elements.

The apparatus has a range of applications, some of which are illustrated in the following example embodiments. However, additional applications of the apparatus are possible which exploit its ability to effectively perform one or more of blocking or sealing an annular path; contacting an auxiliary surface; gripping or anchoring against an auxiliary surface; locating or engaging with radially spaced profiles; and/or supporting a radially spaced component.

There will now be described an application of the expansion apparatus of the invention to a downhole oilfield apparatus, specifically a retrievable bridge plug. A retrievable bridge plug is a downhole tool which is located and set in order to isolate a part of the wellbore, in a way that enables it to be unset and retrieved from the wellbore after use. A typical retrievable bridge plug includes an arrangement of slips for anchoring the plug in the well, and a seal element for creating a fluid seal. Slips used in bridge plugs are typically expensive to manufacture, as they may be required to be milled, turned, machined, wire cut and/or heat treated. Moreover, slips used in bridge plugs conventionally work for a particular range of tubing weights. This may require the wellbore contractor to have an inventory of slips for a single plug, which will be installed depending on where in the completion the plug is required to be placed. The arrangement of slips and their deployment mechanism increases the axial length of the tool, which is generally undesirable and may be a critical issue in some applications. In addition, an unsupported seal assembly may have a tendency to deform and fail through an extrusion gap between the maximum outer diameter of a gauge ring which supports the seal and the surrounding bore to which the seal element has been expanded.

The expansion apparatus of the invention offers a number of advantages in a bridge plug application, as will be apparent from the following description.

Figure 5A:
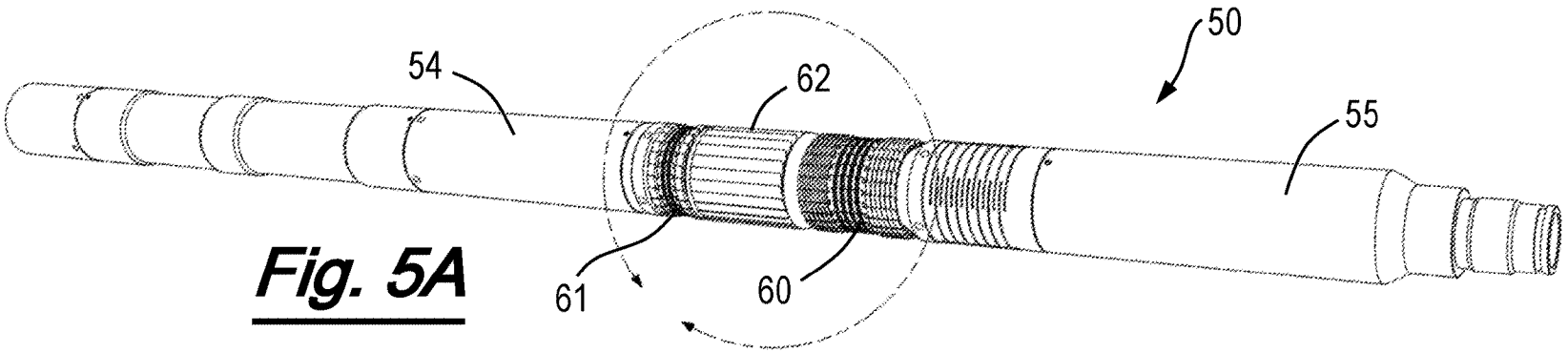
FIGS. 5A and 5B are respectively perspective and sectional views through a retrievable bridge plug incorporating apparatus according to an embodiment of the invention, shown in a run position.
Figure 5B:
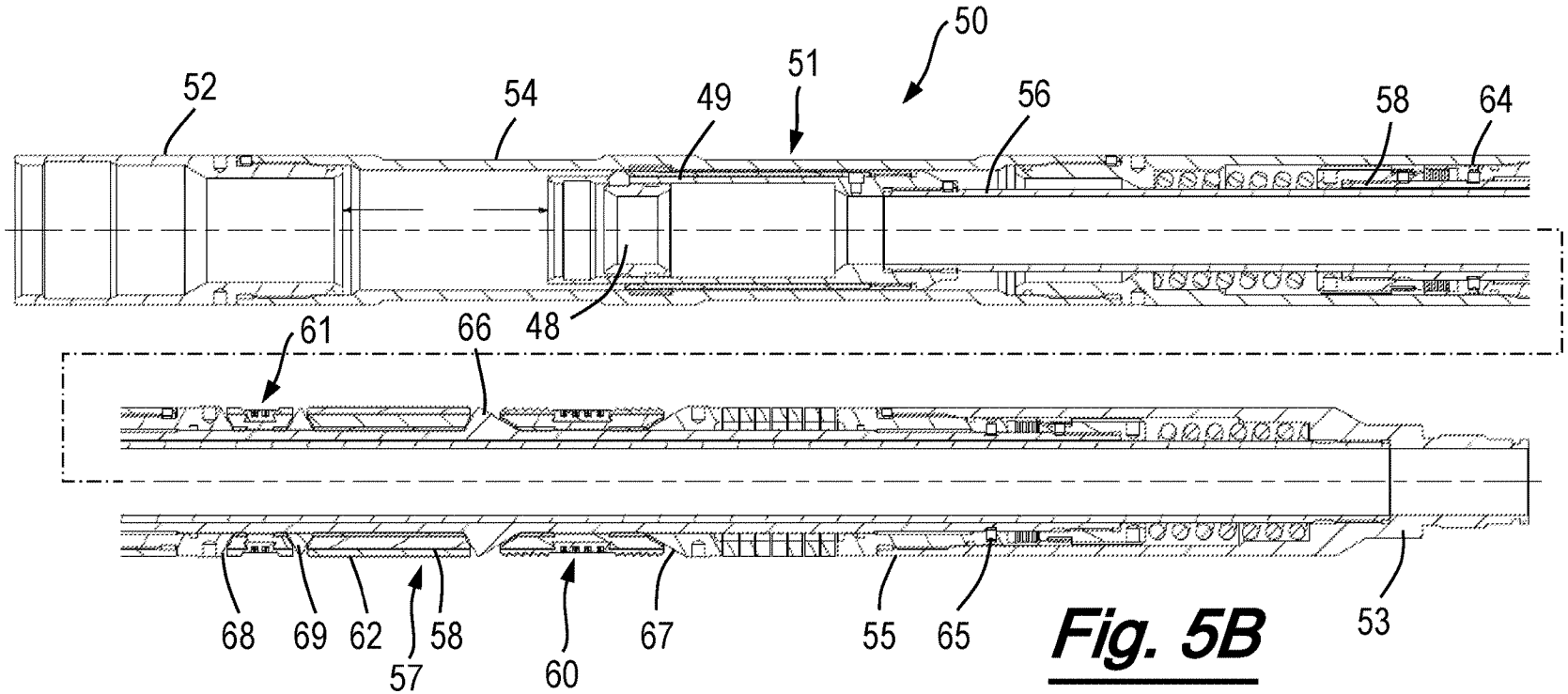

FIG. 5A is an isometric view of a retrievable bridge plug according to an embodiment of the invention, into which an expansion apparatus has been incorporated to perform anchoring and anti-extrusion functions. FIG. 5B is a longitudinal section through the bridge plug, generally shown at 50, in a run position.

The plug 50 comprises a housing assembly 51, and upper and lower connectors 52, 53 for connecting the plug into a tool string. The housing assembly 51 comprises upper and lower housing subs 54, 55 located on a mandrel 56 on either side of a seal and anchor assembly 57. An actuation sleeve 58 connects the upper and lower housing subs on the mandrel.

The slip and seal assembly 57 comprises an expanding slip assembly 60, an expanding anti-extrusion ring 61, and an elastomeric seal element 62 disposed between the expanding slip assembly 60 and the expanding anti-extrusion ring 61. The expanding anti-extrusion ring 61 is similar to the expansion apparatus 10, and will be understood from FIGS. 1 to 4 and the accompanying description. FIGS. 8A to 8D show the individual elements 63 of the expanding anti-extrusion ring 61 in more detail. The elements 63 are similar to the elements 12, and comprise inner and outer surfaces 70, 71, and first and second contact surfaces 72, 73. The first and second contact surfaces are oriented in non-parallel planes, which are tangential to a circle centred on the longitudinal axis of the apparatus. The elements 63 also comprise corresponding interlocking profiles 74. The elements 63 are slightly longer in an axial direction of the tool, and comprise a pair of grooves 75 for accommodating a pair of biasing springs.

The slip assembly 60 is also constructed and operated according to the principles of the invention. The assembly 60 comprises a ring structure formed from a number of individual expansion slip elements, which interlock to create the ring structure. Perspective views of the expansion slip elements 77 are provided in FIGS. 9A to 9D. Each slip element 77 is similar in form and function to the elements 12 and 63, and their operation will be understood from the foregoing description. However, in this embodiment, the outer surface of the element is provided with engaging means 78 defined by a series of grooves 81 and ridges 82 in the outer surface 79, disposed on either side of retaining ring grooves 80. In this embodiment, the slip elements 77 are bidirectional; the engaging means on respective sides of the of the slip surface are asymmetrically formed in opposing directions, to provide an anchoring forces which resist movement in both upward and downward directions.

Figure 6:
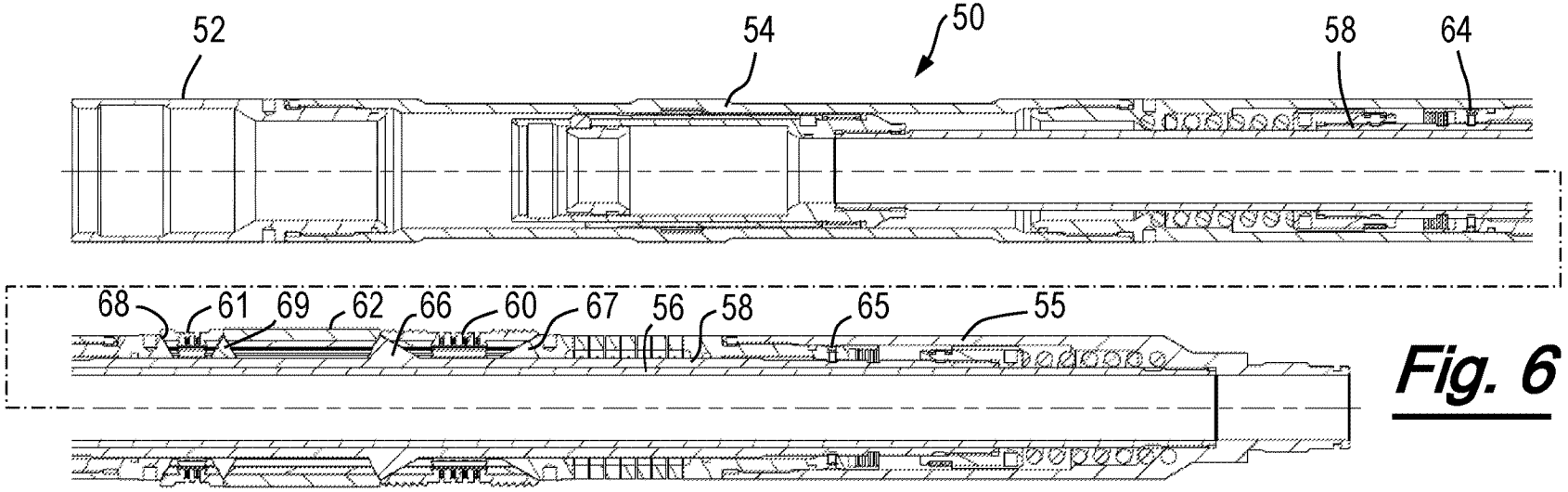
FIG. 6 is a sectional view of the apparatus of FIGS. 5A and 5B, shown in a set position.

Operation of the bridge plug will now be described with particular reference to FIGS. 5B, 6 and 7. When the plug is located at the desired position in the wellbore, it is ready to be set, and a setting tool is used to impart a force to the plug in a manner known in the art. In this example embodiment, a setting tool (not shown) impart a downward force on the outer housing 51 relative to the mandrel 56, resulting in a relative movement between the housing and the mandrel. The downward axial force is transferred from the upper housing sub 54 to the actuation sleeve 58 via upper shear screws 64. An initial downward force on the outer housing with respect to the mandrel causes lower shear screws 65 to shear, enabling the upper housing sub 54 and actuation sleeve 58 to move downward with respect to the lower housing sub 55.

Downward movement of the actuation sleeve 58 moves the fixed upset wedge profile 66 of the actuation sleeve towards the slip assembly 60, to impart an axial force on the slip assembly 60. The slip assembly is axially compressed between the wedge profile 66 of the actuation sleeve and a lower wedge profile 67 on the lower housing sub 55. The slip elements slide with respect to one another in a tangential direction and move to their radially extended positions, in the manner described with reference to FIGS. 1 and 2. The outer surface of the ring structure formed by the slip elements is moved into engagement with the inner surface of the wellbore, where the engaging means anchors the slips at the plug to the wellbore. As the upper housing sub moves downwards with respect to the mandrel, a ratchet sleeve 49 and ratchet clip locks the position of the sub 54, and prevents return movement of the housing and release of the slips.

A further downward force on the upper housing sub with respect to the inner mandrel causes the upper shear screws 64 to shear, which enables the upper housing sub 54 to move downwards with respect to the mandrel 56 and the actuation sleeve 58. Movement of the upper housing assembly 54 imparts an axial force on the anti-extrusion ring 60 between a wedge profile 68 of the upper housing sub 54 and a movable wedge member 69 disposed between the seal assembly 62 and the anti-extrusion ring 60. The axial force results in radial deployment of the element in the manner described above. The downward force also acts on the movable wedge member 69 to compress the seal element 62 between the wedge 69 and the upset profile 66 on the slip actuation sleeve. The compressed seal 62 is expanded in a radial direction into contact with the surrounding wellbore wall. The expanded condition is shown in FIG. 6, with the position locked by the ratchet sleeve 49 and ratchet clip to prevent return movement of the housings and release of the slips and anti-extrusion ring 61. The anti-extrusion ring 61 provides a full extrusion barrier at the upper end of the seal element 62. The expanded slip assembly 60 provides a similar anti-extrusion barrier at the lower end of the seal 62, in addition to its anchoring functionality.

By appropriate using shear screws 64, 65, the plug is made operable to fully deploy the anti-extrusion ring before the seal element is fully compressed. This ensures that there is a fully contained volume, with little or no extrusion gap, into which the seal element is compressed. In a preferred embodiment of the anti-extrusion ring is fully expanded before the seal element begins to be compressed.

Figure 7:
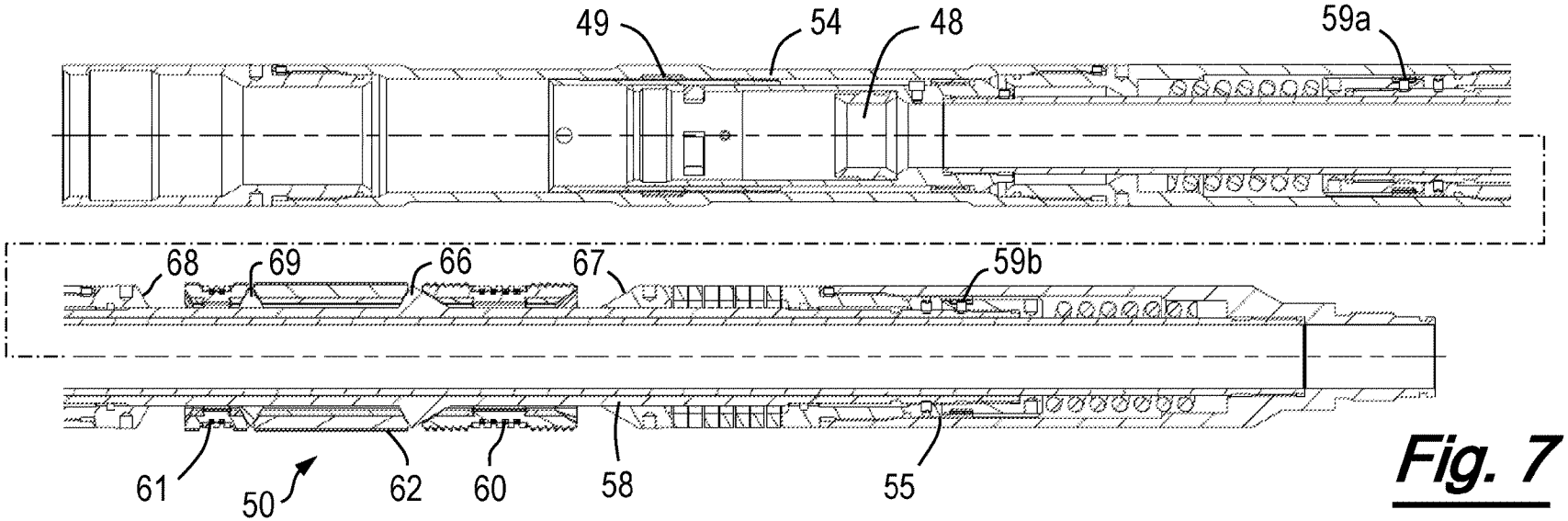
FIG. 7 is a sectional view of the apparatus of FIGS. 5A and 5B, shown in a pull position.
Figure 8A:
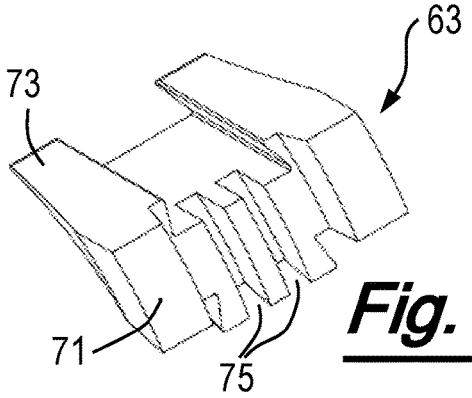
FIGS. 8A to 8D are respectively first perspective, second perspective, third perspective, fourth perspective, plan, end, lower, first side and second side views of a ring segment of apparatus of FIGS. 5A and 5B.
Figure 8B:
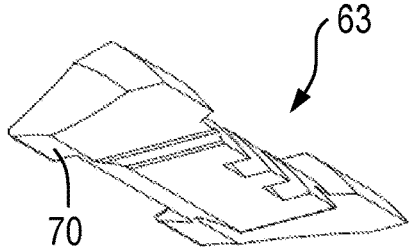
Figure 8C:
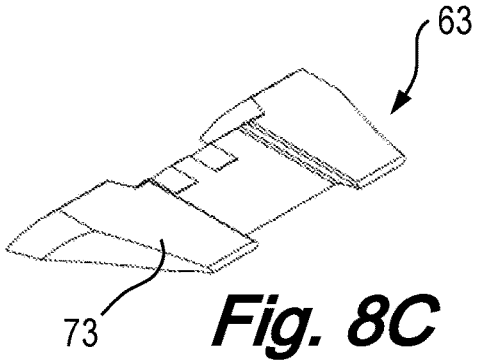
Figure 8D:
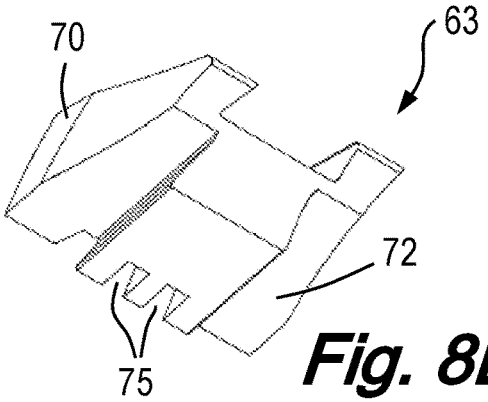
Figure 9A:
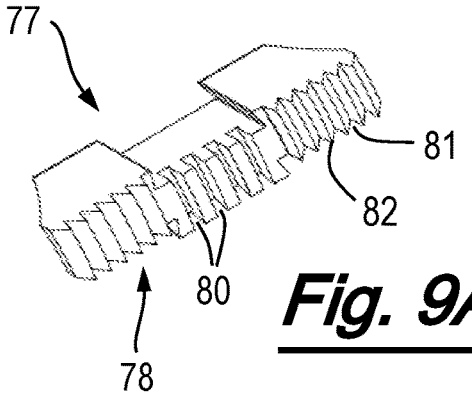
FIGS. 9A to 9D are respectively first perspective, second perspective, third perspective, fourth perspective, plan, end, lower, first side and second side views of a slip segment of the apparatus of FIGS. 5A and 5B.
Figure 9B:
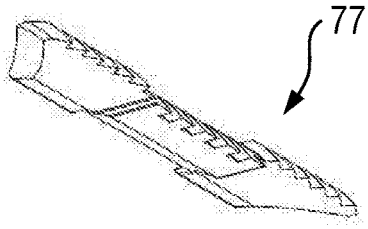
Figure 9C:
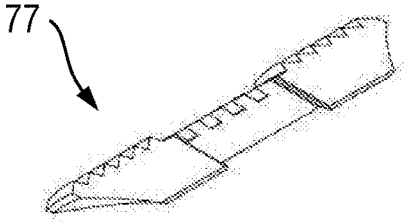
Figure 9D:
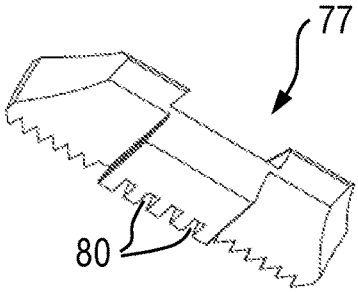

FIG. 7 shows the plug 50 in a pull position. A release tool is run to the plug and engages with a ratchet release sleeve 48, to move it downwards with respect to the mandrel. Movement of the release sleeve releases keys which support the ratchet sleeve 49 on the mandrel. With the ratchet released, the upper and lower housings and actuation sleeve may move upwards relative to the mandrel, to release the actuation force on the slips and seal, resulting in their collapse. Movement of the sleeve relative to the housing subs results in engagement of an upper ratchet lock-out mechanism 59*a* between the upper end of the actuation sleeve and the upper housing sub and a lower ratchet lock-out mechanism 59*b* between the lower end of the actuation sleeve and the lower housing sub. With these components locked together, relative movement of the wedge elements is prevented, to stop expansion of the respective expansion components during pulling out of hole (for example if a restriction is encountered during pulling).

Referring now to FIGS. 10A to 11B, there is shown the application of the invention to a permanent plug, in accordance with an alternative embodiment. FIG. 10A is a perspective view of the permanent plug, generally depicted at 100, and FIG. 10B is a longitudinal sectional view. In each of FIGS. 10A and 10B, the plug is shown in a set position. The plug 100 is similar to the retrievable plug 50, and is general form and function will be understood from FIGS. 5 to 7 and the accompanying description. However, the plug 100 is designed to be permanently installed in a wellbore, and therefore lacks the retrievable functionality of the plug 50. The plug 100 comprises an upper slip assembly 101, and a lower slip assembly 102, positioned either side of an elastomeric seal element 103 disposed on a mandrel 104. A housing 105 enables a downward force to be imparted to the slip assemblies 101, 103, with the wedge members directing a radial expansion force to slip elements, resulting in relative tangential sliding movement of the individual slip elements. The plug 100 differs from the plug 50 in that the anti-extrusion functionality is provided by a pair of slip assemblies rather than providing a dedicated anti-extrusion ring.

FIGS. 11A and 11B are perspective views of individual slip elements 107*a*, 107*b* used respectively in the upper and lower slip assemblies 101, 102. The slip elements are similar to the slip elements 77, and function in the same manner. However, in this embodiment, because a slip assembly is provided above and below the seal element, the engagement profiles on the slips are not bidirectional. Instead, the engagement profiles 108*a*, 108*b* of the respective slip assemblies are unidirectional. The elements of the upper slip assembly are arranged to engage a surrounding surface and resist movement in one direction, whereas the slip elements of the lower assembly are arranged with engaging means configured to resist movement in the opposite direction. Together, the upper and lower slip assemblies provide bidirectional anchoring of the plug in the wellbore. The angles of the respective wedges and the corresponding surfaces in the slip assemblies, along with the retaining force of the biasing means, are selected so that the lower slip assembly can be deployed by an axial force which is directed through the elastomeric seal element. In other words, the axial force required to press the seal element between the anti-extrusion surfaces created by the slip assemblies is greater, and preferably much greater, than the force required to deploy the slip assemblies. This facilitates a full and proper deployment of the slip assemblies before the elastomeric seal element is radially expanded by compression between the wedges.

The slip elements 107*a*, 107*b* of this embodiment are also provided with anti-rotation pegs 109. These pegs are received in corresponding slots in the actuating wedge surfaces, and ensure that the slip elements are not able to rotate with respect to the mandrel and the rest of the plug 100. This configuration prevents the mandrel and other components of the plug from rotating with respect to the slip assemblies if the plug is required to be drilled in order to remove it from the wellbore.

Figure 12A:
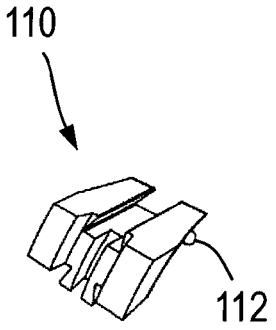
FIGS. 12A and 12B are respectively first and second perspective views of a ring segment according to an alternative embodiment of the invention.
Figure 12B:
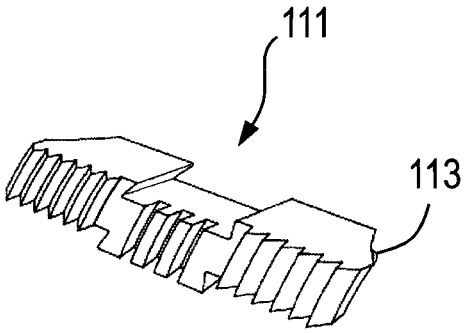

It will be appreciated that alternative configurations may be applied to permanent plug applications, and in particular, that a permanent plug may be configured without slip assemblies being disposed above and below the seal elements. By way of example, FIGS. 12A and 12B are respectively perspective views of an expansion element of an anti-extrusion ring, and a bidirectional slip element, both of which may be used in permanent plug configurations. The expansion element of FIG. 12A is configured to create an anti-extrusion ring structure which functions in the same way as the anti-extrusion ring structure 61 of the plug 50, with the addition of anti-rotation pegs. The slip element of FIG. 12B is similar in form and function to the slip element 77, and is assembled to a bidirectional slip assembly and operates in the same manner as the slip assembly 60 of plug 50, with the addition of anti-rotation pegs.

The foregoing embodiments describe the application of the principles of the invention to wellbore plugs, but it will be apparent from the description that the anti-extrusion ring configurations described with reference to FIGS. 5 to 12 may be applied to tools and devices other than downhole plugs. For example, the system may be used to provide an anti-extrusion ring or back-up ring for a wide range of expanding, radially expanding or swelling elements. For example, the apparatus may be used as an anti-extrusion or back-up ring for compressible, inflatable and/or swellable packer systems. Alternatively, or in addition, the expansion apparatus may provide support or back-up for any suitable flow barrier or seal element in the fluid conduit. This may function to improve the integrity of the fluid barrier or seal, and/or enable a reduction in the axial length of the seal element or flow barrier without compromising its functionality.

Furthermore, the slip assembly applications of the invention as described in the foregoing embodiments may be used to anchor any of a wide range of tools in the wellbore, and are not limited to bridge plug applications. For example, the slip assemblies may be used to anchor drilling, milling or cutting equipment; perforating gun assemblies; or intervention tools deployed by wireline or other flexible conveyance systems.

The invention also has benefits in creating a seal and/or filling an annular space, and an example application will be described with reference to FIGS. 13A to 14D, in which the invention is applied to a downhole locking tool. A typical locking tool uses one or more radially expanding components deployed on a running tool. The radially expanding components engage with a pre-formed locking profile at a known location in the wellbore completion. A typical locking profile and locking mechanism includes a recess for mechanical engagement by the radially expanding components of the locking tool. A seal bore is typically provided in the profile, and a seal on the locking tool is designed to seal against the seal bore. The present embodiment of the invention provides benefits over conventional locking mechanisms as will be apparent from the description below.

Figure 13A:
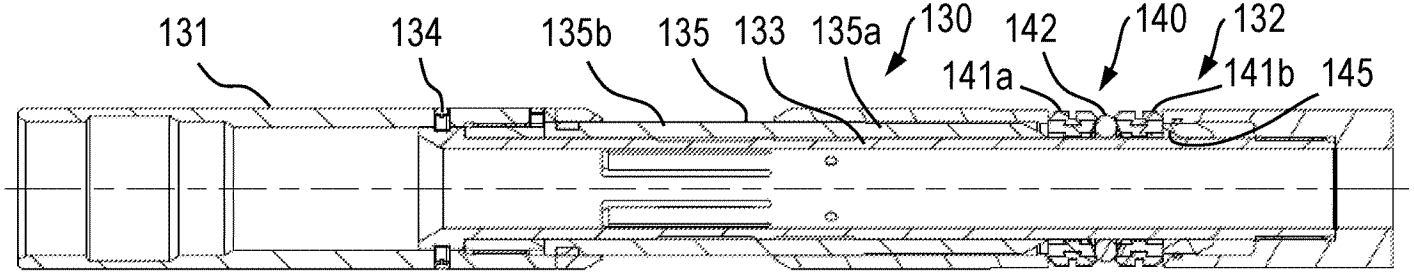
FIGS. 13A to 13D are respectively first sectional, second sectional, isometric, and cross sectional views of a lock apparatus according to an embodiment of the invention, shown in a run position.
Figure 13B:
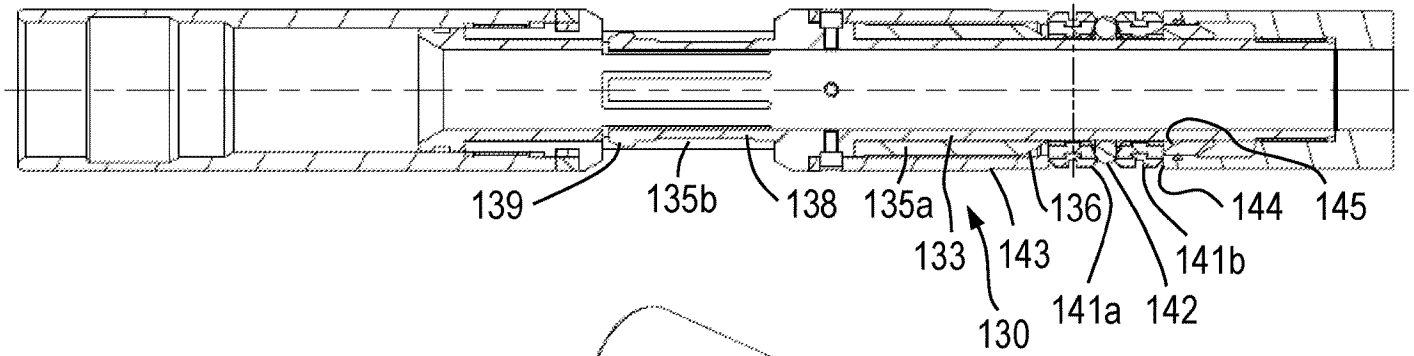
Figure 13C:
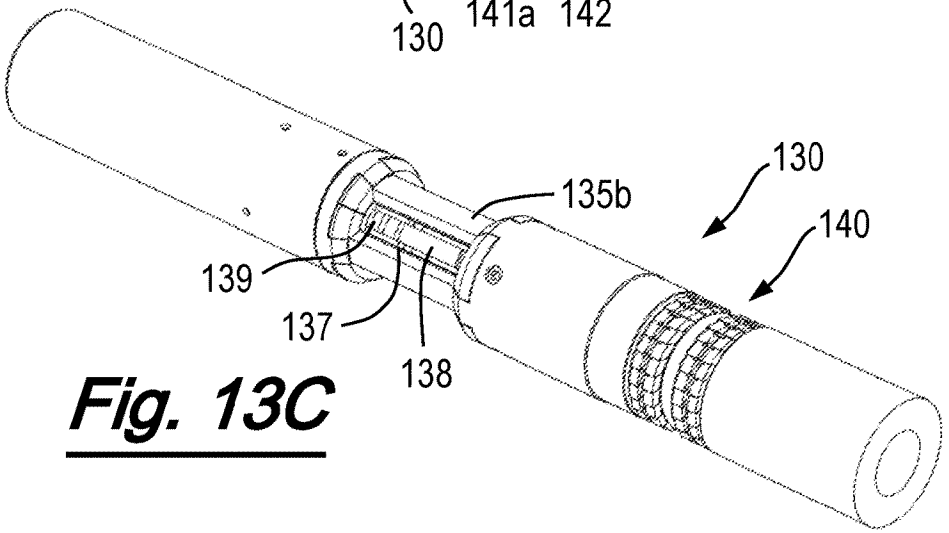
Figure 13D:
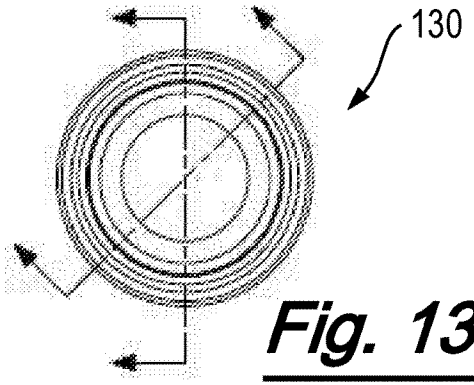
Figure 14A:
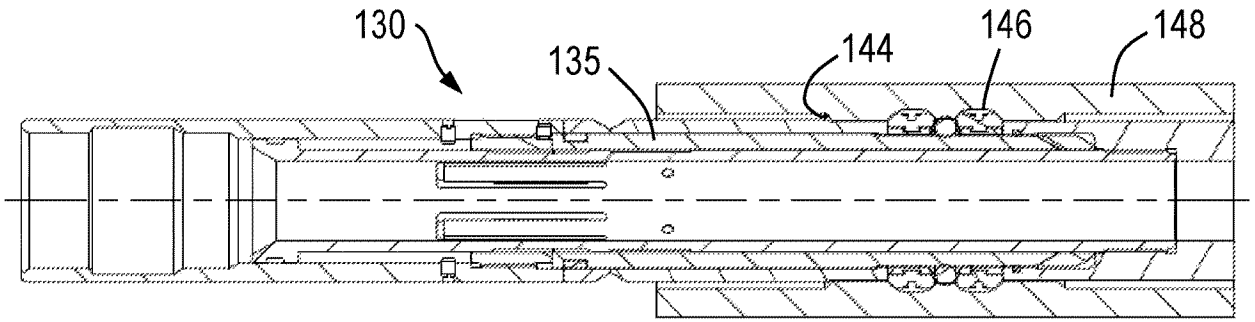
FIGS. 14A to 14D are respectively first sectional, second sectional, isometric, and cross sectional views of the apparatus of FIGS. 13A to 13D, shown in a set position.
Figure 14B:
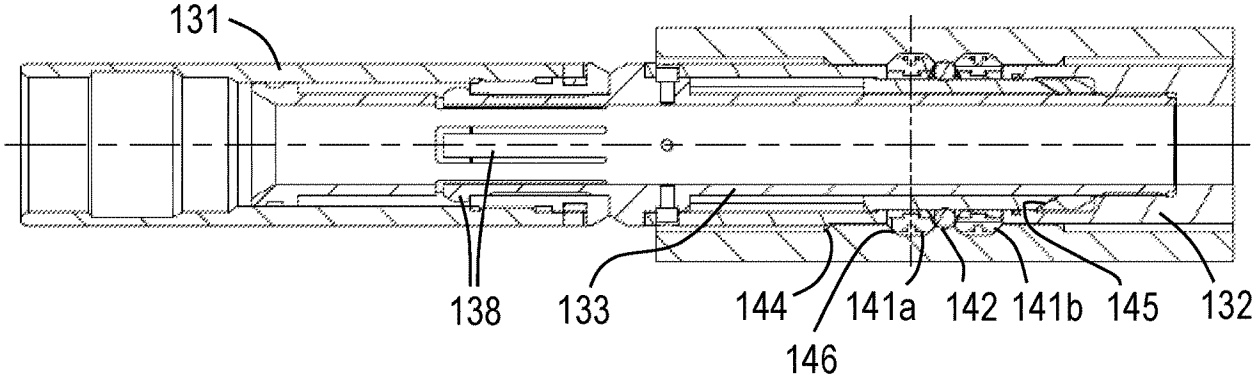
Figure 14C:
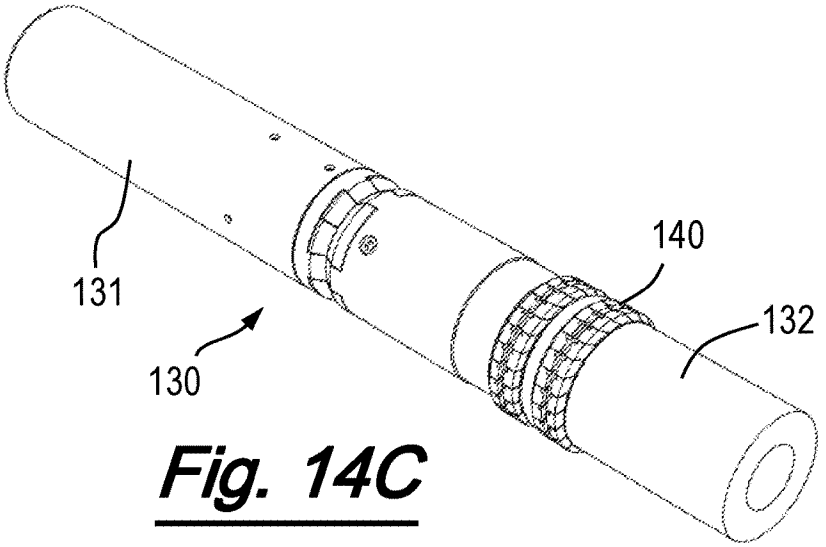
Figure 14D:
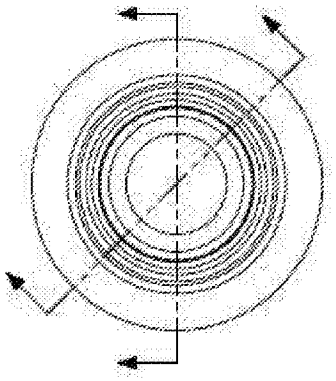

FIGS. 13A and 13B are first and second longitudinal sectional views through a locking tool according to an embodiment of the invention. FIG. 13C is an isometric view of a locking tool, and FIG. 13D is a cross section which shows the position of the longitudinal sections of 13A and 13B. In all of FIGS. 13A to 13D, the locking tool is shown in a run position. FIGS. 14A to 14D are equivalent views of the locking tool in a set position.

The locking tool, generally depicted at 130, comprises an upper housing 131, which provides an upper connecting profile, and a lower housing 132. In the run position, the upper and lower housings 131, 132 are assembled on a mandrel 133 in an axially separated position. The upper housing 131 is secured on the mandrel by a set of shear screws 134.

An actuation sleeve 135 is disposed on the mandrel 133, and connects the upper housing with the lower housing. A lower part 135*a* of the actuation sleeve is cylindrical, and a lower end of the actuation sleeve is provided with a conical wedge profile 136. An upper part 135*b* of the actuation sleeve has part cylindrical sections removed, such that only parts of the actuation sleeve, circumferentially separated around the sleeve, extend to its upper end and engage with the upper housing. Windows 137 formed by removing part sections of the actuation sleeve correspond to the locations of detent fingers 138 of the mandrel 133, and accommodate radially extending formations 139 at the end of the detent fingers.

The locking tool also comprises a locking and sealing assembly, generally shown at 140, located in an annular space between first and second subs of the lower housing. The locking and sealing assembly is formed from two axially separated ring structures 141*a*, 141*b*, each formed from a plurality of elements. Disposed between upper and lower ring structures is an elastomeric seal 142 on a support. Individual elements assembled to form the ring structures are similar to the elements 12 and 63, and their form and function will be understood from FIGS. 1 to 4 and 8 and their accompanying descriptions. In particular, each element comprises a pair of planar contact surfaces which mutually supporting adjacent elements, and the contact surfaces are oriented on tangential planes.

In the run position, the ring structures 141*a*, 141*b* are flush with the immediately adjacent outer diameter of the outer housing. In an alternative configuration, the ring structures may be recessed with respect to the outer housing, such that they have a reduced outer diameter. The outer diameter of the seal element is less than the outer diameter of the ring structures in their retracted position, such that the elastomeric seal element is recessed in the tool.

Operation of the locking tool will now be described with additional reference to FIGS. 14A to 14D. The locking tool 130 is run into the wellbore to a location in the completion which comprises a locking profile, generally shown at 148. The locking and sealing assembly 140 is positioned so that it is aligned with a locking recess 146 in the locking profile. Alignment of the locking and sealing assembly with the locking profile is ensured by the provision of a no-go profile 143 on the lower housing assembly, and a corresponding no-go profile 144 on the completion at a defined axial separation from the locking profile.

With the locking tool in position and the no-go profile engaged, a downward force imparted on the upper housing 131 is transferred to the actuation sleeve 135. The lower housing 132 and mandrel 133 is held up by the no-go, and the shear screws 134 shear, enabling the actuation sleeve to move downwards relative to the lower housing until the wedge profile 136 of the actuation sleeve is brought into contact with the upper ring structure 141*a*. The downward movement of the actuation sleeve imparts an axial force which is transferred through the elastomeric seal element 142 and to the lower ring structure 141*b*, to axially compress the locking and sealing assembly 140 against a shoulder 144 defined by the lowermost housing sub. As described with reference to previous embodiments, the wedge profiles direct a component of the axial force in a radially outward direction, to force the elements of the upper ring structure to a radially outward position. The actuation sleeve passes under the upper ring structure so that it is fully deployed, and subsequently forces the elastomeric seal and its support radially outward. The actuation sleeve continues downward movement to engagement with the lower ring structure, forcing its elements to a radially outward position, and into engagement with the locking profile.

The actuation sleeve 135 continues to move downwards through the housing until it reaches an abutment surface of an o-ring seal protection collar 145 which has a shape corresponding to the wedge profile 136. The o-ring seal protection collar 145 is moved off-seat to complete the sealing mechanism of the lock, with the o-ring sealing on the outer diameter of the actuation sleeve. A continued downward force causes the upper housing to move with respect to the mandrel, until detent fingers 138 on the mandrel engage with a corresponding profile in the upper housing. The detent fingers 138 are configured such that if the lock is not fully set, they will present an obstacle in the bore through the mandrel. This enables verification, for example with a drift tool, that the locking mechanism is in a fully set position. Engagement of the detent fingers prevents the upper and lower housings from being separated, which would enable the actuation sleeve to be withdrawn and the locking mechanism to be retracted. The locking mechanism is therefore locked into engagement with the locking profile.

One advantage of the locking mechanism described with respect to FIGS. 13A to 14D is that the locking mechanism is provided with an integrated seal element, and does not require a seal assembly at an axially separated point. This enables a reduction in the length of the tool. The integrated seal is surrounded at its upper and lower edges by the surfaces of the ring structures, which avoid extrusion of the seal.

In addition, each of the ring structures provides a smooth, unbroken circumferential surface which engages the locking recess, providing upper and lower annular surfaces in a plane perpendicular to the longitudinal axis of the bore. This annular surface is smooth and unbroken around the circumference of the ring structures, and therefore the lock is in full abutment with upper and lower shoulders defined in the locking profile. This is in contrast with conventional locking mechanisms which may only have contact with a locking profile at a number of discrete, circumferentially-separated locations around the device. The increased surface contact provided by this embodiment of the invention enables a locking mechanism which can support larger axial loads being directed through the lock, and therefore the lock can be rated to a higher maximum working pressure. Alternatively, an equivalent pressure rating can be provided in a lock which has reduced size and/or mass.

Another advantage of this embodiment of the invention is that the seal bore (i.e. the part of the completion with which the elastomer creates a seal) can be recessed in the locking profile. In this embodiment, the inner diameter of the locking profile on either side of the lock recess 146 is less than the inner diameter of the seal bore. The benefit of this configuration is that the seal bore is protected from the passage of tools and equipment through the locking profile. This avoids impact with the seal bore which would tend to damage the seal bore, reducing the likelihood of reliably creating a successful seal.

In the foregoing embodiment, the benefits of the principles of the invention to a downhole locking mechanism are described. Similar benefits may be delivered in latching arrangements used in connectors, such as so called "quick connect" mechanisms used for latched connection of tubular components. Such an example application will be described with reference to FIGS. 15A to 16C.

Figure 15A:
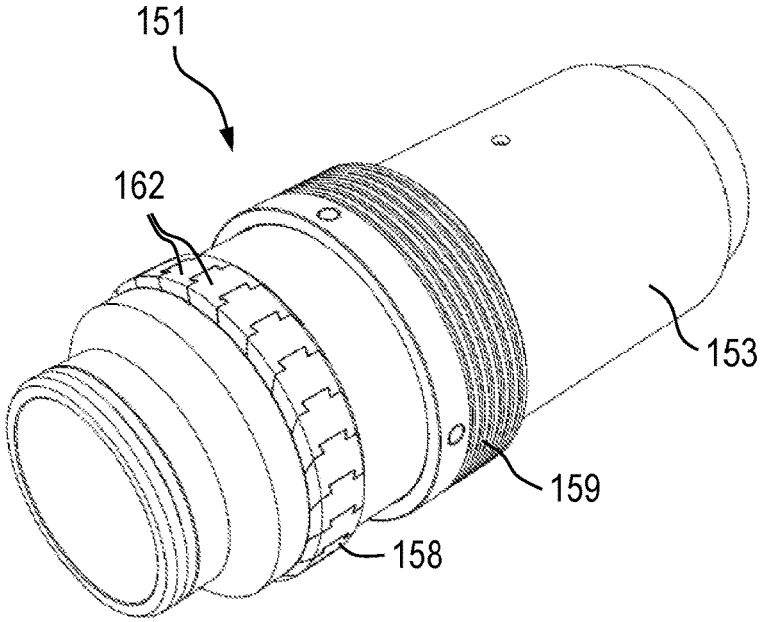
FIGS. 15A to 15D are respectively perspective, perspective cut-away, sectional and cross-sectional views of a quick connect apparatus according to an embodiment of the invention, shown in a lock out position.
Figure 15D:
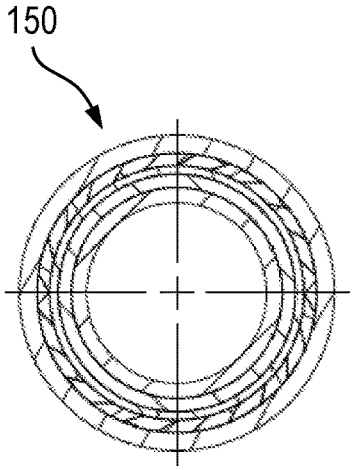
Figure 15B:
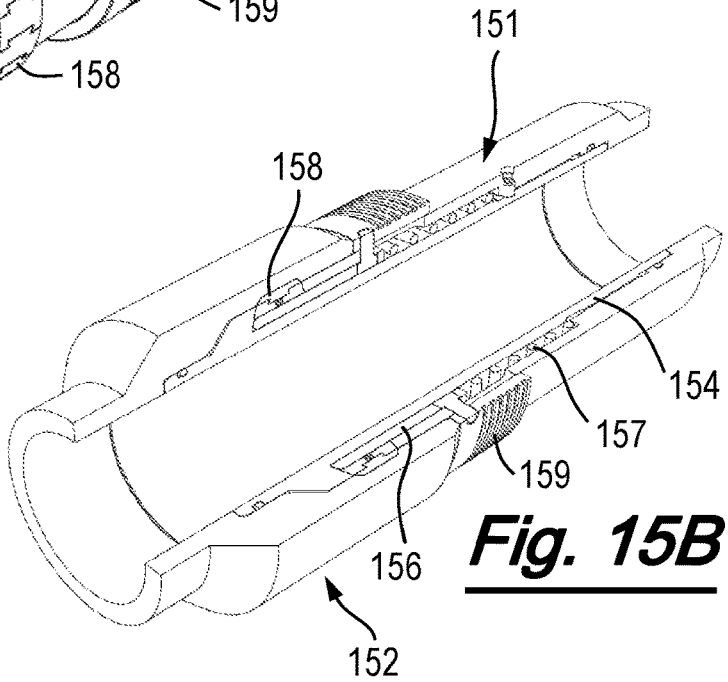
Figure 15C:
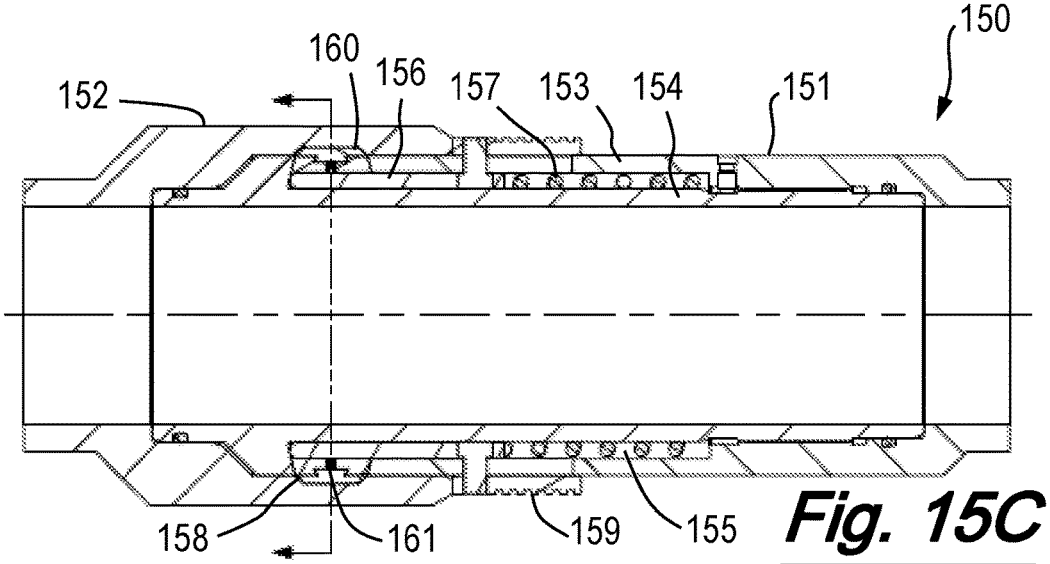
Figure 16A:
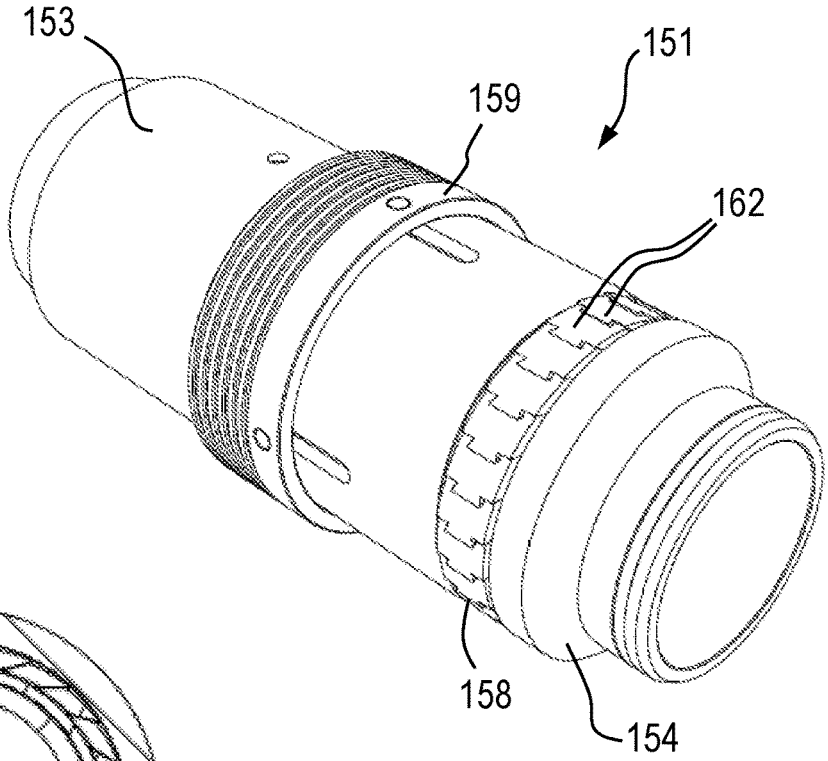
FIGS. 16A to 16C are respectively perspective, sectional and cross-sectional views of the apparatus of FIGS. 15A to 15D, shown in a release position.
Figure 16C:
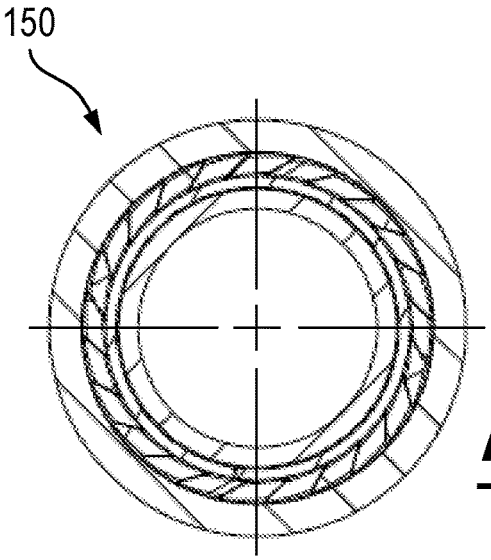
Figure 16B:
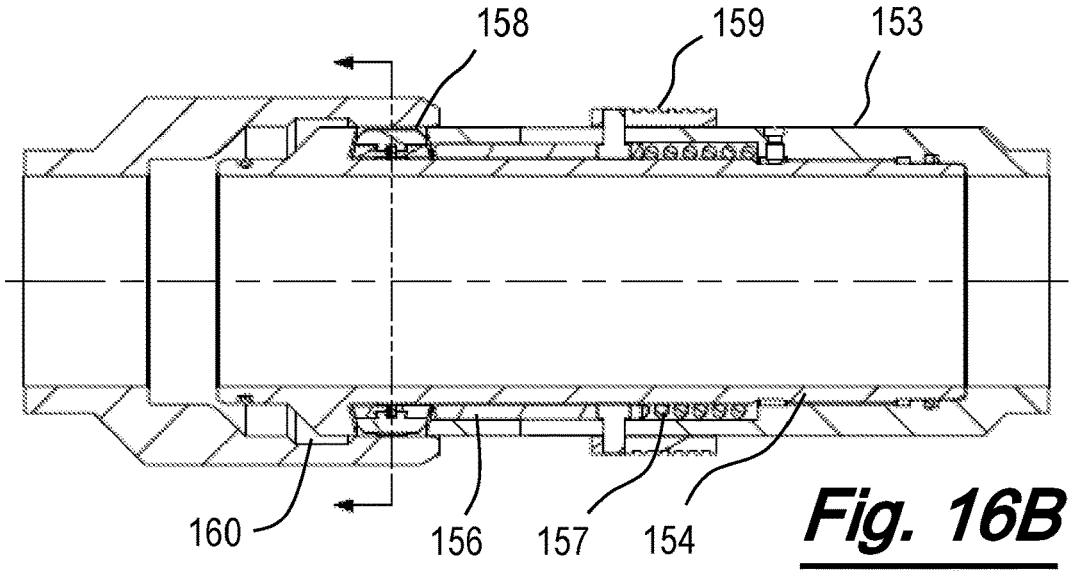

The connection system, generally shown at 150, comprises a male connector 151 and a female connector 152. FIG. 15A is an isometric view of a male connector of a connection system according to an embodiment of the invention, and FIG. 15B to 15D are respectively partially cut away isometric, longitudinal section and cross sectional views of an assembled pair of the male connector and a female connector according to an embodiment of the invention. All of FIGS. 15A to 15D show the apparatus in an expanded condition. FIGS. 16A to 16C are equivalent views which show the connection apparatus in a collapsed release condition.

The male connector 151 comprises an outer housing 153 disposed over an inner mandrel 154 which defines a throughbore through the connector. The female connector 152 comprises a throughbore, which is continuous with the throughbore of the inner mandrel. A first end of the inner mandrel is sized to fit into an opening in the female connector.

The outer housing 153 partially surrounds the mandrel 154, and over a portion of its length has a throughbore formed to an inner diameter larger than the outer diameter of the mandrel, such that an annular space 155 is formed between the inner mandrel and the outer housing when the two are assembled together. The annular space between the outer housing and the inner mandrel accommodates a support sleeve 156 and a biasing means in the form of a coil spring 157. The spring 157 functions to bias the support sleeve to a position in which it is disposed under an expansion apparatus 158 which forms a latching ring for the connection system. An inner surface of the expansion apparatus is supported on the outer surface of the support sleeve. The support sleeve is also mechanically coupled to an external sleeve 159, disposed on the outside of the outer housing by pins extending through axially oriented slots in the outer housing.

The female connector 152 also comprises an annular recess 160 which is sized and shaped to receive the expansion apparatus in a latched position. The annular recess is profiled with chamfered edges, to correspond to the inclined surfaces at the outside of the expansion apparatus 158.

The expansion apparatus 158 of this embodiment of the invention is similar to the expansion apparatus described with reference to previous embodiments of the invention, and is assembled from multiple elements 162. However, a significant difference is that the expansion apparatus 158 is biased towards an expanded condition to provide a latching ring for the connection system. This is achieved by the provision of grooves on the inner surfaces of the elements which make up the ring structure, to accommodate a circumferential spring element 161. The circumferential spring element 161 supports the elements of the ring in their optimum concentric state, which in this case is their radially expanded position.

The profile of the elements is such that they are wider at their inner surface than their outer surface, and wider than the tapered groove through which the ring structure extends. This prevents the elements of the ring structure from being pushed out of the male connector by the circumferential spring element when the system is disconnected.

A disconnection of the connection system 150 will now be described, with additional reference to FIGS. 16A to 16C. FIGS. 15A to 15D show the default, normally expanded position of the connector system 150 and its expansion apparatus 158. The circumferential spring element of the expansion apparatus biases the elements outward into the position shown at FIG. 15A, and they are radially supported in that position by the support sleeve. The external sleeve 159 allows the support sleeve 156 to be retracted against the biasing force of the spring 157. Withdrawal of the support sleeve 156 from beneath the expansion apparatus 158 enables the ring to be collapsed to a reduced radial position, shown in FIGS. 16A to 16C. The presence of the circumferential spring element 161 retains the elements in an outward expanded condition, but with the support sleeve 156 retracted, an axial force which acts separate the male and female parts of the connector will impart an axial force on the elements of the ring structure, via the chamfered edges of the recess 160. The profile of the recesses and the elements directs a radial force component which tends to cause the elements to collapse against the force of the spring element. The elements are collapsed to a reduced diameter position which allows the male and female connectors to be separated. When the expansion apparatus is clear of the female connector, the force of the spring element will tend to expand the elements to their radially expanded positions. Releasing the external sleeve will position the support sleeve under the ring structure to support it in the expanded condition.

To connect the connectors of the connection system, the external sleeve is retracted to withdraw the support sleeve from beneath the elements. An axial force which inserts the male connector into the female connector causes the elements to be brought into abutment with a shoulder at the opening of the female connector. The inclined surface of the ring element radially collapses the elements against the force of the circumferential spring element, until the ring structure is able to pass through the bore opening to the latching position. When the ring structure is aligned with the recess, the circumferential spring element pushes the elements into the recess. Release of the external sleeve positions the support sleeve beneath the ring element and the connector is latched.

In its latched position and when in operation, a raised internal pressure in the throughbore of the connection system acts to radially compress and clamp the male connector, the support sleeve, and the ring structure together. This resists or prevents retraction of the external sleeve and support sleeve, maintaining the connection in a failsafe latched condition.

A significant advantage of the connection system of this embodiment of the invention is that the expansion apparatus forms a solid and smooth ring in its expanded latched position. An arrangement of radially split elements would, when expanded, form a ring with spaces between elements around the sides. In contrast, the provision of a continuous engagement surface which surrounds the expansion ring and provides full annular contact with the recess provides a latch capable of supporting larger axial forces, and therefore the connection system can be rated to a higher maximum working pressure. In addition, the by minimising or eliminating gaps between elements, the device is less prone to ingress of foreign matter which could impede the collapsing action of the mechanism.

The principles of the connection system of this embodiment may also be applied to subsea connectors such as tie-back connectors. In alternative embodiments, the external sleeve for retracting the support sleeve may be hydraulically actuated, rather than manually as shown in the described embodiments.

The principles of the invention may be extended to multi-stage or telescopic expansion apparatus, which have applications to systems in which an increased expansion ratio is desirable. The following embodiments of the invention describe examples of such apparatus.

Figure 17A:
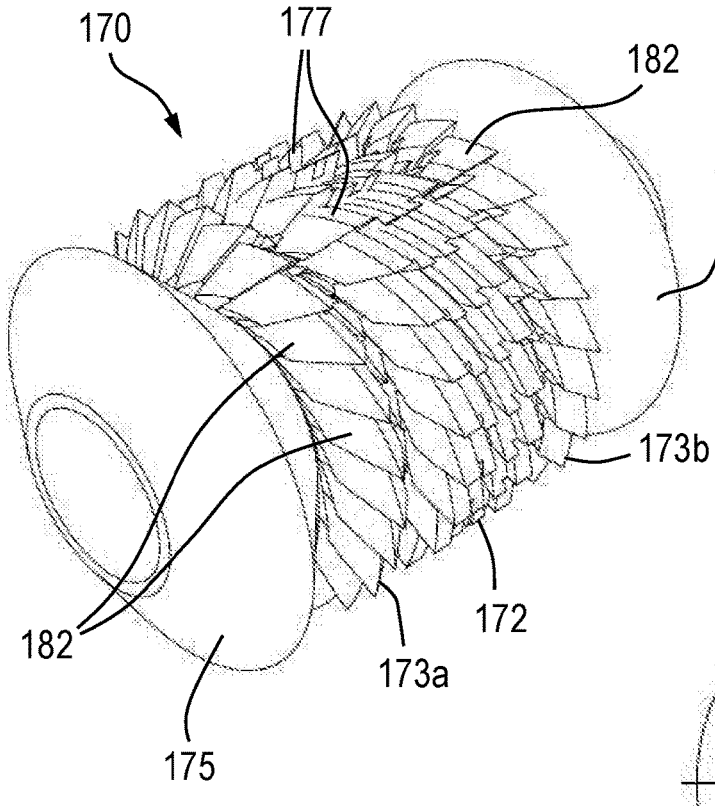
FIGS. 17A to 17C are respectively perspective, sectional and end views of an apparatus according to an alternative embodiment of the invention, shown in a collapsed condition.
Figure 17C:
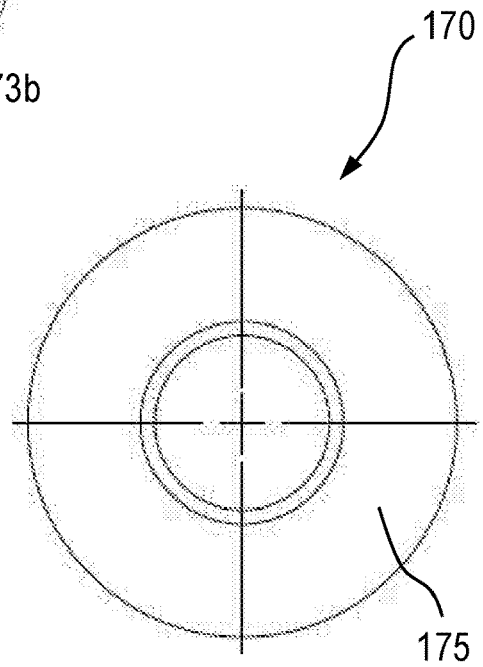
Figure 17B:
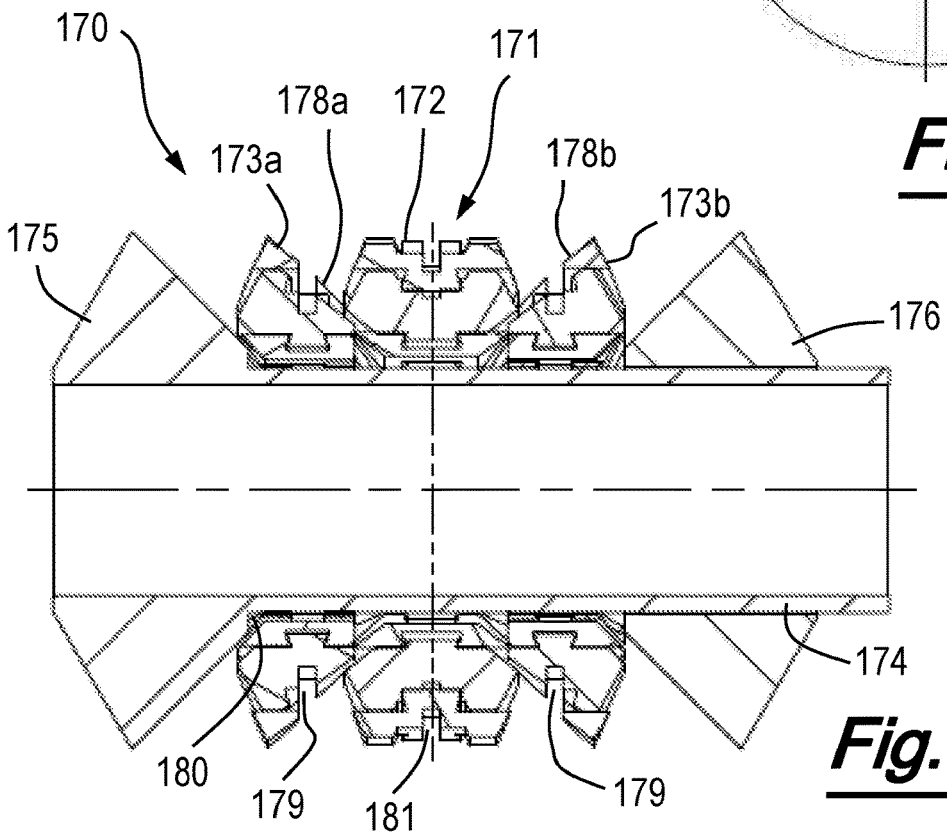
Figure 18A:
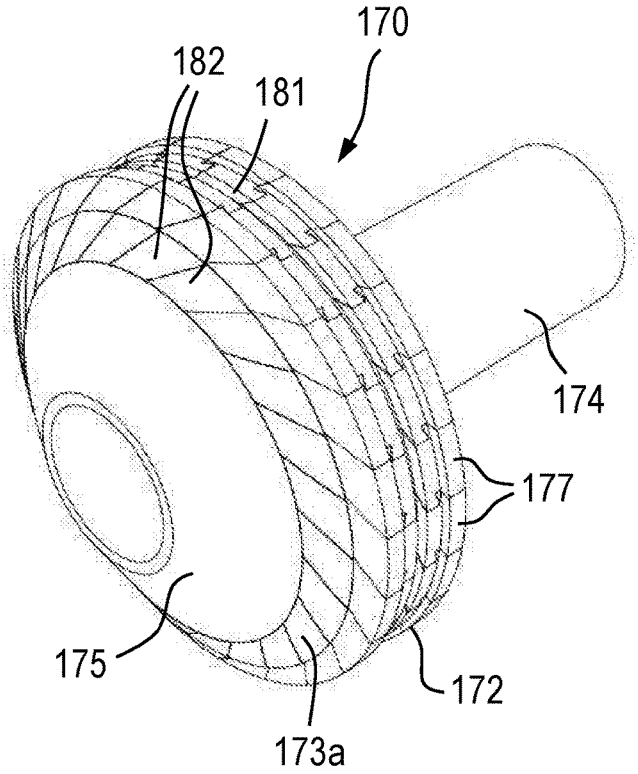
FIGS. 18A to 18C are respectively perspective, sectional and end views of the apparatus of FIGS. 17A to 17C, shown in an expanded condition.
Figure 18C:
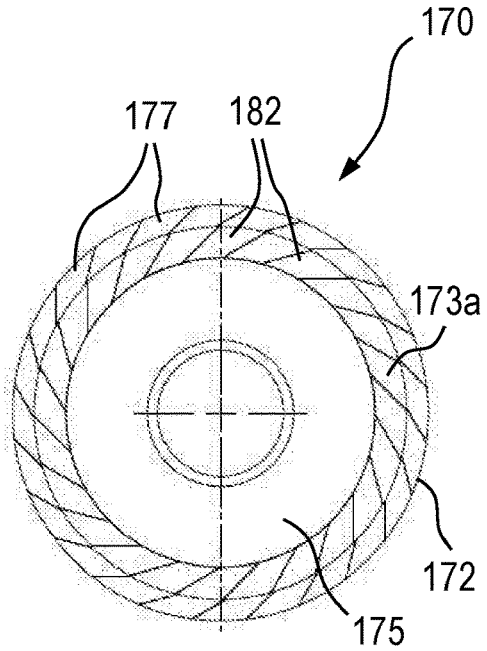

Referring firstly to FIGS. 17A to 18C, there is shown a two-stage expansion apparatus in accordance with an embodiment of the invention. FIGS. 17A to 17C are respectively perspective, longitudinal sectional, and end views of the apparatus in a first, collapsed condition. FIGS. 18A to 18C are equivalent views of the apparatus in an expanded condition. The apparatus, generally depicted at 170, comprises an expansion assembly 171 formed from three ring structures 172, 173*a*, 173*b*, each of which is formed from separate elements in the manner described with reference to FIGS. 1 to 4. The ring structures 172, 173*a*, 173*b* are disposed on a mandrel 174 between a wedge portion 175 which is fixed on a mandrel, and a moveable wedge member 176. A centre ring structure 172 is formed from a number of individual centre elements 177 assembled together. The centre elements 177 are similar to the elements 12 and 77 described with reference to previous embodiments of the invention. FIG. 19 is a geometric representation of a centre element of the apparatus of FIGS. 17A to 17C, shown from one side, and FIGS. 20A to 20F are respectively first perspective, second perspective, plan, first end, lower, and second end views of a centre element 177. The Figures show the inner and outer surfaces, first and second contact surfaces, interlocking profiles, and grooves for retaining circumferential springs which are equivalent in form and function to the features of the elements 12 and 77. Biasing means in the form of a circumferential spring retains the centre ring structure in its collapsed condition.

Disposed on either side of the centre ring structure are first and second outer ring structures 173*a*, 173*b* in the form of wedge ring structures. The wedge ring structures are also assembled from an arrangement of elements which, again, are similar in form and function to the elements 12 and 77. However, instead of providing an outer surface which is substantially parallel to the longitudinal axis of the apparatus, the outer surfaces of the outer elements are inclined to provide respective wedge surfaces 178*a*, 178*b* which face the centre ring structure 172.

Figure 21:
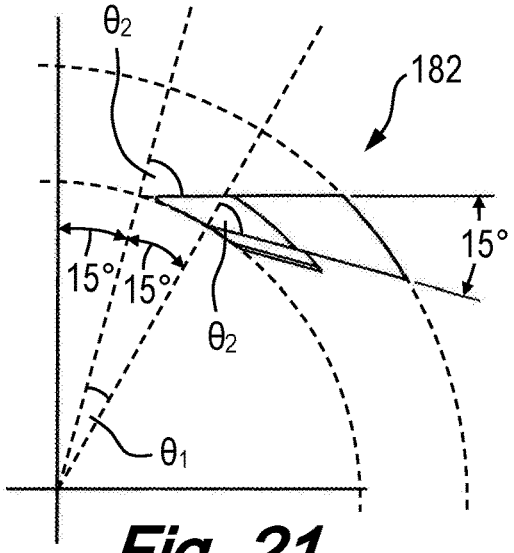
FIG. 21 is a geometric representation of an outer element of the apparatus of FIGS. 17A to 17C, shown from one side.
Figure 22A:
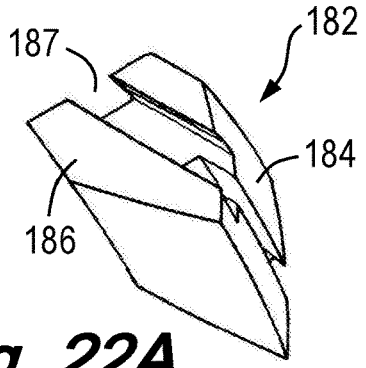
FIG. 22A to 22H are respectively first perspective, second perspective, third perspective, fourth perspective, plan, first end, lower, and second end views of an outer element of the apparatus of FIGS. 17A to 17C.
Figure 22B:
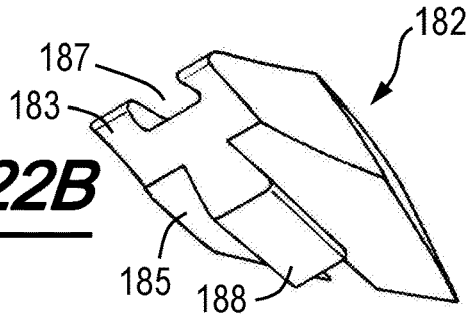
Figure 22C:
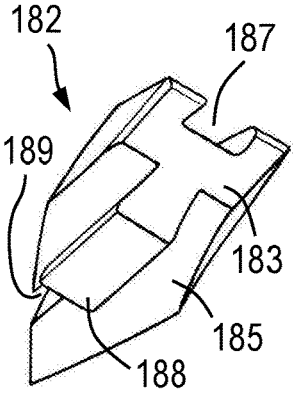
Figure 22D:
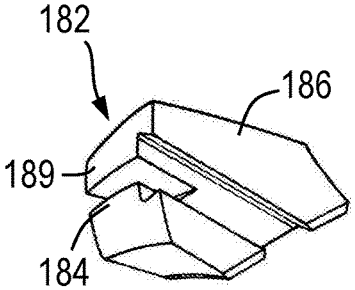
Figure 22E:
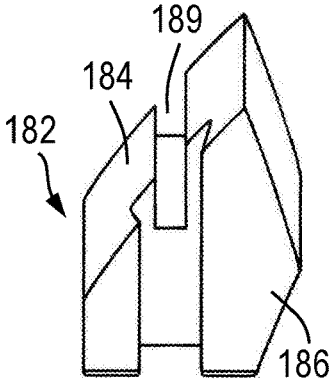
Figure 22F:
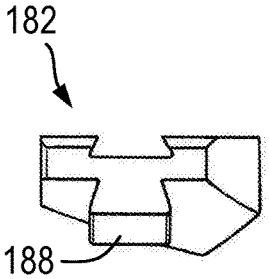
Figure 22G:
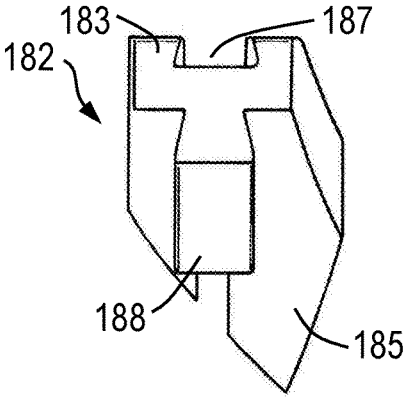
Figure 22H:
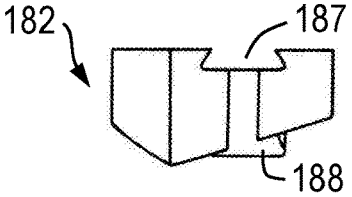

FIG. 21 is a geometric representation of an outer element 182 of the apparatus of FIGS. 17A to 17C, shown from one side, and FIGS. 22A to 22H are respectively first perspective, second perspective, third perspective, fourth perspective, plan, first end, lower, and second end views of an outer element 182. The Figures show the inner and outer surfaces 183, 184, first and second contact surfaces 185, 186, interlocking profiles 187, 188, and grooves 189 for retaining circumferential springs which are equivalent in form and function to the features of the elements 12 and 77. In the assembled ring structure, the outer elements and the centre elements are nested with one another, and the outer surfaces 184 of the outer elements define respective wedge profiles for corresponding centre elements 177 during a first expansion stage as will be described below. Biasing means in the form of a circumferential spring retains the outer rings structure in their collapsed conditions, with the sequencing of the expanding and collapsing movement controlled by the selection of the relative strengths of the biasing means of the centre ring and the outer rings.

In a first, collapsed condition, the elements of the centre ring structure and the elements of the first and second outer ring structures, have a maximum outer diameter which is less than or equal to the outer diameter of the wedge profile 175 and wedge member 176.

Operation of this embodiment of the apparatus will be described, with additional reference to FIGS. 18A to 18C.

In common with other embodiments, the apparatus is actuated to be radially expanded to a second diameter by an axial actuation force which moves the cone wedge member 176 on the mandrel and relative to the ring structure. The axial actuation force acts through the ring structures 173*a*, 173*b* to impart axial and radial force components onto the elements. Radial expansion of the ring structures 173*a*, 173*b* is resisted by their respective circumferential springs arranged in grooves 179, and the forces are transferred to the centre ring structure 172. The elements of centre ring experience an axial force from the wedge surfaces 178*a*, 178*b* of the elements of the outer ring structures, which is translated to a radial expansion force on the elements of the centre ring structure 172. The radial expansion force overcomes the retaining force of a circumferential spring in the groove 181 (which is selected to be weaker than the retaining forces of the circumferential springs in the outer rings), and the elements slide with respect to one another to expand the centre ring structure as the outer ring structures move together.

The pair of outer rings is brought together until the elements of the centre ring structure are expanded on the wedge profiles of the outer elements. In this condition, the first expansion stage is complete, but the centre ring is not yet expanded to its optimum outer diameter.

The elements of the wedge ring structure 173*a*, 173*b* are symmetrical about a centre line of the ring structure, and are configured to be brought into abutment with one another under a central line under the centre segments. This design defines an end point of the axial travel of an outer ring structure, and prevents its elements from over-travelling. This abutment point changes the mode of travel of an outer ring from axial displacement (during which it expands an adjacent ring which is disposed towards the centre of the apparatus by a wedging action) into a tangential sliding movement of elements within the ring, to cause it to expand radially on the apparatus.

The outer ring structures 173*a* and 173*b* have been brought together into abutment, and further application of an axial actuation force causes the elements of the respective outer ring structures to experience a radial force component from the wedge 175 and the wedge profile 176. The radial force directs the elements of the outer ring structures to slide with respect to one another into radially expanded conditions. The radial movement of the elements of the outer rings is the same as the movement of the elements of the centre ring structure and the elements described with reference to previous embodiments: the elements slide with respect to one another in a tangential direction, while remaining in mutually supportive planar contact. As the outer ring structures expand, a radial force is imparted to the elements of the centre ring, which continue to slide with respect to one another in a tangential direction to their fully expanded condition.

Figure 18B:
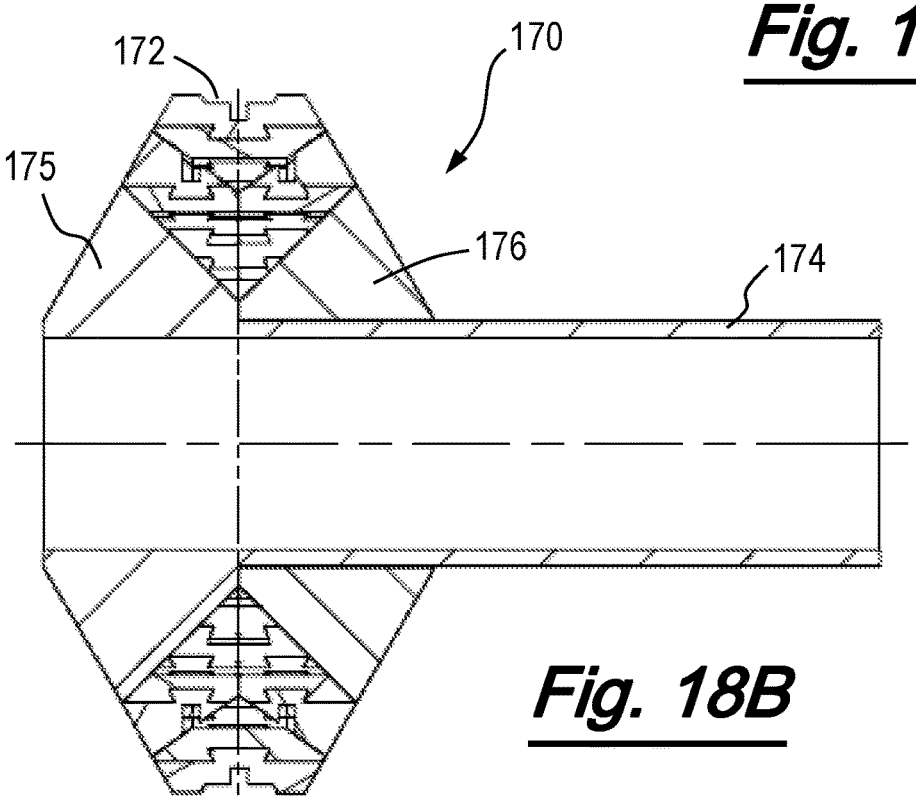
Figure 19:
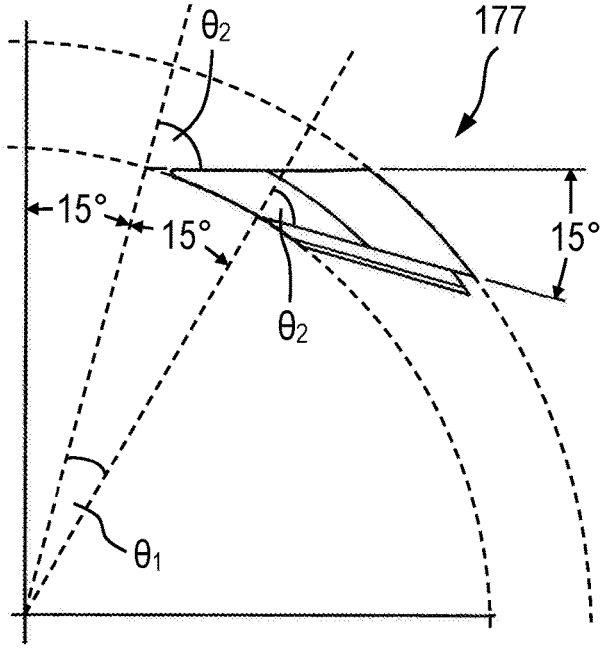
FIG. 19 is a geometric representation of a centre element of the apparatus of FIGS. 17A to 17C, shown from one side.
Figure 20A:
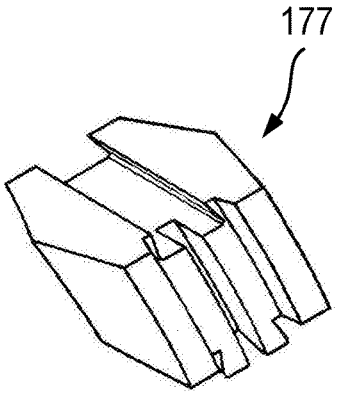
FIGS. 20A to 20F are respectively first perspective, second perspective, plan, first end, lower, and second end views of a centre element of the apparatus of FIGS. 17A to 17C.
Figure 20B:
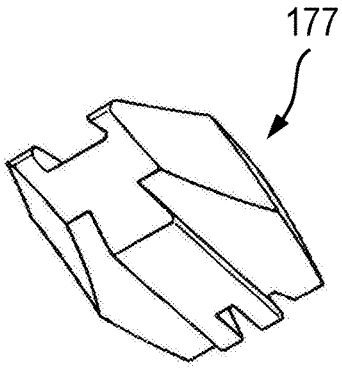
Figure 20C:
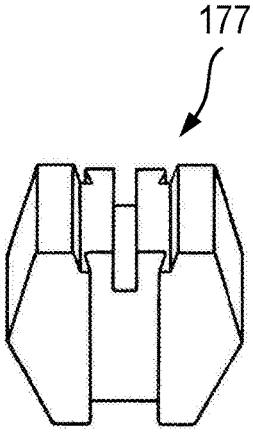
Figure 20D:
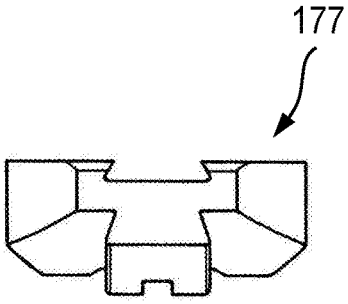
Figure 20E:
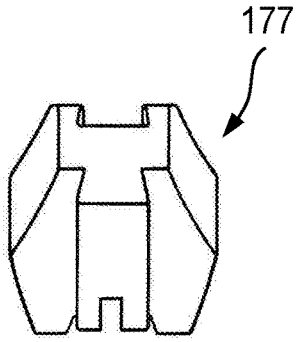
Figure 20F:
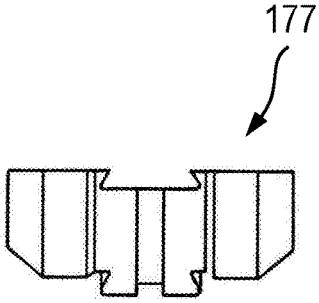

The resulting expanded condition is shown in FIGS. 18A to 18C. The apparatus forms an expanded ring structure which is solid, with no gaps between its elements, and which has a smooth circular outer surface at its full expanded condition. In addition, both of the annular surfaces or flanks of the expanded ring are smooth. The outer diameter of the expanded ring is significantly greater than the outer diameter of the ring structures (and wedges) in their collapsed state, with the increased expansion resulting from the two stage mechanism.

Collapsing of the apparatus to a collapsed condition is achieved by releasing the axial actuation force. The sequence of collapsing is the reverse of the expanding process: the outer ring structures are collapsed first under the higher retaining forces of their respective biasing springs. Collapse of the outer rings also brings the centre ring structure from is fully expanded condition to an intermediate condition. Further separation of the wedge profiles collapses the centre ring structure under the retaining force of its biasing spring, back to the collapsed position shown in FIGS. 17A and 17B.

Figure 23C:
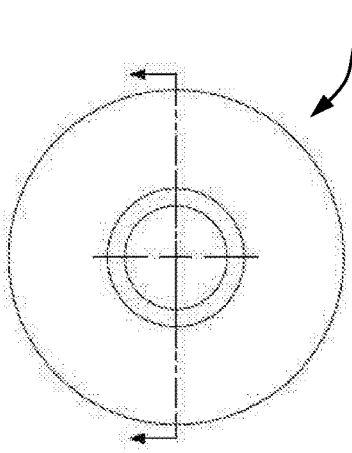
FIGS. 23A to 23C are respectively perspective, sectional and end views of an apparatus according to an alternative embodiment of the invention, shown in a collapsed condition.
Figure 23A:
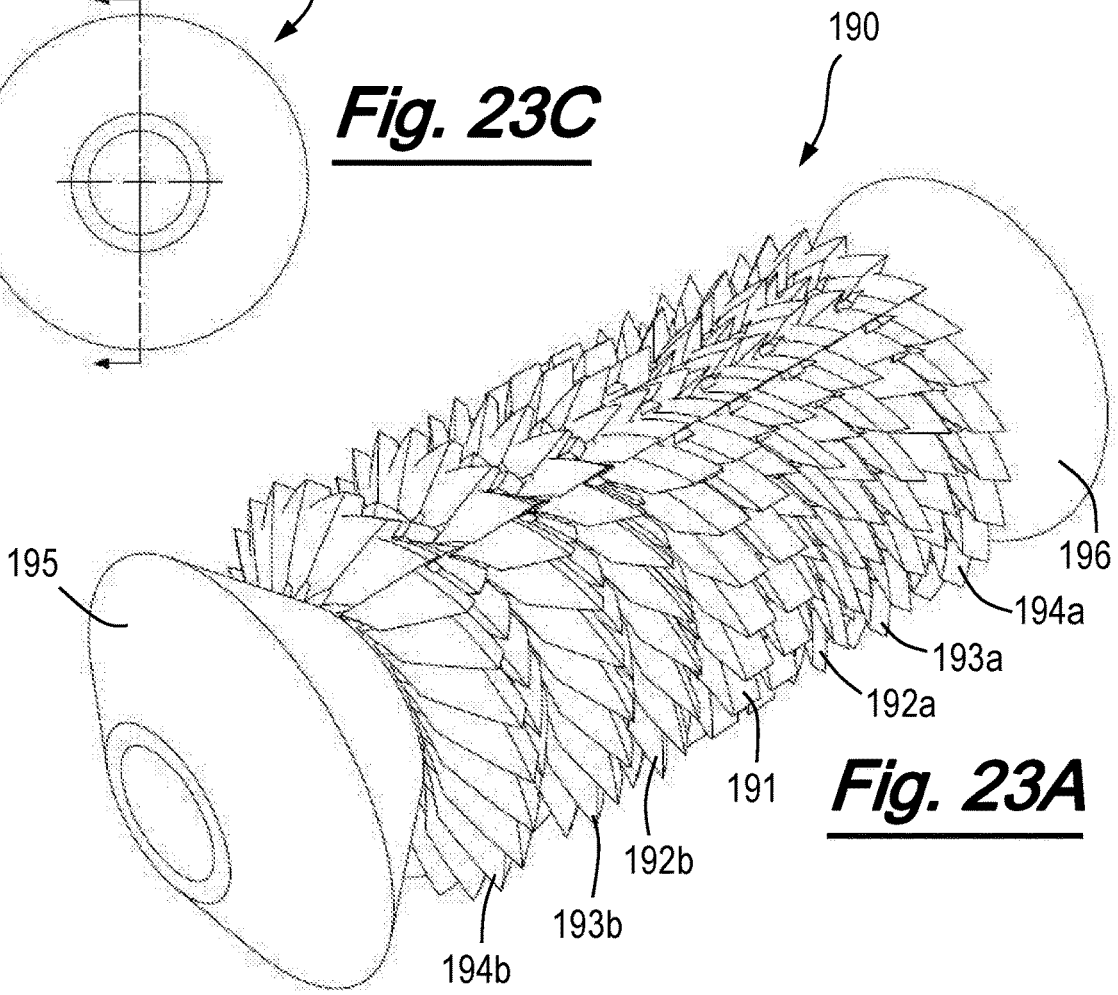
Figure 23B:
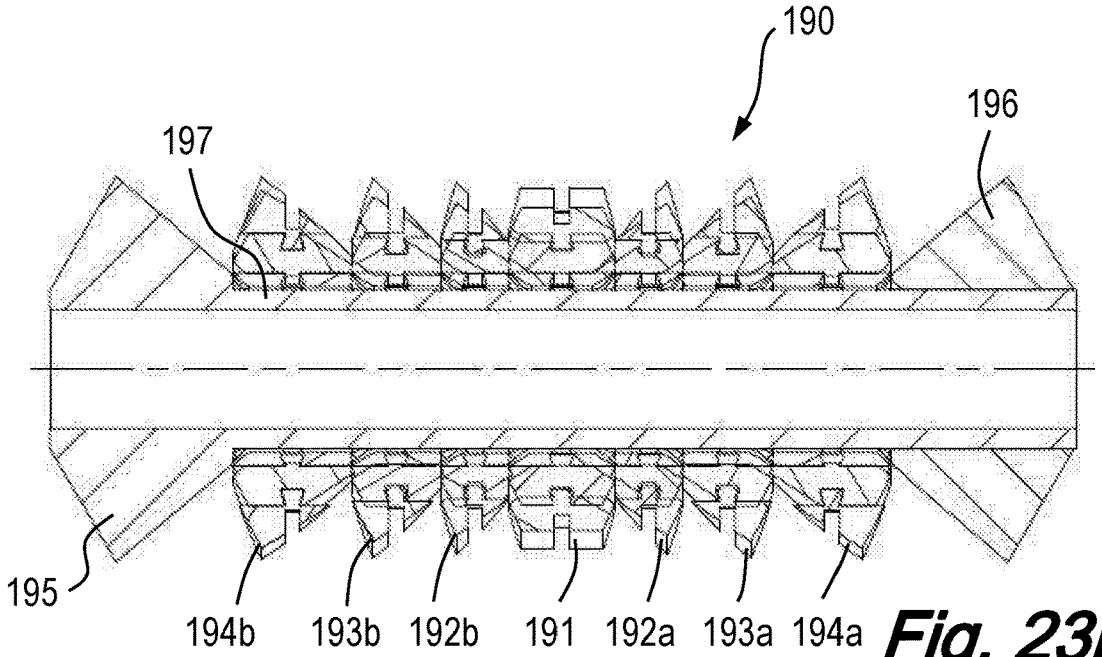

The principles of the two-stage expansion mechanism can be extended to other multi-stage expanding and collapsing apparatus. FIGS. 23A to 24C show such an apparatus, which has a four-stage expansion system. FIGS. 23A to 23C are respectively perspective, longitudinal sectional, and end views of the apparatus in a first, collapsed condition. FIGS. 18A to 18C are equivalent views of the apparatus in an expanded condition. The apparatus, generally shown at 190, is similar to the apparatus 170, and its form and function will be understood from FIGS. 17 and 18 and the accompanying description. However, the apparatus 190 differs in that it comprises a centre ring structure 191 formed from individual elements, and three pairs of outer ring structures 192, 193, 194 (each consisting of upper and lower ring structures 192*a*, 192*b*, 193*a*, 193*b*, 194*a*, 194*b*) disposed on a mandrel 197 between wedge 195 and wedge profile 196.

Figure 24A:
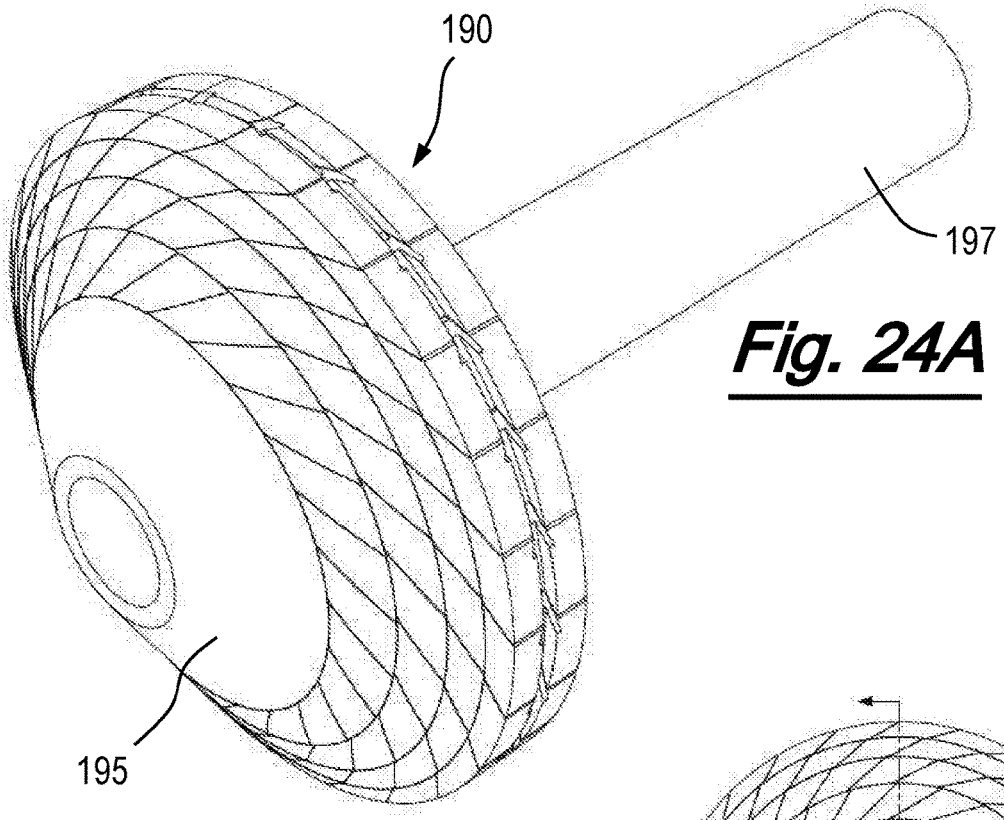
FIGS. 24A to 24C are respectively perspective, sectional and end views of the apparatus of FIGS. 23A to 23C, shown in an expanded condition.
Figure 24C:
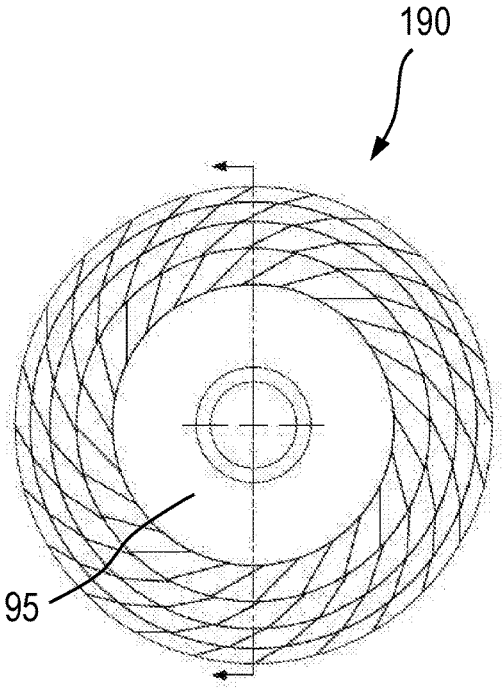
Figure 24B:
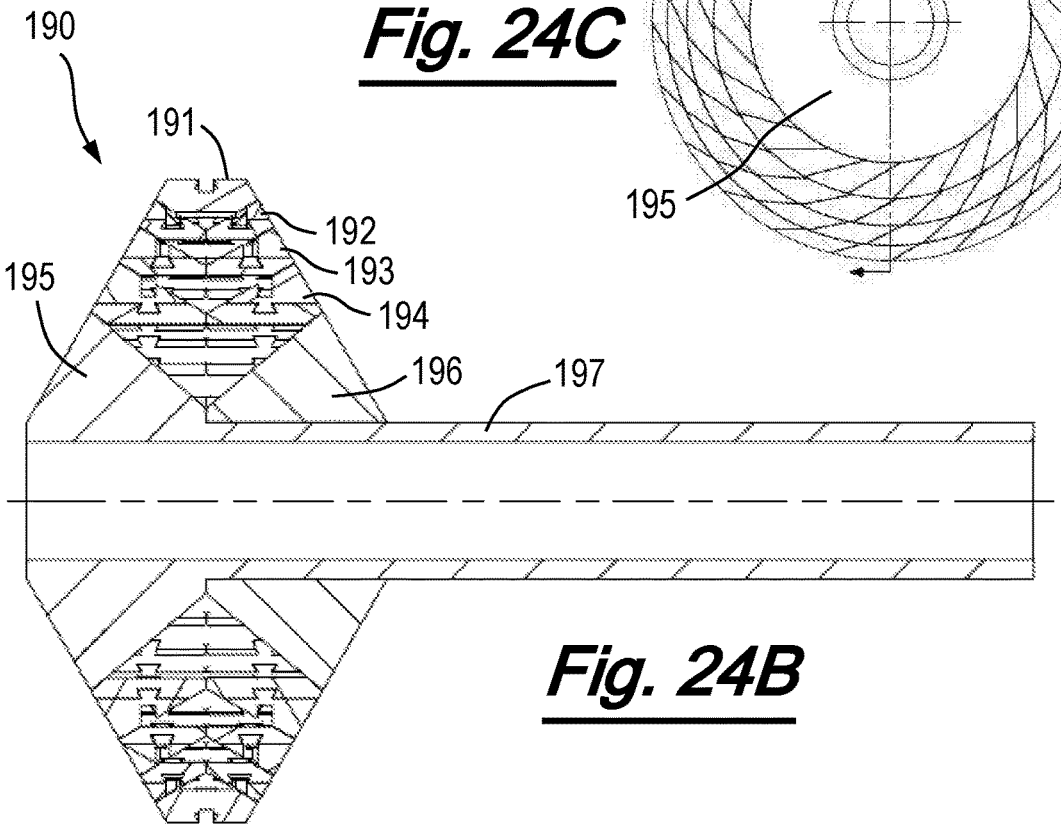

In successive stages of actuation, the centre ring structure 191 is deployed to a first intermediate expanded state, and first, second, and third pairs of outer ring structures are deployed to their radially expanded states, from the inside of the apparatus adjacent to the centre ring, to the outside. At each stage, the centre ring structure is deployed to successive intermediate expanded states, until it is fully expanded as shown in FIGS. 24A to 24C. The outer diameter of the expanded ring is significantly greater than the outer diameter of the ring structures (and wedges) in their collapsed state, with the increased expansion resulting from the four-stage mechanism. Sequencing of the expansion is designed to be from the inside to the outside by selection of biasing springs with successively higher retaining forces (moving from the inside or centre of the apparatus to the outermost rings). Collapsing of the apparatus to a collapsed condition is achieved by releasing the axial actuation force, and the sequence of collapsing is the reverse of the expanding process.

Figure 25A:
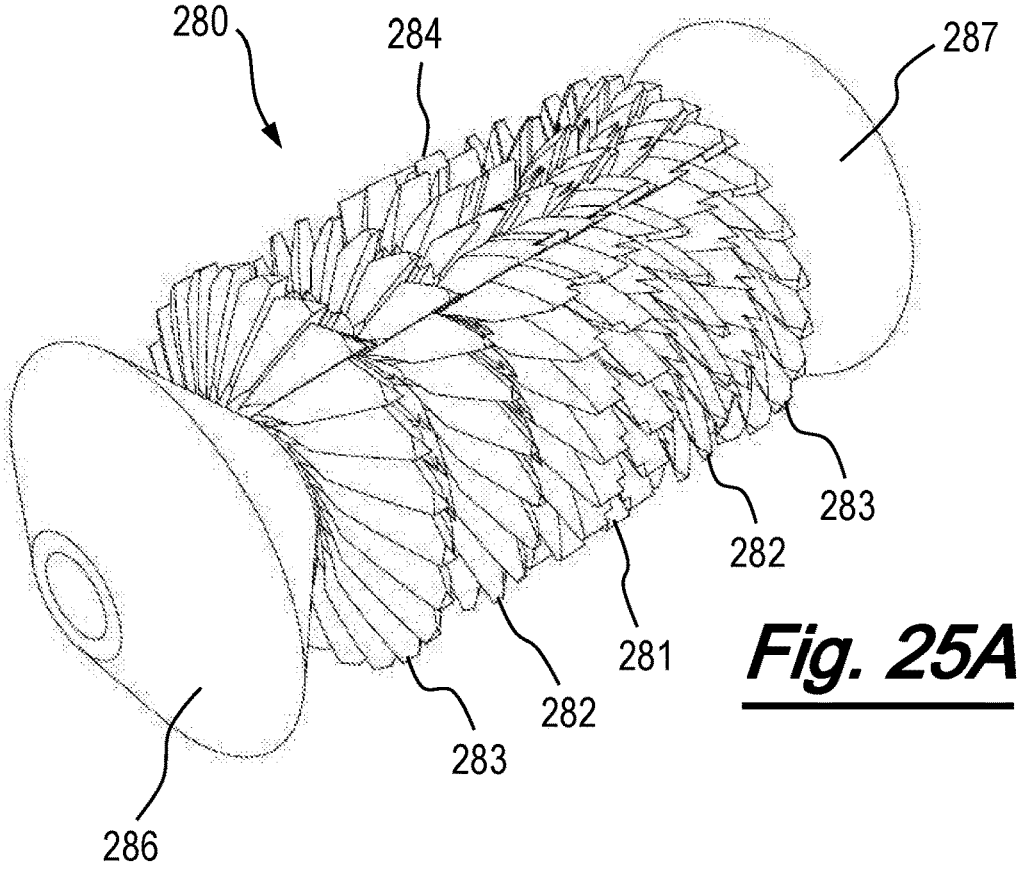
FIGS. 25A and 25B are respectively perspective and sectional views of an apparatus according to an alternative embodiment of the invention, shown in a collapsed condition.
Figure 25B:
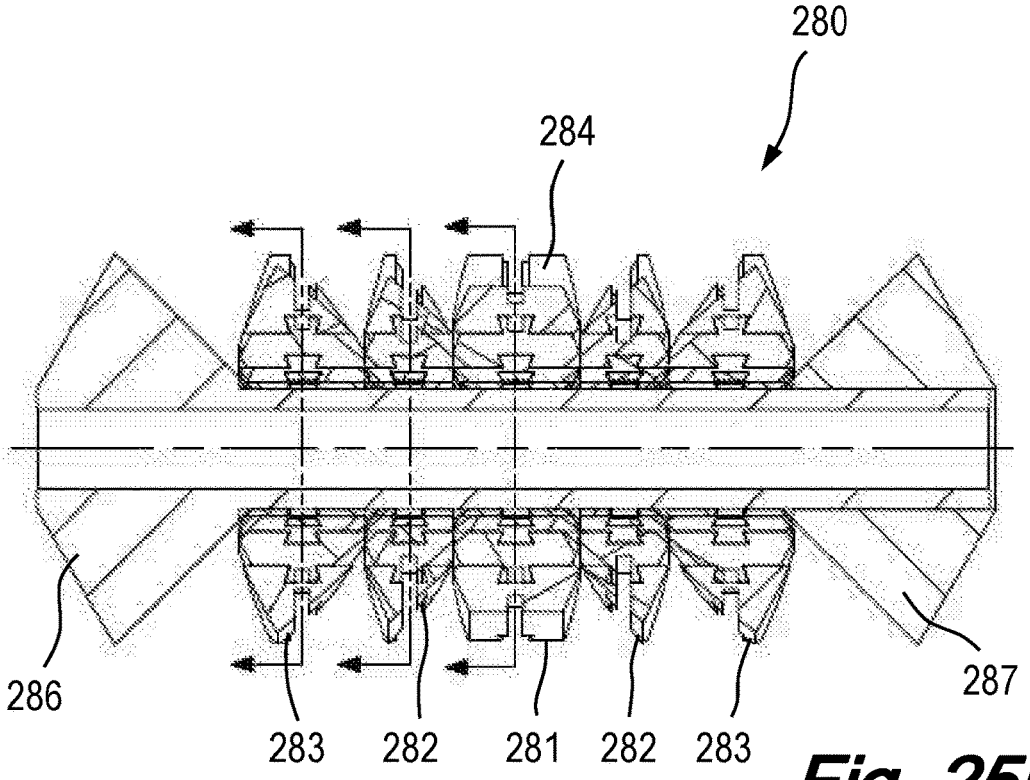
Figure 26A:
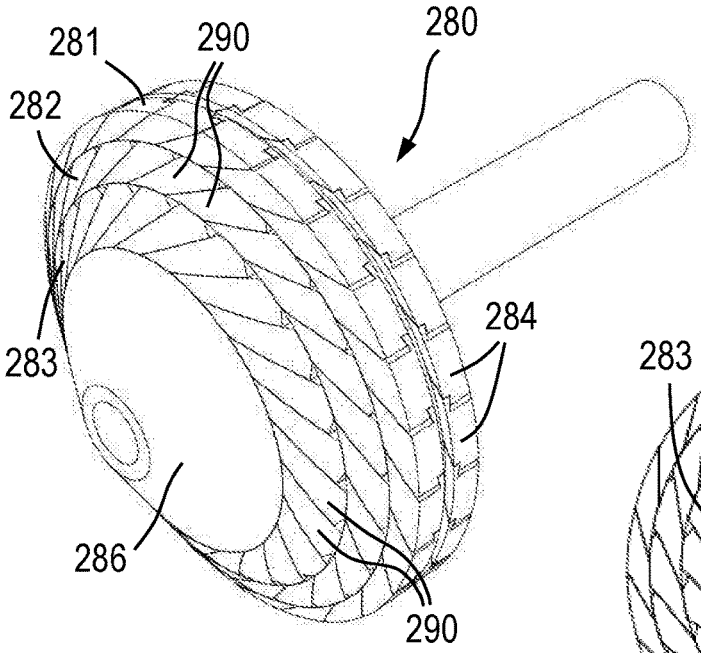
FIGS. 26A to 26D are respectively perspective, first sectional, end, and second sectional views of the apparatus of FIGS. 25A and 25B, shown in an expanded condition.
Figure 26C:
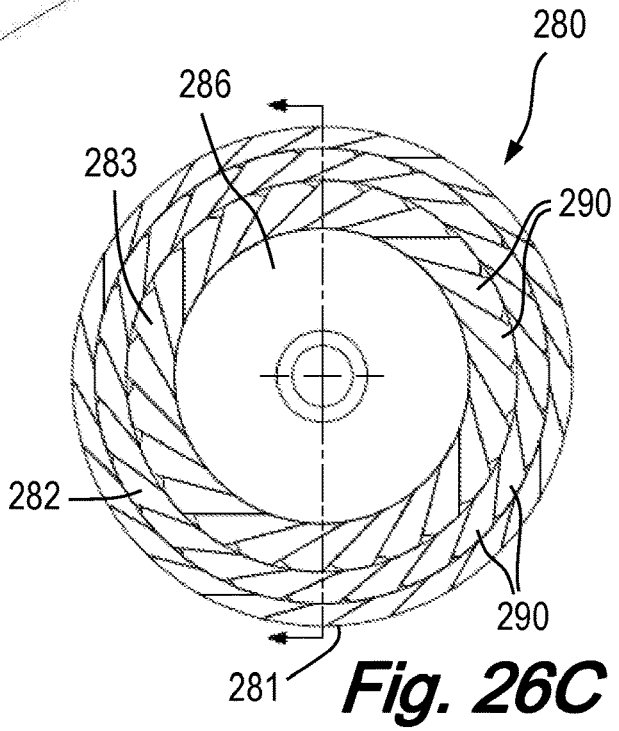
Figure 26B:
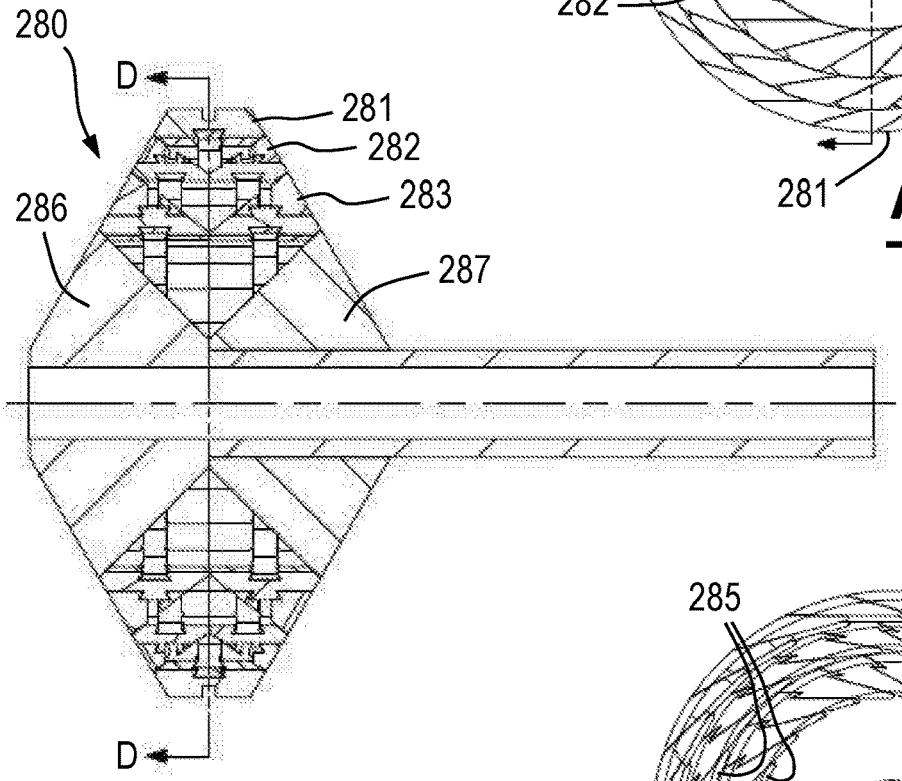
Figure 26D:
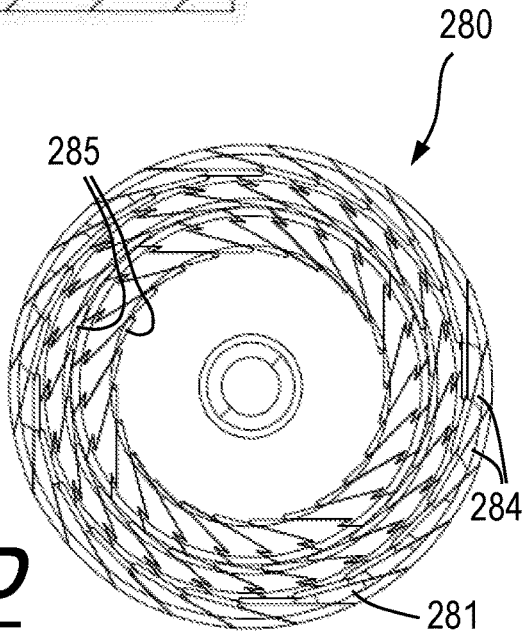

FIGS. 25A to 26D show a multi-stage expanding and collapsing system in accordance with an alternative embodiment of the invention. FIGS. 25A and 25B are respectively perspective and longitudinal sectional views of the apparatus in a first, collapsed condition. FIGS. 26A and 26B are equivalent views of the apparatus in an expanded condition; FIG. 26C is an end view and FIG. 26D is a section through line D-D of FIG. 26B. The apparatus, generally shown at 280, is similar to the apparatus 170 and 190, and its form and function will be understood from FIGS. 17 to 24 and the accompanying description. However, the apparatus 280 differs in that it comprises pairs of ring structures 281, 282, 283 formed from individual elements with geometry different from those of previous embodiments.

Figure 27:
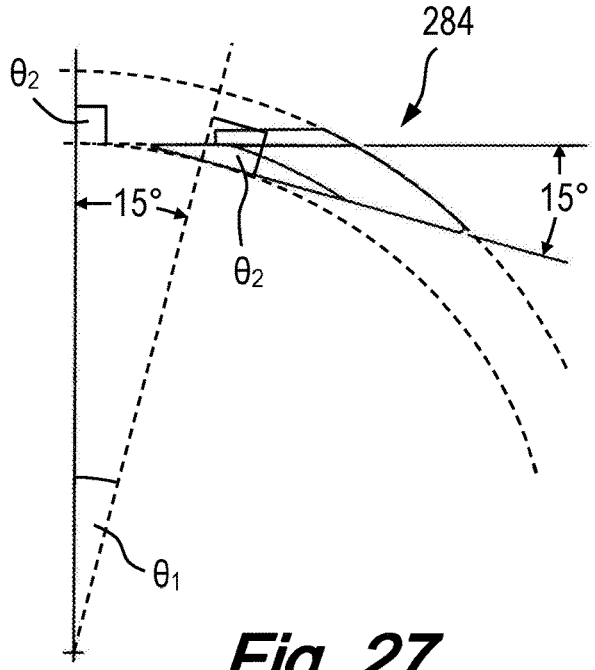
FIG. 27 is a geometric representation of a centre element of the apparatus of FIGS. 25A and 25B, shown from one side.
Figure 28A:
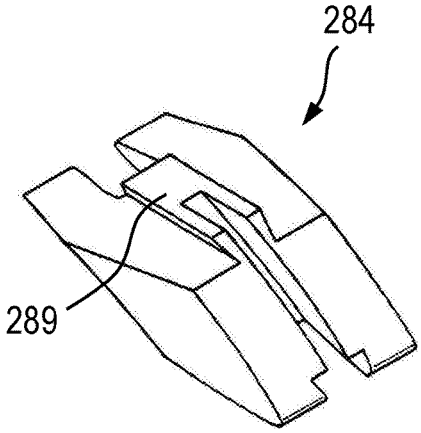
FIGS. 28A to 28F are respectively first to fourth perspective, first end, and second end views of a centre element of the apparatus of FIGS. 25A and 25B.
Figure 28B:
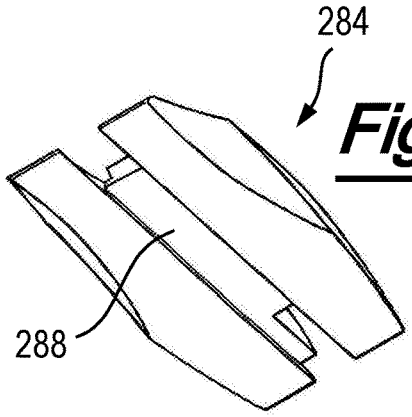
Figure 28C:
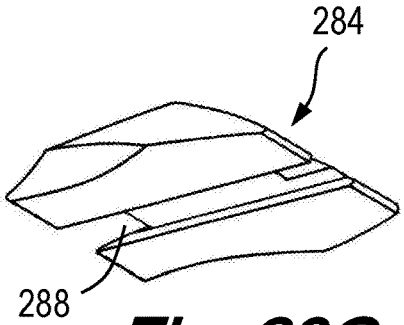
Figure 28D:
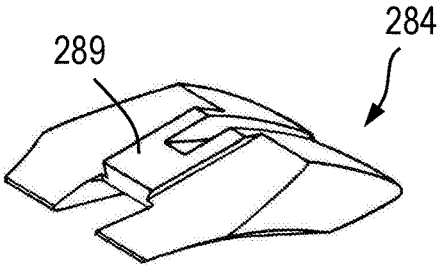
Figure 28E:
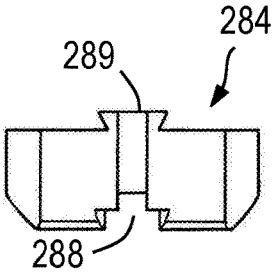
Figure 28F:
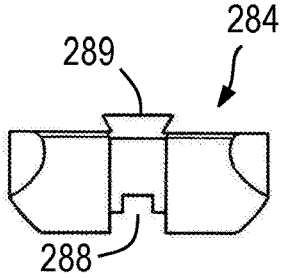

FIG. 27 is a geometric representation of a centre element of the apparatus of FIGS. 25A and 25B, shown from one side, and FIGS. 28A to 28F are respectively first perspective, second perspective, plan, first end, lower, and second end views of a centre element 284. The Figures show the inner and outer surfaces, first and second contact surfaces, interlocking profiles, and grooves for retaining circumferential springs which are equivalent in form and function to the features of the elements 12 and 77.

Each element is effectively a segment of a ring which has its nominal outer diameter at the optimum expansion condition of the ring, but which has been inclined at an angle $\theta_2$ with respect to a radial direction. However, in this embodiment, $\theta_2$ is 90 degrees, and a shallower, finer wedge profile is created by the element. The orientation planes of the contact surfaces are tangential to the circle described by the inner surface of the ring structure in its collapsed condition. This enables optimisation of the collapsed volume of the ring structure, by reducing the size of the gaps created at the inner surface of the ring in the collapsed condition and enabling a more compact collapsed condition. These include the introduction of flat sections 285 at the inner surface of the elements (visible in FIG. 26D), which manifest as spaces at the inner diameter of the ring when in an expanded or partially expanded condition. In the construction shown, the profile of the inner surface of the expanded ring is not critical, as the inner diameter of the ring structure is floating, and the true inner diameter is defined by the actuation wedge profiles 286, 287 rather than the inner surface of the ring. The spaces are therefore not detrimental to the operation of the apparatus, and the apparatus benefits from a reduced collapse volume.

The elements 284 also differ from the elements of previous embodiments of the invention in that the interlocking profiles formed by grooves and tongues are inverted, such that the groove 288 is in the inner surface of the element, and the tongue 289 is in the outer surface. This increases the engagement length between adjacent elements.

The elements 290 of the ring structures 282 and 283 are similarly formed, with angle $\theta_2$ at 90 degrees, with the orientation planes of their contact surfaces being tangential to the circle described by the inner surface of the ring structure in its collapsed condition.

It should be noted that in other embodiments, different angles $\theta_2$ may be adopted, including those which are in the range of 80 degrees to 90 degrees (most preferably tending towards 90 degrees).

Operation of the expanding and collapsing apparatus is the same as that described with reference to FIGS. 23 and 24, with the centre ring structure 281 being deployed to a first intermediate expanded state, and first and second pairs of outer ring structures being deployed to their radially expanded states, in sequence from the inside of the apparatus adjacent to the centre ring 281, to the outside. Sequencing of the expansion is designed to be from the inside to the outside by selection of biasing springs with successively higher retaining forces (moving from the inside or centre of the apparatus to the outermost rings). Collapsing of the apparatus to a collapsed condition is achieved by releasing the axial actuation force, and the sequence of collapsing is the reverse of the expanding process.

The apparatus 280, by virtue of the compact collapsed inner volumes achievable with the finer wedge profiles, is capable of increased expansion ratios. In this example, the apparatus 280 is configured to have the same expansion ratio as the apparatus 190, with only two pairs of expanding ring structure compared with the three pairs in the apparatus 190. This reduces the axial length of the apparatus and greatly reduces the number of parts required.

The particularly high expansion ratios achieved with the multi-stage expansion embodiments of the invention enable application to a range of operations. For example, the apparatus may form part of a mechanically actuated, high expansion, production packer or high expansion annular flow barrier. Particular applications include (but are not limited to) cement stage packers or external casing packers for openhole applications.

The expansion ratios achievable also enable use of the apparatus in through-tubing applications, in which the apparatus is required to pass through a tubing or restriction of a first inner diameter, and by expanded into contact with a tubing of a larger inner diameter at a greater depth in the wellbore. For example, the apparatus may be used in a high expansion retrievable plug, which is capable of passing through a production tubing to set the plug in a larger diameter liner at the tailpipe.

An application of the multi-stage expansion apparatus of FIGS. 17 and 18 to a fluid conduit patch tool and apparatus will now be described with reference to FIGS. 29A to 30B. A typical patching application requires the placement and setting of a tubular section over a damaged part of a fluid conduit (such as a wellbore casing). A patch tool comprises a tubular and a pair of setting mechanisms axially separated positions on the outside of the conduit for securing the tubular to the inside of the fluid conduit. It is desirable for the setting mechanisms to provide an effective flow barrier, but existing patch systems are often deficient in providing a fluid-tight seal with the inner surface of the fluid conduit.

Figure 29A:
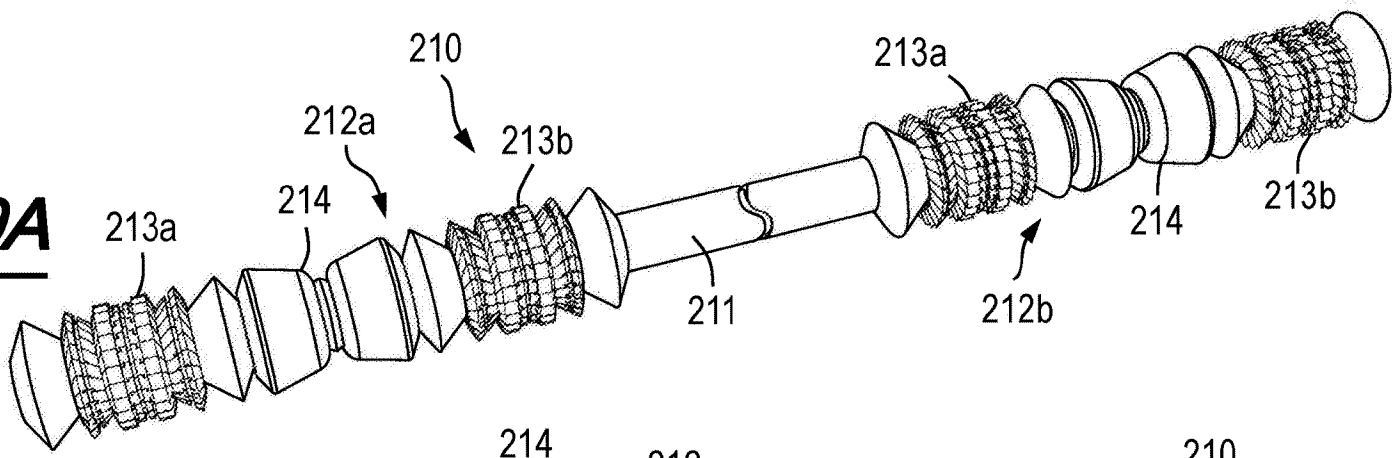
FIGS. 29A and 29B are respectively perspective and sectional views of a patch apparatus according to an embodiment of the invention, shown in a collapsed condition.
Figure 29B:
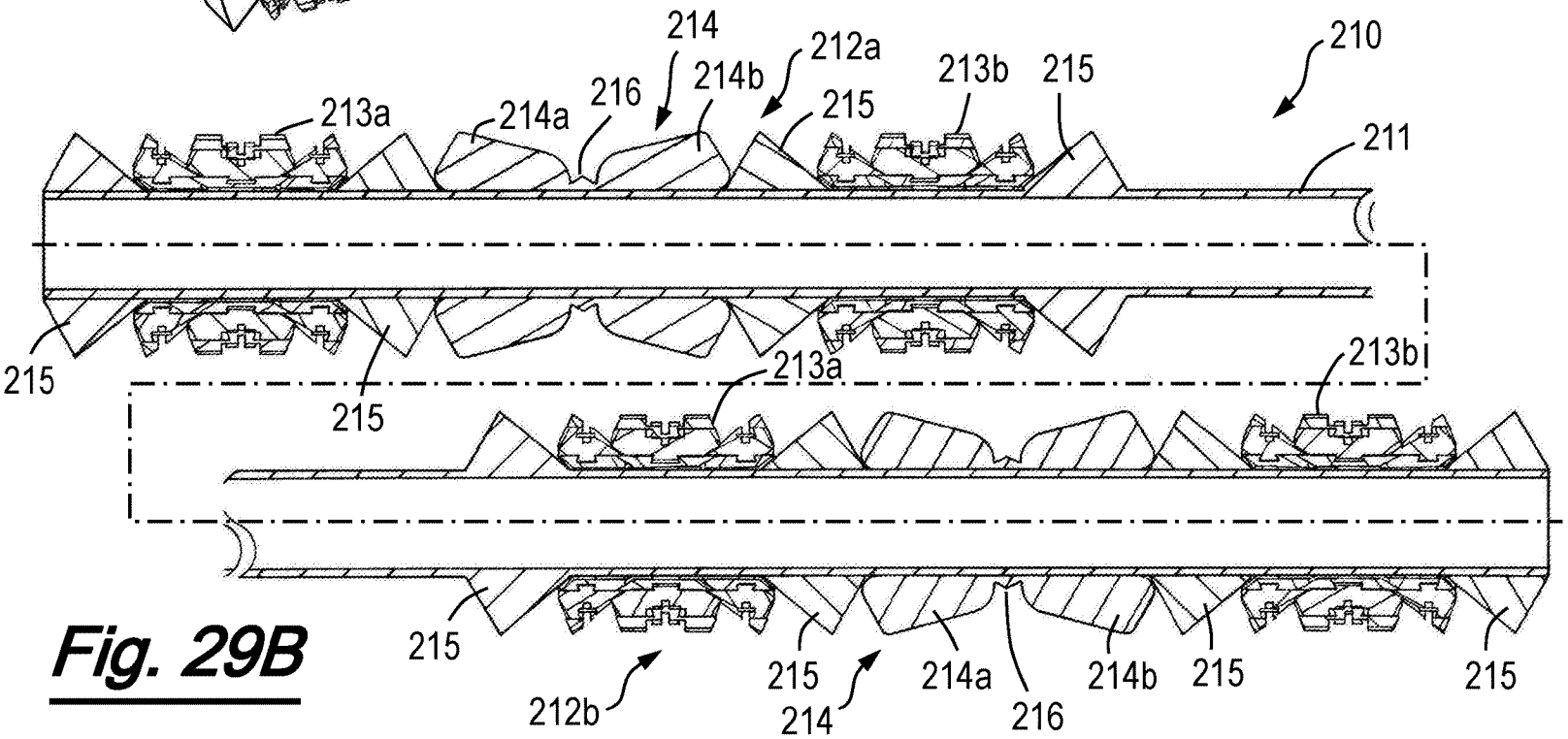
Figure 30A:
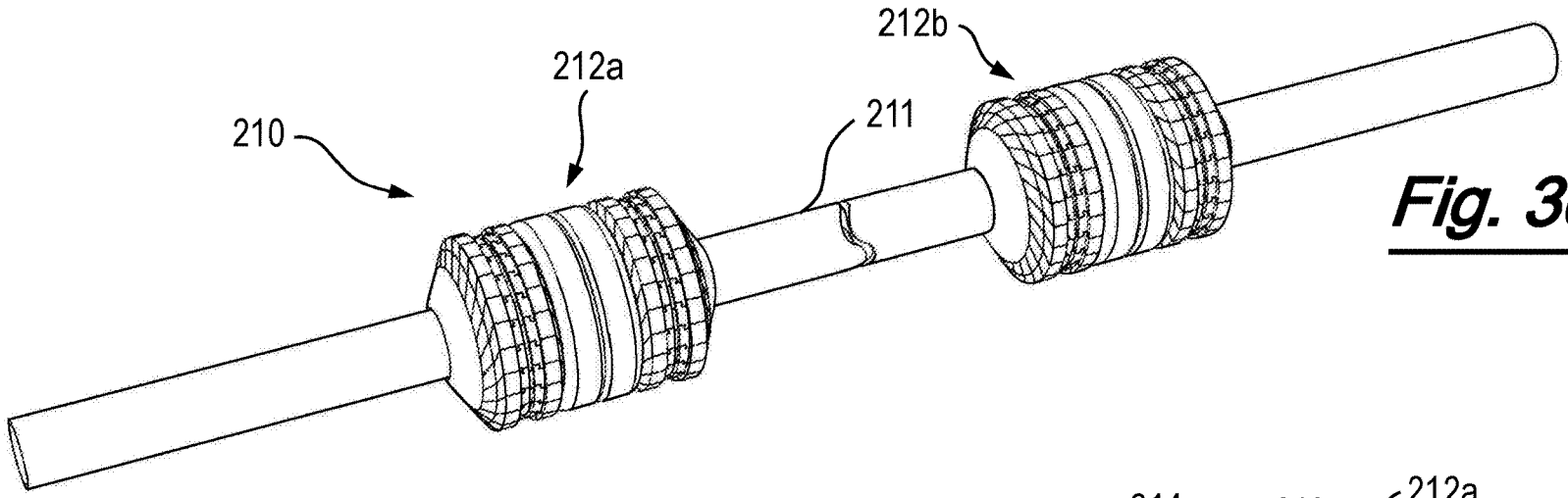
FIGS. 30A and 30B are respectively perspective and sectional views of the apparatus of FIGS. 29A and 29B, shown in an expanded condition.
Figure 30B:
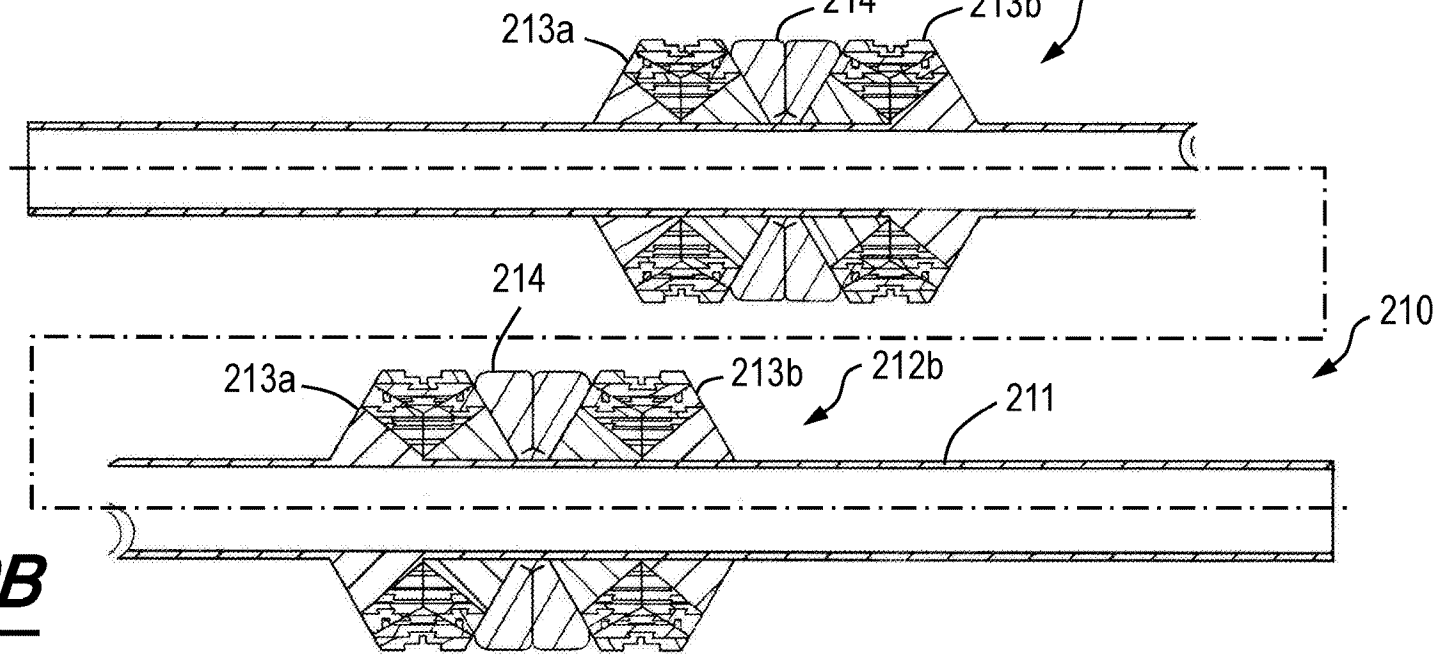

FIGS. 29A and 29B show a high expansion patching tool, generally depicted at 210, from perspective and longitudinal sectional views shown in a collapsed, run position. FIGS. 30A and 30B are equivalent views of the apparatus in an expanded condition.

The patching tool comprises a tubular section 211, and a pair of expansion assemblies 212*a*, 212*b* (together 212) in axially separated positions on the section. The distance between the assemblies 212*a*, 212*b* is selected to span the damaged section of a fluid conduit to be patched. Each of the assemblies 212 comprises a pair of expansion apparatus 213*a*, 213*b*, disposed on either side of an elastomeric seal element 214. The expansion apparatus 213 are similar in form and function to the expansion apparatus 170, and their operation will be described with reference to FIGS. 17 and 18. Each comprises a centre ring structure and a pair of outer ring structures. A pair of cone wedge members 215 is provided on either side of the expansion apparatus 213.

The elastomeric seal elements 214 are profiled such that an axially compressive force deforms the elastomeric material, and brings first and second halves 214*a*, 214*b* of the seal element together around a deformation recess 216.

The patch tool is, like other embodiments of the invention, configured to be actuated by an axial force. The axial force acts to radially expand the expansion apparatus 213 in the manner described with reference to FIGS. 17 and 18, and into contact with the fluid conduit to be patched. The elastomeric seals are deformed by the axial force via the cone wedges 215, to change shape and fill an enclosed annular space formed between a pair of expansion apparatus 213*a*, 213*b*. The expanded condition is shown in FIGS. 30A and 30B.

The expansion apparatus may provide sufficient frictional force with the inner surface of the conduit being patched to secure the patch tool in the conduit. This may be facilitated by providing engaging profiles on the expansion apparatus (for example, similar to the expansion slips described with reference to FIGS. 9, 11 and 12). Alternatively (or in addition), separate anchor mechanisms may be provided.

The patching tool 210 provides a pair of effective seals which are fully supported by the expansion apparatus, each of which forms a solid anti-extrusion ring.

Figure 31:
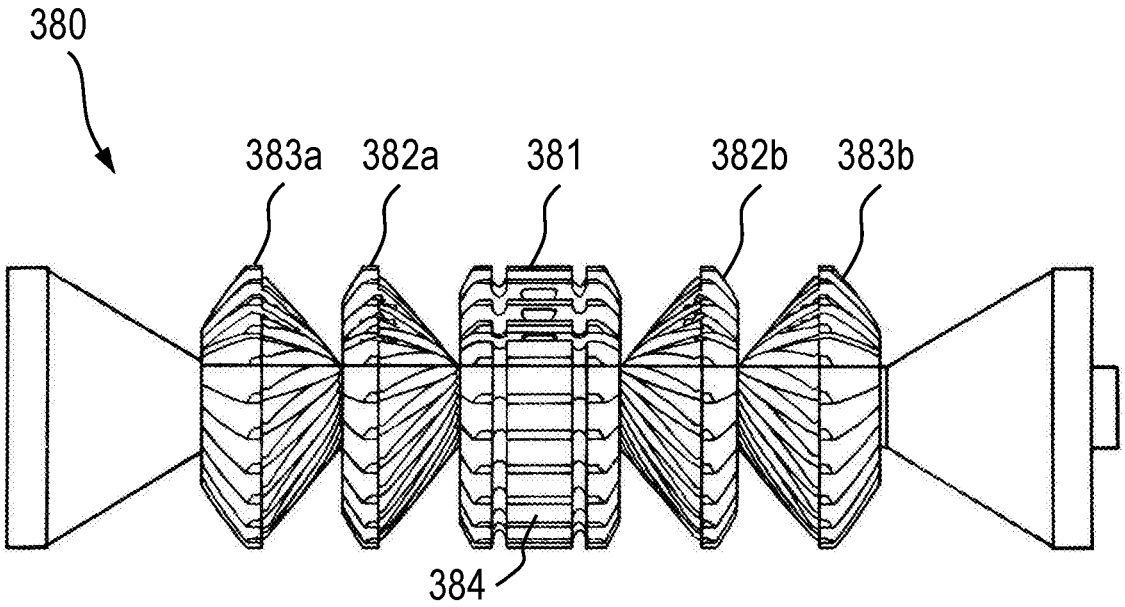
FIG. 31 is a side view of an apparatus according to an alternative embodiment of the invention in a first, collapsed condition.
Figure 32:
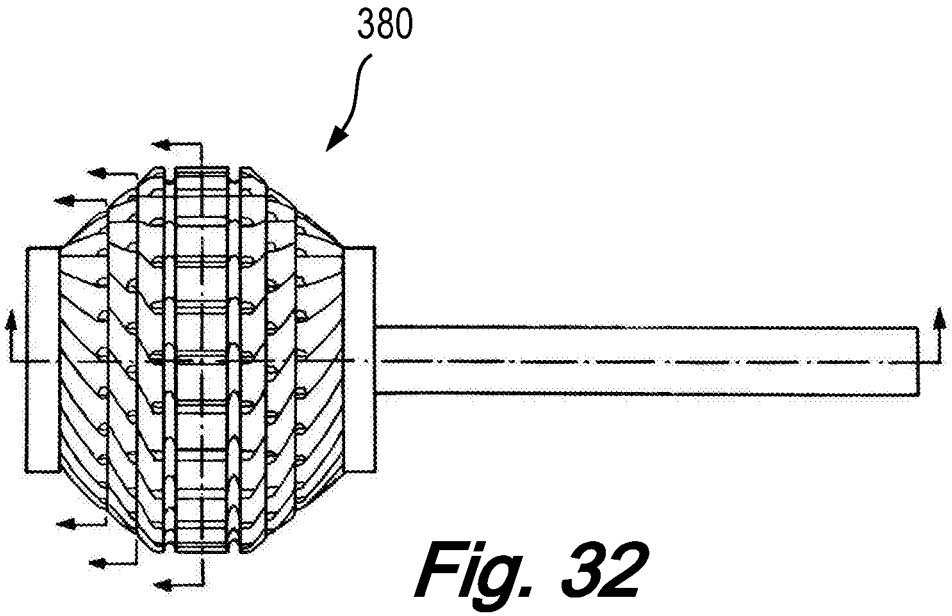
FIG. 32 is a side view of the apparatus of FIG. 31 a second, collapsed condition.
Figure 33A:
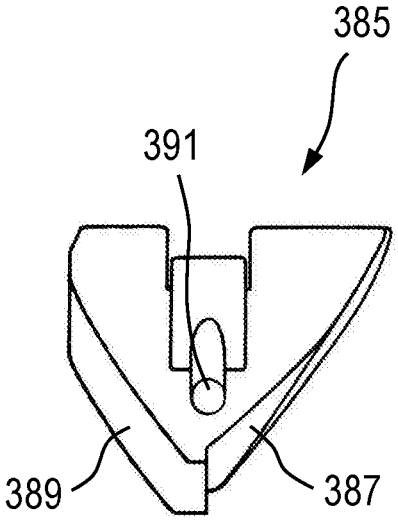
FIGS. 33A and 33B are respectively plan and isometric views of an element of the apparatus of FIGS. 31 and 32.
Figure 33B:
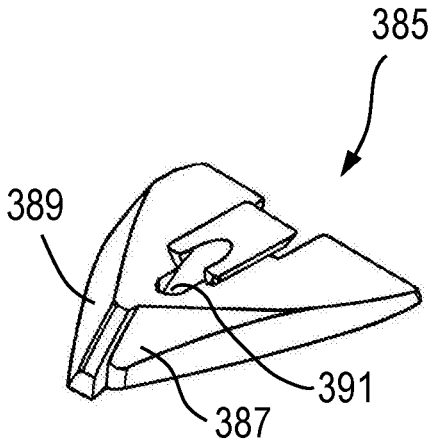
Figure 34A:
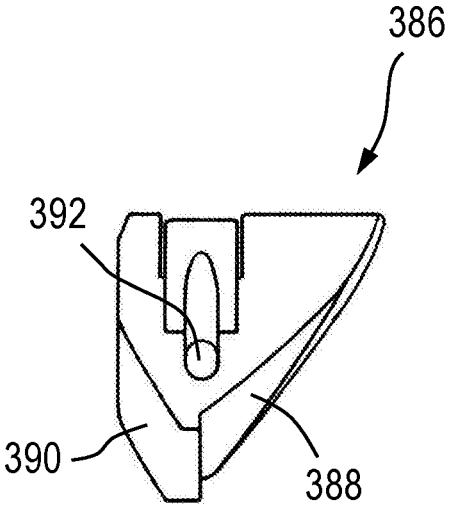
FIGS. 34A and 34B are respectively plan and isometric views of a second element of the apparatus of FIGS. 31 and 32.
Figure 34B:
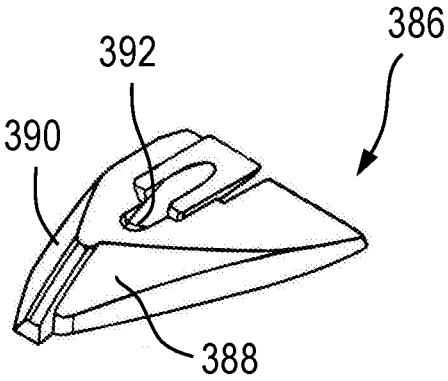

FIGS. 31 to 34B show a multi-stage expanding and collapsing system in accordance with an alternative embodiment of the invention. FIGS. 31 and 32 are respectively side views of the apparatus in a first, collapsed condition and second expanded condition. FIGS. 33A and 33B are respectively plan and isometric views of the a first set of elements of the apparatus; FIGS. 34A and 34B are respectively plan and isometric views of a second set of elements of the apparatus. The apparatus, generally shown at 380, is similar to the apparatus 170, 190, and 280, with a central ring structure 381 formed from an assembly of elements 384, and two pairs of ring structures 382*a*, 382*b* (together 382), 383*a* and 383*b* (together 383). The form and function of the apparatus will be understood from FIGS. 17 to 26 and the accompanying description. However, the apparatus 380 differs in that it comprises pairs of ring structures 382, 383 formed from individual elements with geometry different from those of previous embodiments.

FIGS. 33A and 33B are respectively plan and isometric views of an element 385, from which the outer ring structures 383*a*, 383*b* are assembled. FIGS. 34A and 35B are respectively plan and isometric views of an element 386, from which the intermediate ring structures 382*a*, 382*b* are assembled. The Figures show the outer surfaces, first contact surfaces, and interlocking tongues. The external profiles of the elements 385, 386 are modified by provision of additional chamfers 387, 388. These chamfers modify the external profile of the elements, so that when assembled into a ring, the inward facing flank (i.e. the flank facing the centre ring) has an at least partially smoothed conical surface. This facilitates the deployment of the apparatus; the smoother conical surface improves the sliding action of the elements the centre ring 381 on the conical profiles of the rings 382*a*, 382*b* as the elements are brought together to expand the centre ring. Similarly, the smoothed inward facing flank of the rings 383*a*, 383*b* facilitate the sliding of the elements 382*a* of the rings 382*a*, 383*b* during their expansion. The smoothed cones assist a supporting ring in punching under the adjacent ring with a smooth action, The outer surfaces 389, 390 of the elements 385, 386 are profiled such that the ring structures 382, 383 define smooth conical surfaces on their outward facing flanks when in their expanded condition. These conical surfaces combine in the assembled, expanded apparatus, to provide a substantially or fully smooth surface which is suitable for abutment with and/or support of an adjacent element such as an elastomer.

The elements 385, 386 also differ from the elements of previous embodiments of the invention in that the biasing means in the form of garter springs are not mounted in external grooves. Instead, apertures 391, 392 are provided in the elements for receiving the garter springs (or an alternative biasing means). The garter spring may be threaded through each segment and then joined to make a continuous loop upon assembly. By providing the biasing means inboard of the external surface, it may be better protected from damage. In addition, the external profile of the elements is simplified and is more supportive of adjacent elements. as supportive as possible. This configuration also facilitates location of the biasing means directly over the dovetail feature, so that the biasing force acts centrally to avoid canting and jamming.

It will be appreciated that "single stage" expansion apparatus, for example as described with reference to FIGS. 1 to 4, may be used in a patching tool and method of use. Indeed, in some applications this may desirable, as the resulting patched tubular can have an inner diameter close to the inner diameter of the fluid conduit that has been patched, mitigating the reduction to bore size. However, the patching tool 170 has the advantage of high expansion for a slim outer diameter profile, which enables the tool to be run through a restriction in the fluid conduit, to patch a damaged part of the conduit which has a larger inner diameter than the restriction. For example, the patching tool could be run through a part of the fluid conduit that has already been patched, either by conventional means or by a patching tool based on a single-stage expansion apparatus. Higher expansion ratio patching tools could be used, based on expansion apparatus having three or more stage deployment.

In the foregoing embodiments, where the expanding and collapsing apparatus is used to create a seal, the seal is typically disposed between two expanding ring structures. In alternative embodiments (not illustrated), an expanding ring structure can be used to provide a seal, or at least a restrictive flow barrier directly. To facilitate this, the elements which are assembled together to create the ring structures may be formed from a metal or a metal alloy which is fully or partially coated or covered with a polymeric, elastomeric or rubber material. An example of such a material is a silicone polymer coating. In one embodiment, all surfaces of the elements may be coated, for example by a dipping or spraying process, and the mutually supportive arrangement of the elements keeps them in compression in their operating condition. This enables the ring structures themselves to function as flow barriers, and in some applications, the seal created is sufficient to seal against differential pressures to create a seal.

Alternatively, or in addition, the elements themselves may be formed from a compressible and/or resilient material, such as an elastomer, rubber or polymer.

In a further alternative embodiment of the invention (not illustrated) the characteristics of the expanding/collapsing apparatus are exploited to provide a substrate which supports a seal or other deformable element. As described herein, the expanded ring structures of the invention provide a smooth circular cylindrical surface at their optimum expanded conditions. This facilitates their application as a functional endo-skeleton for a surrounding sheath. In one example application, a deformable elastomeric sheath is provided over an expanding ring structure 10, as described with reference to FIGS. 1 to 4. When in its collapsed condition, the sheath is supported by the collapsed ring structures. The ring structure are deployed in the manner described with reference to FIGS. 1 and 2, against the retaining force of the circumferential spring element and any additional retaining force provided by the sheath, and the sheath is deformed to expand with the ring structure into contact with the surrounding surface. The sheath is sandwiched between the smooth outer surface of the ring structure and the surrounding surface to create a seal.

Although the example above is described with reference to a single-stage expanding apparatus, it will be appreciated that a multistage expanding apparatus (for example the apparatus 170) could be used. In addition, the expanding apparatus may be used as an endo-skeleton to provide structural support for components other than deformable sheaths, including tubulars, expanding sleeves, locking formations and other components in fluid conduits or wellbores.

Additional applications of the principles of the invention include variable diameter tools. Examples will be described with reference to FIGS. 35A to 39B.

Figure 35A:
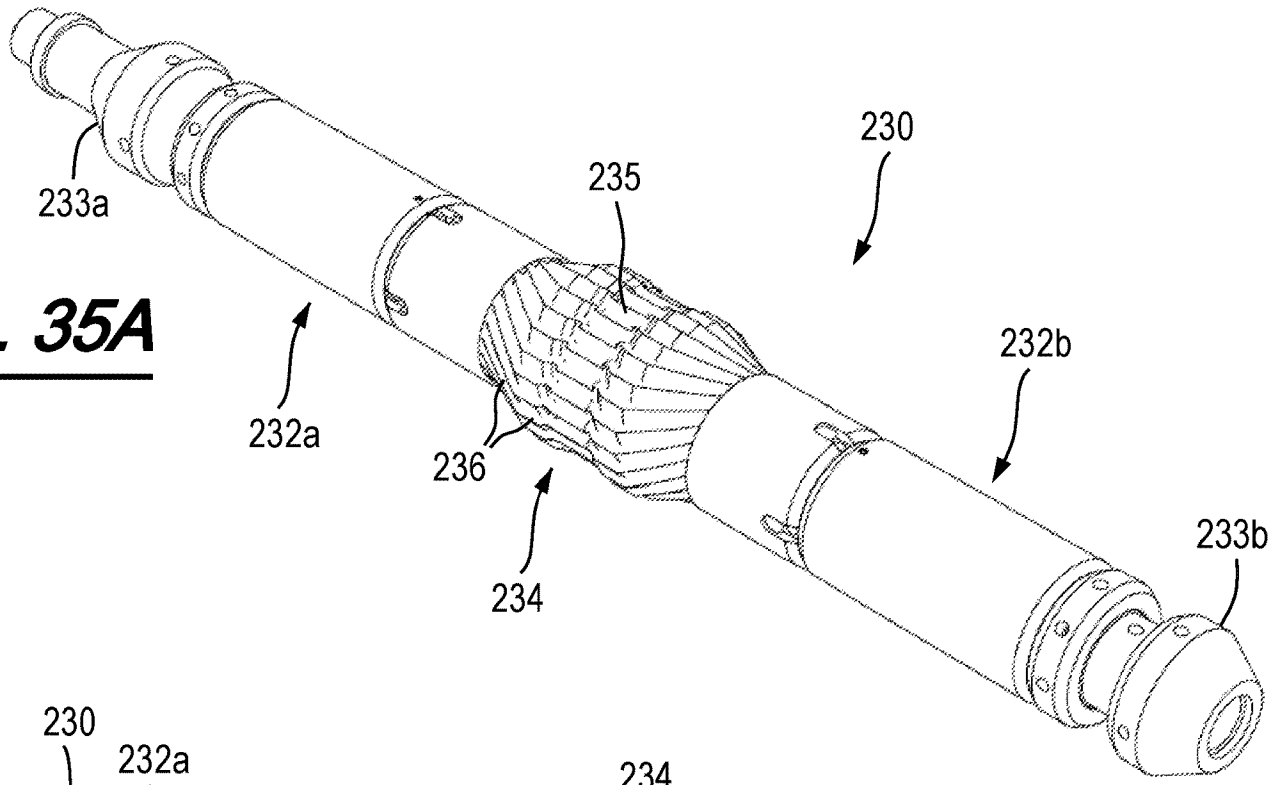
FIGS. 35A and 35B are respectively isometric and sectional views of a drift tool according to an embodiment of the invention, shown in a run position.
Figure 35B:
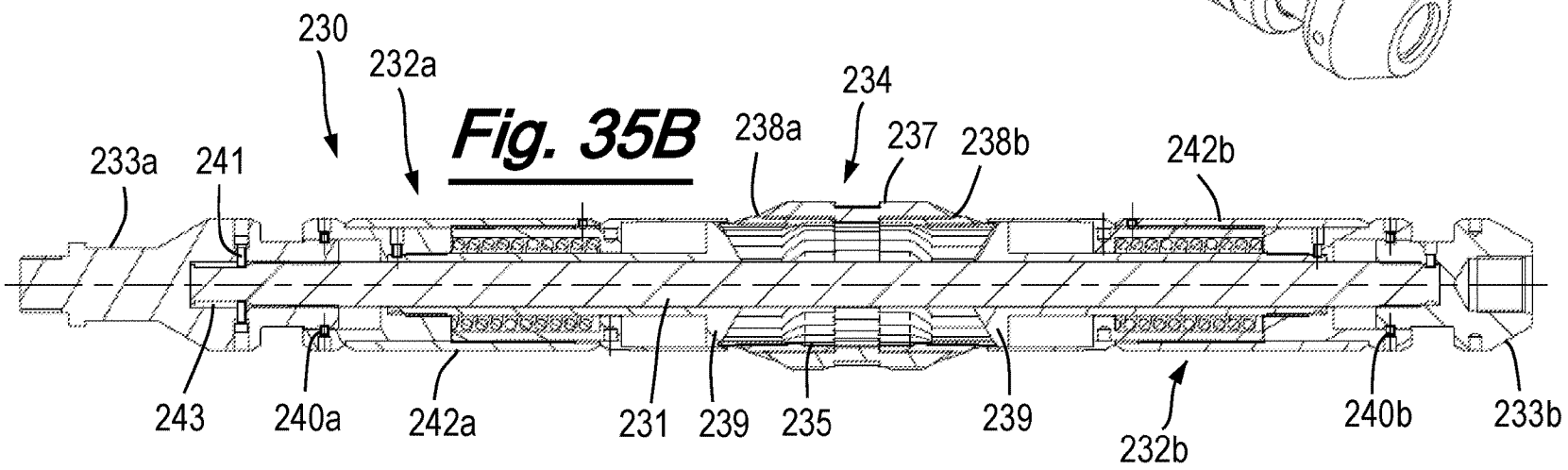
Figure 36A:
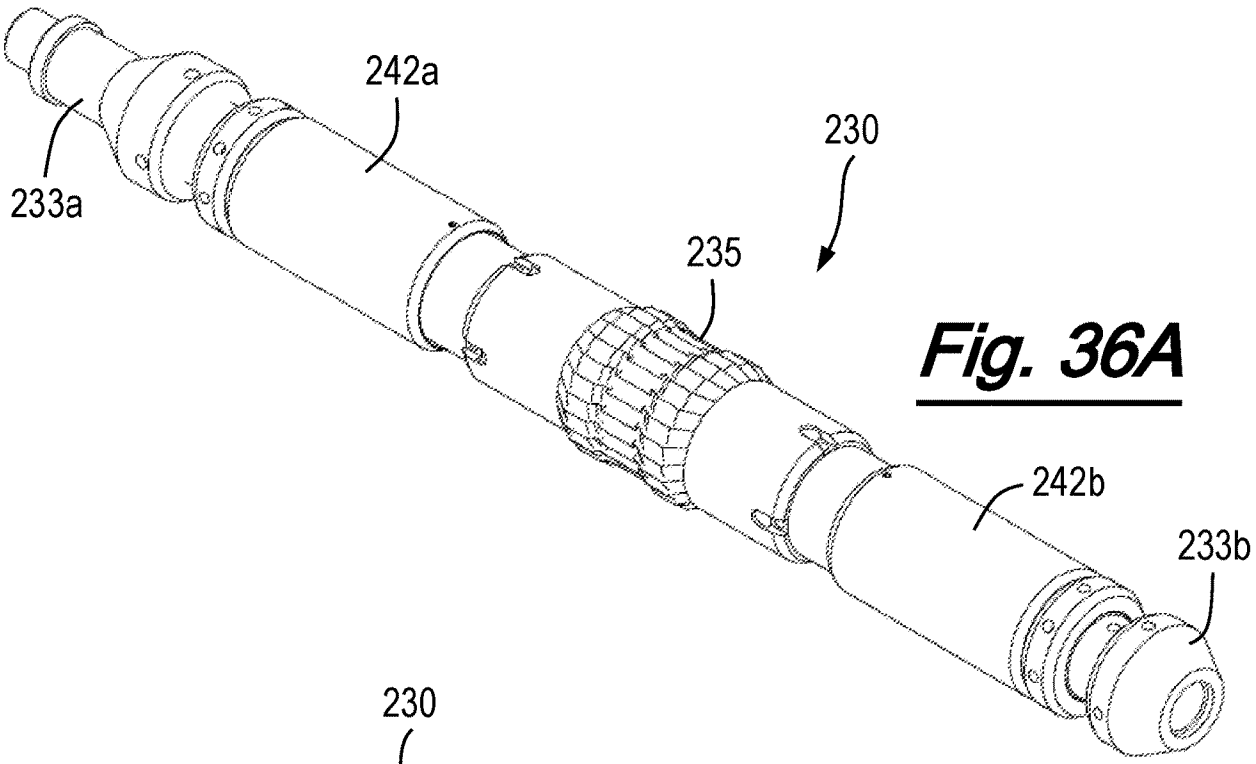
FIGS. 36A and 36B are respectively isometric and sectional views of the apparatus of FIGS. 35A and 35B, shown in an alternative run position.
Figure 36B:
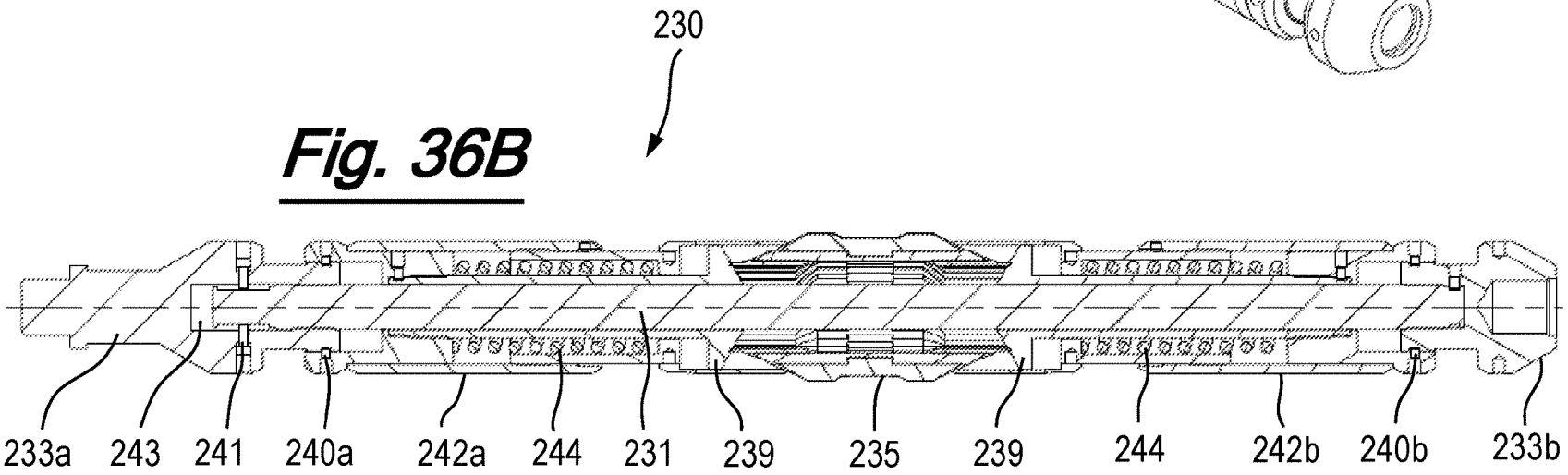
Figure 37A:
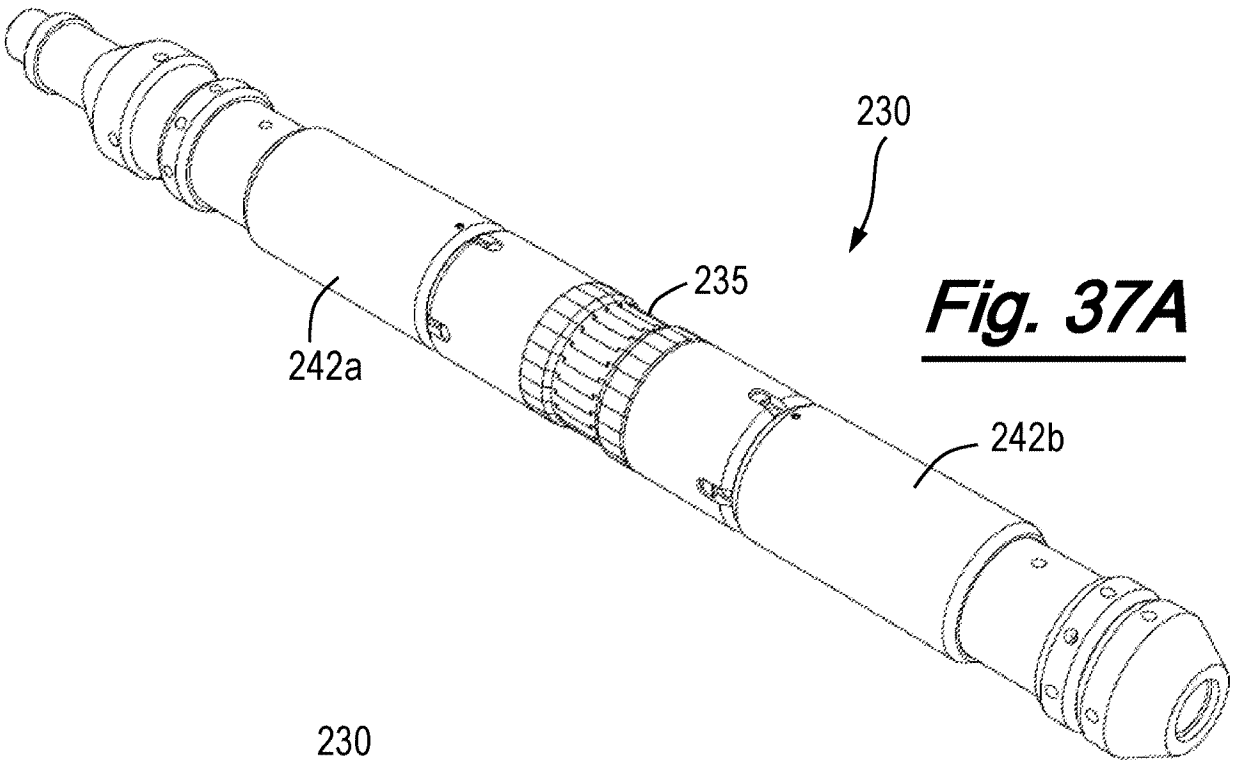
FIGS. 37A and 37B are respectively isometric and sectional views of the apparatus of FIGS. 35A and 35B, shown in a collapsed position.
Figure 37B:
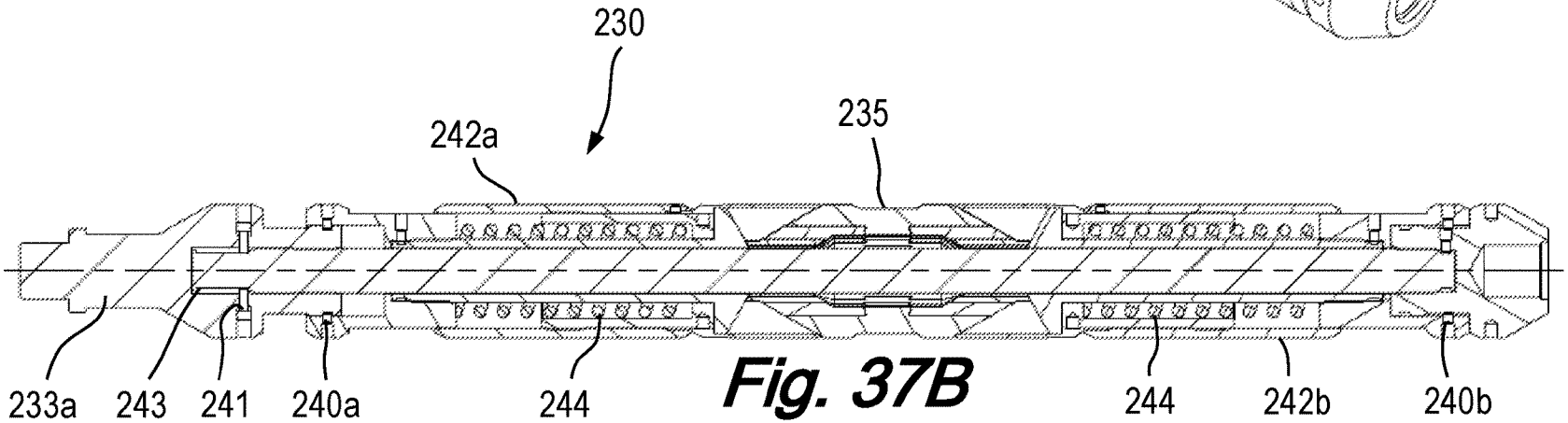

FIGS. 35A and 35B are respectively perspective and longitudinal sectional views of a variable diameter drift tool according to an embodiment of the invention, shown in a first run position. FIGS. 36A and 36B, are equivalent views of the drift tool in an alternative run position, and FIGS. 37A and 37B are equivalent views of the drift tool in a collapsed position.

The drift tool, generally depicted at 230, comprises a central core 231, upper and lower housings 232*a*, 232*b*, and upper and lower connectors 233*a*, 234*a* for connecting the tool to a tool string or other conveyance. Disposed between the upper and lower housings is an expanding and collapsing apparatus 234, which provides the variable diameter functionality of the tool. The expanding and collapsing apparatus 234 comprises a ring structure 235 assembled from a plurality of elements 236. The elements 236 are similar to the elements 12 and 77 of previous embodiments, and their assembly and expanding and collapsing functionality will be understood from FIGS. 1 to 4 and the accompanying text.

The elements 236 differ from the elements previously described in their outer profile. The elements are not, in this embodiment, designed to create a smooth outer ring surface, but instead are designed to present a fluted surface at their optimal and intermediate expanded positions. This is to permit fluid to pass the tool as it is being run in a wellbore in an expanded condition. In addition, the ring structure 235 defines a central portion 237, in which the ring surface is substantially parallel to the longitudinal axis of the tool, and upper and lower tapered portions 238*a*, 238*b*. The tapered portions facilitate the passage of the tool in the wellbore without being hung up on minor restrictions on the bore.

The upper and lower housings 232*a*, 232*b* define cone wedge profiles 239 which impart radial force components on the elements 236 from an axial actuation force during expansion of the ring structure 235. Upper and lower shear screws 240*a*, 240*b* secure the upper and lower housings to the core 231 via the connectors 233*a*, 233*b*.

The position and separation of the cone wedges 239 on the core 231 determines the expanded position of the ring structure 235 and the outer diameter of the tool. This can be adjusted by setting the position of the upper connector 233*a* with respect to the core 231 by means of locking screws or pins 241. Locking collars 242*a*, 242*b* are able to lock the position of the housing in the desired condition with respect to the ring structure.

In the position shown in FIGS. 35A and 35B, the core 231 is fully retracted into a bore 243 in the upper connector, which draws the upper and lower housings together and brings the wedge profiles 239 together. An axial force is imparted on the wedges 239 which is directed radially to the elements of the ring structure 235 to expand the ring structure to its maximum outer diameter.

In the position shown in FIGS. 36A and 36B, the core 231 is only partially retracted into the bore 243 in the upper connector, which partially lengthens the tool and enables the wedges 239 to be partially separated. This enables the elements of the ring structure 235 to partially collapse to an intermediate outer diameter under the force of a circumferential retaining spring (not shown). An axial force from coil springs 244 in the housings extends the housings to partially cover the tapered portions of the ring structure. Locking collars 242*a*, 242*b* are repositioned to lock position of the housing in the desired condition with respect to the ring structure.

It will be appreciated that in embodiments of the invention, the position of the core with respect to the upper connector may be adjusted continuously or to a number of discrete positions, to provide a continuously variable diameter, or a number of discrete diameters. The tool 230 is designed to be retrieved to surface to be adjusted, but other embodiments may comprise mechanisms for automated and/or remote adjustment of the core position and the outer diameter. Such variants may include an electric motor which actuates rotation of a threaded connection to change the relative position of the wedges and the diameter of the ring structure.

FIGS. 37A and 37B show the tool 230 in a collapsed condition, in which the ring structure is fully collapsed to be flush with the principle outer diameter of the tool housings. This collapsed position is actuated by a jar up force on the tool string. The jarring force acts through the core and shears through the lower shear screws 240*b*, disconnecting the lower housing from the lower connector. This enables downward movement of the lower housing with respect to the lower connector, and separates the wedges 239 to collapse the ring structure.

A jar-down collapse condition (not shown) can alternatively be created by imparting a jar down force on the tool. The downward force shears the upper shear screws 240*a*, disconnecting the upper housing from the upper connector. This enables upward movement of the upper housing with respect to the upper connector, and separates the wedges 239 to collapse the ring structure.

The tool 230 is configured as a drift tool, which is run to verify or investigate the drift diameter of a wellbore. The tool may also be configured as a centralising tool, which has variable diameter to set variable stand-off of a tool string.

Figure 38A:
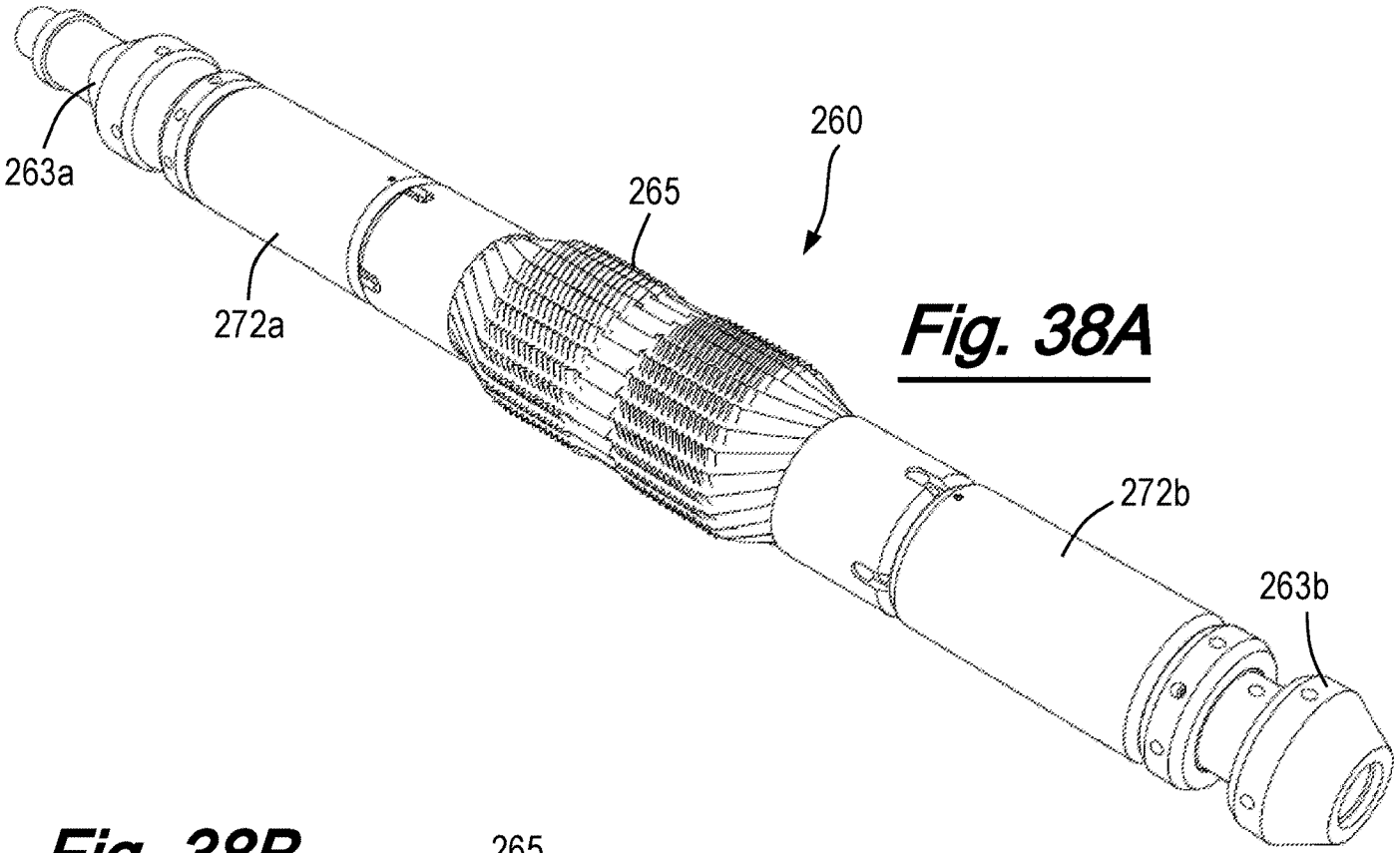
FIGS. 38A and 38B are respectively isometric and sectional views of a broaching tool apparatus according to an embodiment of the invention, shown in a run position.
Figure 38B:
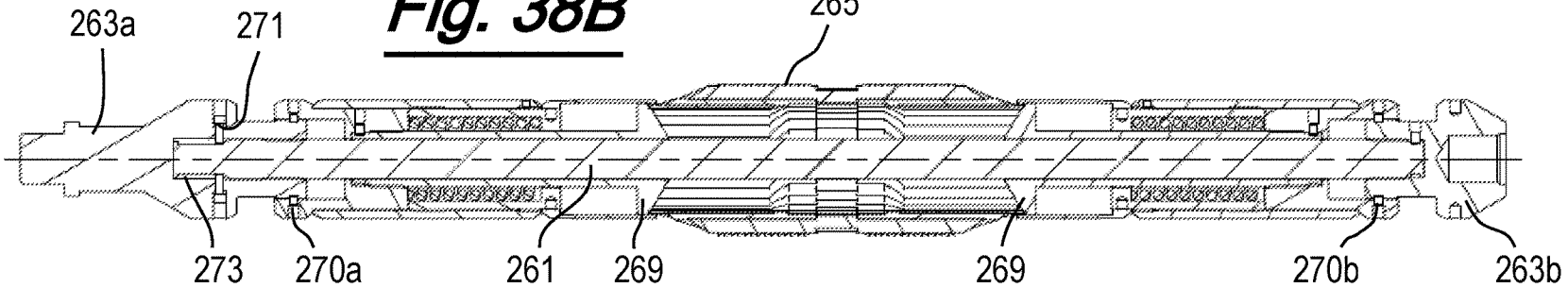
Figure 39A:
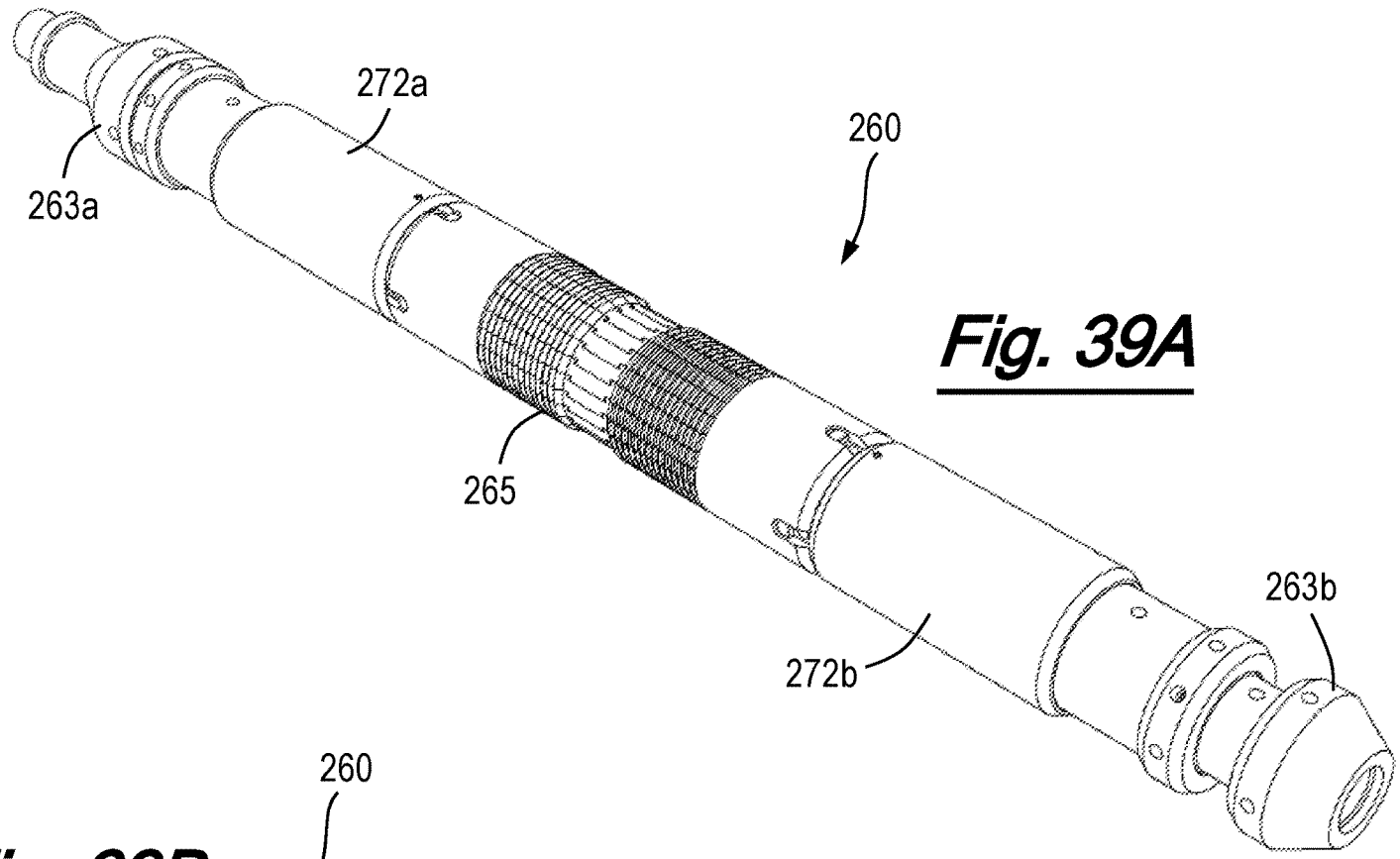
FIGS. 39A and 39B are respectively isometric and sectional views of the apparatus of FIGS. 38A and 38B, shown in a collapsed position.
Figure 39B:
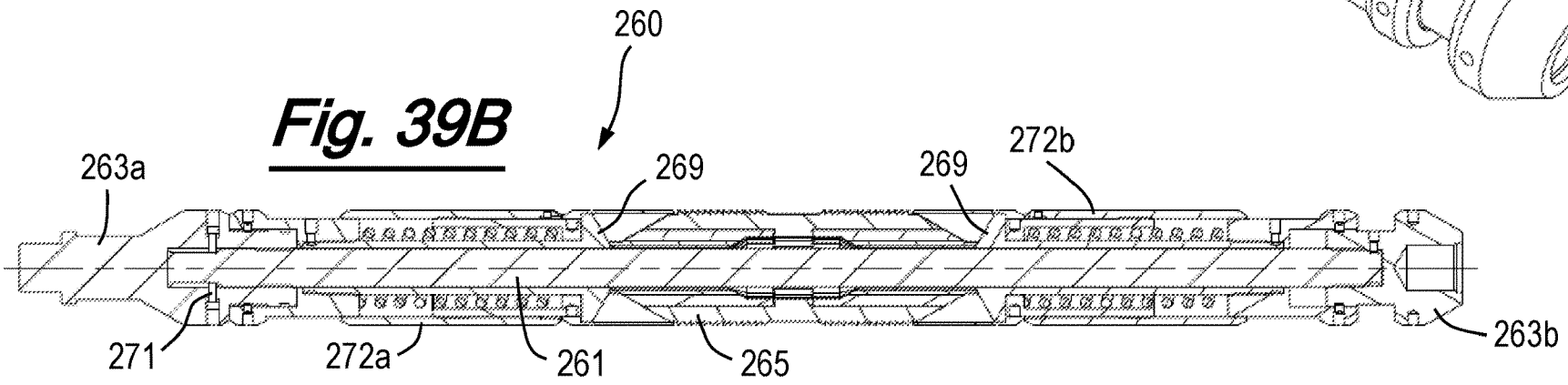

A further variation is described with reference to FIGS. 38A to 39B. FIGS. 38A and 38B are respectively perspective and longitudinal sectional views of a variable diameter wellbore broaching tool, generally depicted at 260, according to an embodiment of the invention, shown in a first run position. FIGS. 39A and 39B, are equivalent views of the tool in a collapsed position.

The wellbore broaching tool 260 is similar to the drift tool 230, with like components indicated by like reference numerals incremented by 30. In this embodiment, the outer surfaces of the elements 266 which make up the ring structure are provided with abrasive cutting formations or teeth, which are designed to remove material from the inner surface of a wellbore.

The position and separation of the cone wedges 269 on the core 261 determines the expanded position of the ring structure 265 and the outer diameter of the tool. This can be adjusted by setting the position of the upper connector 263*a* with respect to the core 261 by means of locking screws or pins 261. Locking collars 262*a*, 262*b* are able to lock the position of the housing in the desired condition with respect to the ring structure.

In common with the previous embodiment of the invention, the position of the core with respect to the upper connector may be adjusted continuously or to a number of discrete positions, to provide a continuously variable diameter, or a number of discrete diameters. The tool 260 is designed to be retrieved to surface to be adjusted, but other embodiments may comprise mechanisms for automated and/or remote adjustment of the core position and the outer diameter.

A further application of the invention is to a variable diameter centralising and/or stabilising tool, which may be used in a variety of downhole applications with non-sealing devices. These include, but are not limited to, drilling, milling and cutting devices. The tool may be similar to the drift tool 230 and the broaching tool 260, with the outer surface of the elements designed to contact and engage with a borehole wall at a location axially displaced from (for example) a drill bit, milling head, or cutting tool. The tool may be provided with a bearing assembly to facilitate rotation of a mandrel with respect to the expanding ring structure, or to permit rotation of a drilling, milling or cutting tool. The diameter of the tool can be controlled to provide a centralising and/or stabilising engagement force to support the wellbore operation. The invention can be used in a similar manner to stabilise, centre, or anchor a range of non-sealing devices or tools.

The invention provides an expanding and collapsing apparatus and methods of use. The apparatus comprises a plurality of elements assembled together to form a ring structure oriented in a plane around a longitudinal axis. The ring structure is operable to be moved between an expanded condition and a collapsed condition on actuation by an axial force. The plurality of elements are operable to be moved between the expanded and collapsed conditions by sliding with respect to one another in the plane of the ring structure.

The invention provides an expanding and/or collapsing apparatus and a method of use. The apparatus comprises a plurality of elements assembled together to form a ring structure oriented in a plane around a longitudinal axis. The ring structure is operable to be moved between an expanded condition and a collapsed condition by movement of the plurality of elements on actuation by an axial force. The plurality of elements is operable to be moved between the expanded and collapsed conditions by sliding with respect to one another in the plane of the ring structure, in a direction tangential to a circle concentric with the ring structure. Applications of the invention include oilfield devices, including anti-extrusion rings, plugs, packers, locks, patching tools, connection systems, and variable diameter tools run in a wellbore.

The invention in its various forms benefits from the novel structure and mechanism of the apparatus. At an optimal expansion condition, shown in FIGS. 2B and 2D, the outer surfaces of the individual elements combine to form a complete circle with no gaps in between the individual elements, and therefore the apparatus can be optimised for a specific diameter, to form a perfectly round expanded ring (within manufacturing tolerances) with no extrusion gaps on the inner or outer surfaces of the ring structure. The design of the expansion apparatus also has the benefit that a degree of under expansion or over expansion (for example, to a slightly different radial position) does not introduce significantly large gaps.

It is a feature of the invention that the elements are mutually supported before, throughout, and after the expansion, and do not create gaps between the individual elements during expansion or at the fully expanded position. In addition, the arrangement of elements in a circumferential ring, and their movement in a plane perpendicular to the longitudinal axis, facilitates the provision of smooth side faces or flanks on the expanded ring structure. With deployment of the elements in the plane of the ring structure, the width of the ring structure does not change. This enables use of the apparatus in close axial proximity to other functional elements.

In addition, each of the ring structures provides a smooth, unbroken circumferential surface which may be used in engagement or anchoring applications, including in plugs, locks, and connectors. This may provide an increased anchoring force, or full abutment with upper and lower shoulders defined in a locking or latching profile, enabling tools or equipment be rated to a higher maximum working pressure. The invention also enables high expansion applications.

Various modifications to the above-described embodiments may be made within the scope of the invention, and the invention extends to combinations of features other than those expressly claimed herein. In particular, the different embodiments described herein may be used in combination, and the features of a particular embodiment may be used in applications other than those specifically described in relation to that embodiment.

The invention claimed is:

1. An apparatus comprising:

a plurality of elements assembled together to form a ring structure oriented in a plane around a longitudinal axis;

wherein the ring structure is operable to be moved between an expanded condition and a collapsed condition by movement of the plurality of elements on actuation by an axial force;

wherein each element of the ring structure comprises a first contact surface and a second contact surface, where each first contact surface abuts a first adjacent element and each second contact surface abuts a second adjacent element;

and wherein the plurality of elements is operable to be moved between the expanded and collapsed conditions by sliding with respect to one another in the plane of the ring structure, in a direction tangential to a circle concentric with the ring structure.

2. The apparatus according to claim 1, wherein the ring structure comprises one or more ring surfaces configured to be presented to an auxiliary surface when actuated to the expanded condition or the collapsed condition.

3. The apparatus according to claim 2, wherein the ring surface is a substantially cylindrical surface arranged to contact or otherwise interact with an inner surface of a tubular or bore.

4. The apparatus according to claim 2, wherein the ring surface is substantially smooth.

5. The apparatus according to claim 2, wherein the ring surface is provided with one or more functional formations thereon, for interacting with an auxiliary surface.

6. The apparatus according to claim 1, wherein the elements are configured to move between their expanded and collapsed conditions in a path which is tangential to a circle described around and concentric with the longitudinal axis.

7. The apparatus according to claim 1, wherein the elements are configured to slide relative to one another along their respective contact surfaces.

8. The apparatus according to claim 7, wherein the first contact surface and/or the second contact surface are oriented tangentially to a circle described around and concentric with the longitudinal axis.

9. The apparatus according to claim 7, wherein the first contact surface and the second contact surface converge towards one another in a direction towards an inner surface of the ring structure.

10. The apparatus according to claim 1, wherein the elements are provided with interlocking profiles for interlocking with an adjacent element.

11. The apparatus according to claim 10, wherein the elements are configured to slide relative to one another along their respective contact surfaces; and wherein the interlocking profiles are formed in the first contact surface and/or the second contact surface, and each element is configured to interlock with an adjacent element such that contact surfaces of respective elements are in abutment.

12. The apparatus according to claim 1, wherein the apparatus comprises a support surface for the ring structure, wherein the support surface is an outer surface of a mandrel or tubular, and wherein the support surface supports the ring structure in the collapsed condition of the apparatus.

13. The apparatus according to claim 1, wherein the apparatus comprises a support surface for the ring structure, wherein the support surface is an inner surface of a mandrel or tubular, and wherein the support surface supports the ring structure in the expanded condition of the apparatus.

14. The apparatus according to claim 1, wherein the apparatus is operated in its expanded condition, and elements forming the ring structure are mutually supportive in the expanded condition of the apparatus.

15. The apparatus according to claim 1, wherein an operating condition of the apparatus is its expanded condition, wherein the ring structure is a substantially solid ring structure in the expanded condition, and wherein the elements are fully mutually supported in the expanded condition.

16. The apparatus according to claim 1, wherein an operating condition of the apparatus is its collapsed condition, wherein the ring structure is a substantially solid ring structure in the collapsed condition, and wherein the elements are fully mutually supported in the in the collapsed condition.

17. The apparatus according to claim 1, comprising a formation configured to impart a radial expanding or collapsing force component to the elements of the ring structure from an axial actuation force.

18. The apparatus according to claim 1, comprising a biasing means configured to bias the ring structure to one of its expanded or collapsed conditions.

19. The apparatus according to claim 1, comprising a secondary expanding and collapsing mechanism operable to move the ring structure between a first expanded condition to a second expanded condition on actuation by the axial force.

20. The apparatus according to claim 1, wherein the ring structure is a first ring structure, and the apparatus comprises at least one additional ring structure, wherein the additional ring structure is operable to move the first ring structure from an intermediate expanded condition to a fully expanded condition.

21. The apparatus according to claim 20, wherein the ring structure is a first ring structure, and the apparatus comprises at least one pair of additional ring structures, wherein the pair of additional ring structures is operable to move the first ring structure from an intermediate expanded condition to a fully expanded condition.

22. The apparatus according to claim 20, wherein a plurality of elements of the additional ring structure is operable to be moved between expanded and collapsed conditions by sliding with respect to one another in a plane of the additional ring structure, in a direction tangential to a circle concentric with the additional ring structure.

23. The apparatus according to claim 20, comprising a plurality of additional ring structures arranged in functional pairs, operable to move the first ring structure from an intermediate expanded condition to a subsequent intermediate expanded condition, or a fully expanded condition.

24. An oilfield tool comprising the apparatus of claim 1.

25. The oilfield tool according to claim 24, configured as a downhole tool selected from the group consisting of: a plug, a packer, an anchor, a tubing hanger, or a downhole locking tool.

26. The oilfield tool according to claim 25, configured as a retrievable bridge plug.

27. The oilfield tool according to claim 25, configured as a permanent plug.

28. A variable diameter downhole tool comprising an apparatus according to claim 1.

29. The variable diameter downhole tool according to claim 28, selected from the group consisting of a wellbore centraliser, a wellbore broach tool, and a wellbore drift tool.

30. A connector system comprising a first connector and a second connector, wherein one of the first connector and the second connector comprises the apparatus of claim 1.

31. A patch apparatus for a fluid conduit or tubular, the patch apparatus comprising the apparatus of claim 1.

32. A method of expanding an apparatus, the method comprising:

providing an apparatus comprising a plurality of elements assembled together to form a ring structure oriented in a plane around a longitudinal axis, wherein each element of the ring structure comprises a first contact surface and a second contact surface, where each first contact surface abuts a first adjacent element and each second contact surface abuts a second adjacent element; and imparting an axial force to the ring structure to move the plurality of elements by sliding with respect to one another in the plane of the ring structure, in a direction tangential to a circle concentric with the ring structure; thereby moving the ring structure from a collapsed condition to an expanded condition.

33. A method of collapsing an apparatus, the method comprising:

providing an apparatus comprising a plurality of elements assembled together to form a ring structure oriented in a plane around a longitudinal axis, wherein each element of the ring structure comprises a first contact surface and a second contact surface, where each first contact surface abuts a first adjacent element and each second contact surface abuts a second adjacent element; and releasing or reducing an axial force from the ring structure to move the plurality of elements by sliding with respect to one another in the plane of the ring structure, in a direction tangential to a circle concentric with the ring structure, thereby moving the ring structure from an expanded condition to a collapsed condition.

* * * * *